US010314766B2

(12) United States Patent
Terhune et al.

(10) Patent No.: US 10,314,766 B2
(45) Date of Patent: Jun. 11, 2019

(54) MEDICATION PACKAGING AND DOSE REGIMEN SYSTEM

(71) Applicant: MYLAN Inc., Canonsburg, PA (US)

(72) Inventors: JoAnna Terhune, Pittsburgh, PA (US); Jeffrey Warden, Bala Cynwyd, PA (US); Chad Holland, Wexford, PA (US); Eric Richardson, Cave Creek, AZ (US)

(73) Assignee: Mylan, Inc., Canonsburg, PA (US)

( * ) Notice: Subject to any disclaimer, the term of this patent is extended or adjusted under 35 U.S.C. 154(b) by 0 days.

(21) Appl. No.: 15/544,657

(22) PCT Filed: Jan. 20, 2016

(86) PCT No.: PCT/US2016/014095
§ 371 (c)(1),
(2) Date: Jul. 19, 2017

(87) PCT Pub. No.: WO2016/118605
PCT Pub. Date: Jul. 28, 2016

(65) Prior Publication Data

US 2018/0000691 A1 Jan. 4, 2018

Related U.S. Application Data

(60) Provisional application No. 62/105,877, filed on Jan. 21, 2015, provisional application No. 62/209,525, filed on Aug. 25, 2015.

(51) Int. Cl.
*A61J 7/00* (2006.01)
*A61J 1/03* (2006.01)
(Continued)

(52) U.S. Cl.
CPC ..... *A61J 7/0084* (2013.01); *A61J 1/035* (2013.01); *A61J 1/16* (2013.01); *A61J 7/0076* (2013.01);
(Continued)

(58) Field of Classification Search
CPC ..... A61J 1/03; A61J 1/035; A61J 1/16; A61J 7/00; A61J 7/0084; A61J 7/04;
(Continued)

(56) References Cited

U.S. PATENT DOCUMENTS 2,415,859 A 2/1947 Ancker
2,589,735 A 3/1952 Salfisburg
(Continued)

OTHER PUBLICATIONS

International Search Report and Written Opinion of the International Searching Authority dated May 2, 2016 and mailed Jun. 3, 2016 of International PCT Application No. PCT/US2016/014095 filed on Jan. 20, 2016.

*Primary Examiner* — Bryon P Gehman
(74) *Attorney, Agent, or Firm* — Sorell, Lenna & Schmidt, LLP

(57) ABSTRACT

A medicament dispensing container includes a first wall connected with a second wall and defines a cavity therebetween. The walls are movable between an open configuration and a closed configuration. At least one member is disposable in the cavity and defines at least one dose receptacle configured for disposal of at least one dose of at least one medication. At least one fixation member connects the at least one member to at least one of the walls such that the at least one member is movable relative to the wall. Systems and methods of use are disclosed.

12 Claims, 42 Drawing Sheets

(51) Int. Cl.

| | |
|---|---|
| ***A61J 1/16*** | (2006.01) |
| ***A61J 7/04*** | (2006.01) |
| ***B65D 83/04*** | (2006.01) |
| ***B42F 7/08*** | (2006.01) |
| ***B65D 21/02*** | (2006.01) |
| ***B65D 77/04*** | (2006.01) |
| ***B65D 77/22*** | (2006.01) |
| ***B65D 5/00*** | (2006.01) |

(52) U.S. Cl.
CPC ..... *A61J 7/04* (2013.01); *B42F 7/08* (2013.01); *B65D 5/00* (2013.01); *B65D 21/0209* (2013.01); *B65D 77/042* (2013.01); *B65D 77/0446* (2013.01); *B65D 77/22* (2013.01); *B65D 83/0463* (2013.01); *A61J 2200/30* (2013.01); *A61J 2205/30* (2013.01)

(58) Field of Classification Search
CPC .. A61J 2200/30; A61J 2205/30; A61J 7/0076; B42F 7/08; B65D 21/02; B65D 21/0209; B65D 77/04; B65D 77/042; B65D 77/0446; B65D 77/22; B65D 83/04; B65D 83/0463; B65D 5/00
USPC ..... 206/531–534
See application file for complete search history.

(56) References Cited

U.S. PATENT DOCUMENTS

| | | | |
|---|---|---|---|
| 3,054,503 | A | 9/1962 | Hartman, Jr. et al. |
| 3,199,489 | A | 8/1965 | Ruoss et al. |
| 3,279,651 | A | 10/1966 | Thompson |
| 3,283,885 | A | 11/1966 | Grunewald et al. |
| 3,305,077 | A | 2/1967 | Greif et al. |
| 3,324,996 | A | 6/1967 | Jordt |
| 3,367,535 | A | 2/1968 | Tanguay |
| 3,387,699 | A | 6/1968 | Heller |
| 3,472,367 | A | 10/1969 | Hellstrom |
| 3,530,818 | A | 9/1970 | Secondino |
| 3,567,013 | A | 3/1971 | Tannenbaum |
| 3,579,883 | A | 5/1971 | Hayes |
| 3,587,517 | A | 6/1971 | Fites et al. |
| 3,630,171 | A | 12/1971 | Huck |
| 3,630,346 | A | 12/1971 | Burnside |
| 3,659,706 | A | 5/1972 | Serrell |
| 3,722,739 | A | 3/1973 | Blumberg |
| 3,809,221 | A | 5/1974 | Compere |
| 3,835,995 | A | 9/1974 | Haines |
| 3,856,144 | A | 12/1974 | Kelly |
| 3,904,075 | A | 9/1975 | Richardson et al. |
| 3,912,081 | A | 10/1975 | Haines et al. |
| 3,921,805 | A | 11/1975 | Compere |
| 3,924,746 | A | 12/1975 | Haines |
| 3,924,747 | A | 12/1975 | Gerner |
| 4,078,660 | A | 3/1978 | Lerro |
| RE29,705 | E | 7/1978 | Compere |
| 4,158,411 | A | 6/1979 | Hall et al. |
| 4,196,809 | A | 4/1980 | Tonrey |
| 4,280,621 | A | 7/1981 | Tonrey |
| 4,295,567 | A | 10/1981 | Knudsen |
| 4,340,141 | A | 7/1982 | Fischer |
| 4,384,649 | A | 5/1983 | Brodsky |
| 4,429,792 | A | 2/1984 | Machbitz |
| 4,483,626 | A | 11/1984 | Noble |
| 4,526,474 | A | 7/1985 | Simon |
| 4,534,468 | A | 8/1985 | Nuckols et al. |
| 4,537,312 | A | 8/1985 | Intini |
| 4,574,954 | A | 3/1986 | Reid |
| 4,588,090 | A | 5/1986 | Spuck et al. |
| 4,616,316 | A | 10/1986 | Hanpeter et al. |
| 4,627,432 | A | 12/1986 | Newell et al. |
| 4,662,537 | A | 5/1987 | Wolf et al. |
| 4,664,262 | A | 5/1987 | White |
| 4,736,849 | A | 4/1988 | Leonard et al. |
| 4,817,819 | A | 4/1989 | Kelly |
| 4,889,236 | A | 12/1989 | Bartell et al. |
| 4,911,327 | A | 3/1990 | Shepherd et al. |
| 4,955,481 | A | 9/1990 | Novinski et al. |
| 4,974,729 | A | 12/1990 | Steinnagel |
| 4,988,004 | A | 1/1991 | Intini |
| 5,014,851 | A | 5/1991 | Wick |
| 5,046,618 | A | 9/1991 | Wood |
| 5,050,739 | A | 9/1991 | Hannan et al. |
| 5,181,189 | A | 1/1993 | Hafner |
| 5,236,749 | A | 8/1993 | Ewing |
| 5,244,091 | A | 9/1993 | Tannenbaum |
| 5,265,728 | A | 11/1993 | Allendorf et al. |
| 5,310,060 | A | 5/1994 | Bitner et al. |
| 5,323,907 | A | 6/1994 | Kalvelage |
| 5,332,096 | A | 7/1994 | Battaglia |
| 5,339,960 | A | 8/1994 | Price |
| 5,358,118 | A | 10/1994 | Thompson et al. |
| 5,360,116 | A | 11/1994 | Schmiletzky |
| 5,405,011 | A | 4/1995 | Haber et al. |
| 5,412,372 | A | 5/1995 | Parkhurst et al. |
| 5,469,968 | A | 11/1995 | Matthews et al. |
| 5,486,390 | A | 1/1996 | Burns et al. |
| 5,489,025 | A | 2/1996 | Romick |
| 5,511,665 | A | 4/1996 | Dressel et al. |
| 5,522,506 | A | 6/1996 | Roulin et al. |
| 5,549,204 | A | 8/1996 | Toren |
| 5,560,490 | A | 10/1996 | Chawla |
| 5,562,232 | A | 10/1996 | Pearson |
| 5,613,609 | A | 3/1997 | Hamilton et al. |
| 5,624,036 | A | 4/1997 | Roulin et al. |
| D384,283 | S | 9/1997 | Davies et al. |
| 5,673,793 | A | 10/1997 | Seidler |
| 5,695,063 | A | 12/1997 | Roulin et al. |
| 5,758,774 | A | 6/1998 | Leblong |
| 5,775,505 | A | 7/1998 | Vasquez et al. |
| 5,794,781 | A | 8/1998 | Roulin et al. |
| D398,521 | S | 9/1998 | Coe |
| 5,816,404 | A | 10/1998 | Seidler |
| 5,819,940 | A | 10/1998 | Roulin et al. |
| 5,878,885 | A | 3/1999 | Wangu et al. |
| 5,878,888 | A | 3/1999 | Faughey et al. |
| 5,904,249 | A | 5/1999 | Roulin et al. |
| 5,911,325 | A | 6/1999 | Breitler |
| 5,915,558 | A | 6/1999 | Girvetz |
| 5,954,204 | A | 9/1999 | Grabowski |
| 5,988,429 | A | 11/1999 | Coe |
| 6,021,392 | A | 2/2000 | Lester et al. |
| 6,024,222 | A | 2/2000 | Friberg et al. |
| 6,036,016 | A | 3/2000 | Arnold |
| 6,062,420 | A | 5/2000 | Krouwel et al. |
| 6,082,544 | A | 7/2000 | Romick |
| 6,098,835 | A | 8/2000 | Dejonge |
| 6,155,423 | A | 12/2000 | Katzner et al. |
| 6,155,424 | A | 12/2000 | Dubach |
| 6,161,699 | A | 12/2000 | Gartland |
| 6,219,997 | B1 | 4/2001 | Friberg et al. |
| 6,253,920 | B1 | 7/2001 | Källgren |
| 6,279,736 | B1 | 8/2001 | Hekal |
| 6,301,196 | B1 | 10/2001 | Daniel |
| 6,338,408 | B1 | 1/2002 | Anderson |
| 6,349,831 | B1 | 2/2002 | Buss |
| 6,352,158 | B1 | 3/2002 | Cole-Bennett et al. |
| 6,364,155 | B1 | 4/2002 | Wolfe |
| 6,375,956 | B1 | 4/2002 | Hermelin et al. |
| 6,401,926 | B1 | 6/2002 | Lo |
| 6,411,567 | B1 | 6/2002 | Niemiec et al. |
| 6,412,636 | B1 | 7/2002 | Jones et al. |
| 6,422,391 | B1 | 7/2002 | Swartz |
| 6,460,693 | B1 | 10/2002 | Harrold |
| 6,516,949 | B2 | 2/2003 | Fuller et al. |
| 6,540,081 | B2 | 4/2003 | Balz et al. |
| 6,574,166 | B2 | 6/2003 | Niemiec |
| 6,601,876 | B1 | 8/2003 | Instance |
| 6,641,031 | B2 | 11/2003 | Evans et al. |
| 6,675,972 | B2 | 1/2004 | Patterson |
| 6,708,826 | B1 | 3/2004 | Ginsberg et al. |
| 6,752,272 | B2 | 6/2004 | Jones et al. |

(56) References Cited

U.S. PATENT DOCUMENTS 6,802,422 B2 10/2004 Kalvelage et al.
6,830,153 B2 12/2004 French et al.
6,832,686 B2 12/2004 Donegan
6,854,618 B2 2/2005 Harrold
6,874,652 B2 4/2005 Christensen et al.
6,896,138 B2 5/2005 Rock et al.
6,988,618 B2 1/2006 Dejonge
7,000,768 B2 2/2006 Morita et al.
7,000,769 B2 2/2006 Killinger et al.
7,051,876 B2 5/2006 Grosskopf
7,113,101 B2 9/2006 Petersen et al.
7,126,879 B2 10/2006 Snyder
7,150,355 B2 12/2006 Coe et al.
7,175,044 B2 2/2007 Benktzon et al.
7,188,728 B2 3/2007 Williams-Hartman
7,188,729 B2 3/2007 Dejonge
7,243,797 B2 7/2007 Donegan
7,243,798 B2 7/2007 Buss et al.
7,252,208 B1 8/2007 Alvino et al.
7,264,137 B2 9/2007 Drought et al.
7,284,661 B1 10/2007 Evans et al.
7,295,890 B2 11/2007 Jean-Pierre
7,325,689 B2 2/2008 Buss
7,331,460 B2 2/2008 Barndt et al.
7,336,564 B2 2/2008 Feodoroff
7,360,652 B2 4/2008 Arnold
7,377,394 B2 5/2008 Buss et al.
7,387,206 B2 6/2008 Grosskopf
7,395,928 B2 7/2008 Bertsch et al.
7,401,702 B2 7/2008 Hession
7,464,819 B2 12/2008 Maietta
7,481,331 B2 1/2009 Webster et al.
7,489,594 B2 2/2009 Simon et al.
7,494,012 B1 2/2009 Priebe et al.
7,497,331 B2 3/2009 Pham
7,542,379 B2 6/2009 Kimel et al.
7,552,824 B2 6/2009 Le et al.
7,584,849 B2 9/2009 Mauk et al.
7,588,149 B2 9/2009 Gelardi
D601,337 S 10/2009 Hale
7,623,040 B1 11/2009 Cote
7,644,822 B2 1/2010 Elliott
7,658,287 B2 2/2010 Hession
7,699,174 B2 4/2010 Allison et al.
7,726,485 B2 6/2010 Brollier
7,748,535 B2 7/2010 Grosskopf
7,784,250 B2 8/2010 Grosskopf
7,802,682 B2 9/2010 Bitner
7,828,149 B2 11/2010 Kalvelage et al.
7,866,476 B2 1/2011 McGonagle et al.
7,926,660 B2 4/2011 Jones et al.
7,938,265 B2 5/2011 Bitner
7,967,143 B2 6/2011 Paliotta et al.
7,987,985 B2 8/2011 Ede et al.
7,997,411 B2 8/2011 Williams-Hartman
8,011,512 B2 9/2011 Brollier et al.
8,038,008 B2 10/2011 Bitner
8,079,475 B2 12/2011 McArthur et al.
8,085,135 B2 12/2011 Alloro et al.
8,091,708 B2 1/2012 Loftin et al.
8,091,790 B2 1/2012 Mickle et al.
8,154,390 B2 4/2012 Heath et al.
8,181,772 B2 5/2012 Short et al.
8,214,077 B2 7/2012 Bertrand et al.
8,220,636 B2 7/2012 Beecroft et al.
8,251,219 B1 8/2012 Lewis
8,312,993 B2 11/2012 Sams et al.
8,317,026 B2 11/2012 Hession et al.
8,333,280 B2 12/2012 Le
8,342,331 B2 1/2013 Ziemba et al.
8,392,220 B2 3/2013 Knowlton et al.
8,413,813 B2 4/2013 Grosskopf
8,443,977 B2 5/2013 Killinger et al.
8,444,006 B2 5/2013 Dixon
8,508,346 B2 8/2013 Heath et al.
8,544,650 B2 10/2013 Williams-Hartman
8,552,868 B1 10/2013 Ferguson
8,556,077 B1 10/2013 Hanley
8,567,606 B2 10/2013 Bellamah et al.
8,573,403 B2 11/2013 Stevens et al.
8,607,982 B2 12/2013 Jones
8,627,957 B2 1/2014 Ziemba et al.
8,672,130 B2 3/2014 Aldridge
8,679,605 B2 3/2014 Stevenson
8,689,978 B2 * 4/2014 Flood ..... A61J 1/03 206/531
8,701,889 B2 4/2014 Sams et al.
9,414,993 B2 * 8/2016 Flynn ..... A61J 7/0069
2001/0017273 A1 8/2001 Raj et al.
2002/0066690 A1 6/2002 Mattis et al.
2003/0024849 A1 2/2003 Nielsen et al.
2003/0111380 A1 6/2003 Taneja et al.
2003/0168376 A1 9/2003 Taneja et al.
2003/0209558 A1 11/2003 Cross
2004/0026293 A1 2/2004 Hughes
2004/0050746 A1 3/2004 Dunlop et al.
2004/0188312 A1 9/2004 Stepowany
2004/0188315 A1 9/2004 Morita et al.
2004/0256277 A1 12/2004 Gedanke
2005/0051454 A1 3/2005 Coe et al.
2005/0082194 A1 4/2005 Fry et al.
2005/0109658 A1 5/2005 Bindford
2005/0139506 A1 6/2005 Lorenzato
2005/0150897 A1 7/2005 Fabricius et al.
2005/0162979 A1 7/2005 Ostergaard et al.
2006/0042987 A1 3/2006 Buss
2006/0049078 A1 3/2006 Sams et al.
2006/0065670 A1 * 3/2006 Doublet ..... A61J 1/035 221/1
2006/0070895 A1 4/2006 Khawaja
2006/0086639 A1 4/2006 Priebe et al.
2006/0144749 A1 7/2006 Arnold et al.
2006/0157375 A1 7/2006 Dejonge
2007/0056876 A1 3/2007 Jones
2007/0068844 A1 3/2007 Weston
2007/0235366 A1 10/2007 Desai et al.
2007/0241552 A1 10/2007 Watson et al.
2007/0246395 A1 10/2007 Arnold et al.
2007/0267318 A1 11/2007 Grosskopf
2008/0017542 A1 1/2008 Le et al.
2008/0047969 A1 2/2008 Farhan et al.
2008/0078690 A1 4/2008 Zumbiel
2008/0202972 A1 8/2008 Prud'Homme
2008/0202973 A1 8/2008 Prud'Homme
2008/0230432 A1 9/2008 Bobbett et al.
2008/0302695 A1 12/2008 Meeren et al.
2009/0045096 A1 2/2009 Knutson et al.
2009/0065506 A1 3/2009 Currie et al.
2009/0084702 A1 4/2009 Arnold et al.
2009/0107873 A1 4/2009 Cotton et al.
2009/0109800 A1 4/2009 Kimel et al.
2009/0139893 A1 6/2009 McGonagle et al.
2009/0194434 A1 8/2009 Ellis et al.
2009/0288978 A1 11/2009 Prud'Homme
2010/0000899 A1 1/2010 Burg et al.
2010/0096292 A1 4/2010 Jones
2010/0102062 A1 4/2010 Jones et al.
2010/0126886 A1 5/2010 Le
2010/0181335 A1 7/2010 Farrar et al.
2010/0206765 A1 8/2010 Fonte
2010/0243507 A1 9/2010 Gelardi et al.
2011/0011756 A1 1/2011 Bellamah
2011/0108452 A1 5/2011 Gelardi
2011/0127320 A1 6/2011 Sams et al.
2011/0226765 A1 9/2011 Gelardi
2012/0024889 A1 2/2012 Robertson et al.
2012/0061276 A1 3/2012 Gelardi et al.
2012/0145586 A1 6/2012 Doyle et al.
2012/0160724 A1 6/2012 Gelardi
2012/0160726 A1 6/2012 Gelardi
2012/0267261 A1 10/2012 Gelardi
2013/0090937 A1 4/2013 Wright
2013/0112586 A1 5/2013 Hawry et al.
2013/0112588 A1 5/2013 Flood et al.

(56) References Cited

U.S. PATENT DOCUMENTS

| | | | | |
|---|---|---|---|---|
| 2013/0160408 | A1 | 6/2013 | Neff | |
| 2013/0161230 | A1 | 6/2013 | Haering et al. | |
| 2013/0285681 | A1 | 10/2013 | Wilson et al. | |
| 2013/0319902 | A1 | 12/2013 | Tufi | |
| 2014/0083900 | A1 | 3/2014 | Ziemba et al. | |
| 2014/0117060 | A1 | 5/2014 | Colone et al. | |
| 2014/0138430 | A1 | 5/2014 | Loftin | |
| 2014/0346184 | A1* | 11/2014 | Bae | A61J 7/0076 221/1 |

* cited by examiner

MEDICATION PACKAGING AND DOSE REGIMEN SYSTEM

CROSS-REFERENCE TO RELATED APPLICATIONS

This application claims the benefits of U.S. Provisional Patent Application No. 62/105,877 filed Jan. 21, 2015 and U.S. Provisional Patent Application No. 62/209,525 filed Aug. 25, 2015, the contents of each of these applications being hereby incorporated in their respective entireties by reference.

TECHNICAL FIELD

The present disclosure generally relates to medicament packaging and more particularly to a dispensing device and system that provides a medication regimen and a method for treatment of a medical condition.

BACKGROUND

Retail customers and/or patients can be engaged in a medical therapy, which may include diet, exercise and/or a prescription and/or a non-prescription medication dosing regimen, which may be employed to treat an illness. In some cases, hospitalized patients are often discharged and instructed by one or more medical practitioners to comply with a medical therapy.

Such medication dosing regimen can include one or a plurality of medications administered over a regimen, which may include one or more medications. The medication dosing regimen can require administration of medications simultaneously, at different times and/or according to days of a week or time of day. Such medication regimens may be administered in addition to existing medication regimens that a user may take for nutritional, therapeutic and/or illness treatment.

Such medication regimens, however, often suffer from poor patient compliance. In fact, many patients fail to comply with their medication regimens. In some cases, life-style related medications may also suffer from poor user compliance. Factors that contribute to non-compliance may include complexity of medication regimen, patient failure in filling prescriptions, incorrect order and/or prescription, cost, adverse side effects, patient reluctance, lack of motivation, non-reconciliation with existing medication and/or patient physiological issues.

Various medications of a medication regimen can be dispensed from a medication container such as single dose and/or multiple dose blister packaging to a user with or without tamper resistance. Multiple dose blister packaging can dispense a single medication according to a regimen including day, e.g., Monday, Tuesday, etc. and/or time of day. This disclosure describes an improvement over these technologies.

SUMMARY

In one embodiment, a medicament dispensing container is provided. The medicament dispensing container includes a first wall connected with a second wall and defines a cavity therebetween. The walls are movable between an open configuration and a closed configuration. At least one member is disposable in the cavity and defines at least one dose receptacle configured for disposal of at least one dose of at least one medication. At least one fixation member connects the at least one member to at least one of the walls such that the at least one member is movable relative to the wall. Systems and methods of use are disclosed.

BRIEF DESCRIPTION OF THE DRAWINGS

The present disclosure will become more readily apparent from the specific description accompanied by the following drawings, in which.

DETAILED DESCRIPTION

Figure 1:
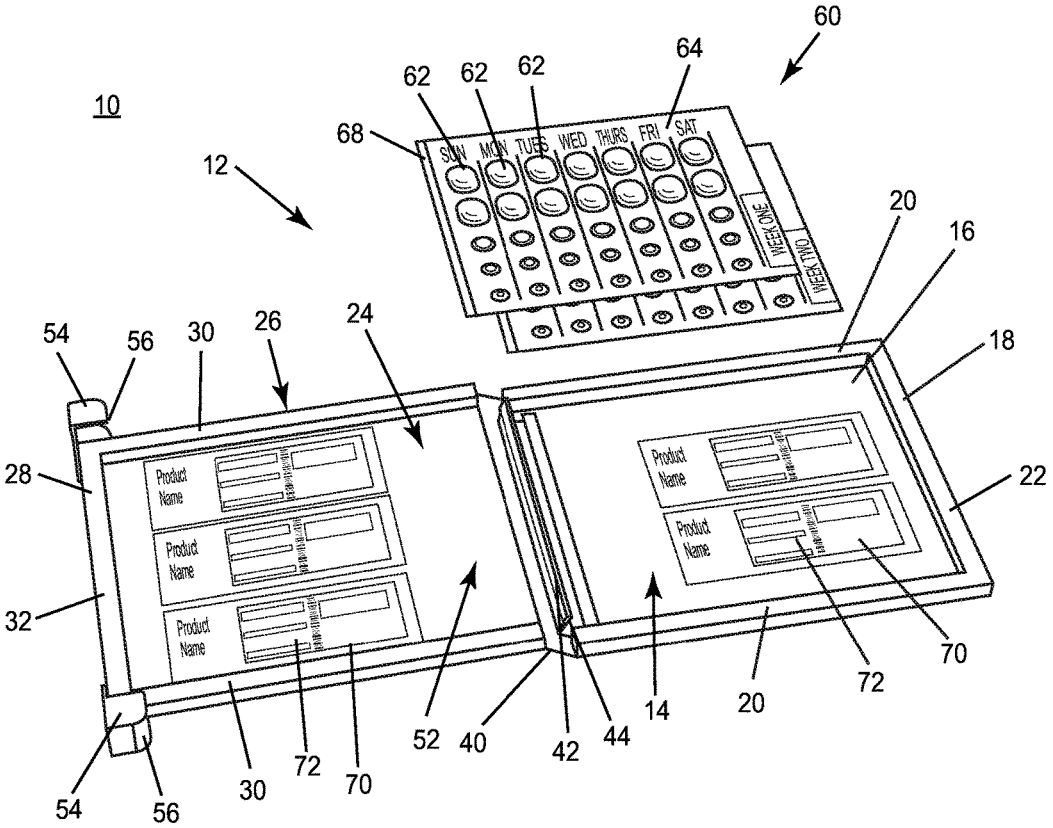
FIG. 1 is a perspective view of components of one embodiment of a system in accordance with the principles of the present disclosure.

The exemplary embodiments of a medicament packaging system and related methods of use disclosed are discussed in terms of dispensing devices for the treatment of various diseases, illness and/or ailments and more particularly, in terms of a medicament dispensing device and system that provides a medication regimen and/or, child or tamper resistance and a method for treatment of a medical condition. In some embodiments, the present system is employed with a method for distribution of medication packaging to a patient for treatment of one or more diseases, illness and/or ailments. In some embodiments, the present system is employed with a method such that a patient is discharged from a health care facility, for example, short term discharge and/or long term discharge.

In one embodiment, the present system is employed with a method such that a patient is discharged from a health care facility, such as, for example, a hospital after one or more diseases, illness and/or ailments, such as, for example, myocardial infarction and may be prescribed one or more medications. In some embodiments, a patient may be directed and/or prescribed medication, such as, for example, an anti-platelet agent, aspirin, a beta-blocker, an ACE inhibitor, an ARB statin, nitro-glycerin, a docusate and/or antidepressants. In some embodiments, the present system is employed to avoid failure of a patient to comply with such regimens and/or to take medications as prescribed or directed. In some embodiments, compliance failure can include the patient failing to refill the prescription, forgetting to take the prescribed medication, incomplete dosage and/or taking the medication at the incorrect time. In some embodiments, the present system is employed with a method for chronic dosing, for example, 30 day scripts or 90-100 day mail order refills. In some embodiments, the present system is employed with a method to facilitate compliance. In some embodiments, the present system is employed with a method to display and/or prove compliance. For example, a patient attending a practitioner appointment provides a present system, such as, for example, a compliance pack and displaying and/or showing the practitioner use of the compliance pack, which may include rupture of one or more blister packs to evidence compliance, as described herein. In some embodiments, the present system is employed with a method for distribution of medication packaging to a patient for treatment of one or more diseases, illness and/or ailments, such as, for example, pneumonia, heart failure, pain, infectious diseases that may include administration of medications, such as, for example, anti-retrovirals (ARV) for treatment of HIV/AIDS, dyslipidemia (high cholesterol), hypertension (high blood pressure), metabolic syndrome/insulin intolerance related to diabetes, psychological diseases and/or administration of transplant/anti-rejection drugs.

In some embodiments, the present system comprises a medicament dispensing system and methods of use for storage, transportation and discharge of medications for the treatment of a medical condition. In some embodiments, the present system comprises a medicament dispensing system and methods of use for storage, transportation and discharge of medications including those for treating illnesses, such as, for example, elevated blood pressure, dyslipidemia (high cholesterol), diabetes, metabolic syndrome, heart failure, pneumonia, cardiac deficiencies, arthritis, illnesses in which pain is part of an on-going treatment plan, and/or life-style related medications such as, for example, birth control pills, hormone replacement pills and nutritional supplements, such as, for example, neutraceuticals, for example, having vitamin A, D, and E with a calcium supplement. In some embodiments, the method includes treatment of a heart condition following a myocardial infarction. In one embodiment, the systems and methods of the present disclosure are employed to aid a person with a medical condition requiring administration of multiple pills, doses or schedules as part of a regimen. In one embodiment, the systems and methods of the present disclosure include a medicament dispensing device that provides child and/or tamper resistance, while being easily accessed by an adult.

In one embodiment, the medication container may include multiple medications on a blister card. In one embodiment, the medication container is disposable after a certain period of time, such as, for example, about one week to about 90 days, with a specific embodiment being disposable after two weeks for up to 5 medications to be taken once a day. In some embodiments, one or more blister cards are provided pre-filled with medication, as described herein, from a manufacturer. In some embodiments, a practitioner, such as, for example, a pharmacist determines and selects one or more of the pre-filled blister cards based on doctor's prescription and creates the medication container. In some embodiments, the manufacturer provides a medication container packed with selected blister cards and pre-filled medication according to the doctor's prescription. In one embodiment, the medication container includes a self-sealing punch card filled by a pharmacist. In one embodiment, the medication container includes a seven day regimen blister strip. In one embodiment, the medication container is approximately nine inches in length and width.

In some embodiments, the medication container includes one or a plurality of blister cards that hold multiple medications, for example, the medication container can include a range of one through ten blister cards that hold multiple medications. In some embodiments, the medication container includes two unit dose blister cards that hold multiple medications. In some embodiments, a pharmacist applies prescription labels and supplied product image labels to inside covers of the medication container. In some embodiments, a pharmacist inserts unit dose blister cards, dosing schedule labels and inserts into the medication container. In some embodiments, the blister cards include receptacles for seven days of medication. In some embodiments, the blister cards may include up to five different medications. In some embodiments, a pharmacist uses a supplied blister filling unit to facilitate in blister card assembly. In some embodiments, the blister card includes a first surface having receptacles and a second surface including tearing areas to be joined together by a pharmacist. In some embodiments, a pharmacist peels a protective backing from an adhesive strip on the first surface, aligns the sides of the first surface and the second surface, and applies the second surface to the first surface. In some embodiments, the first and second surfaces are folded at a crease and pressed together to permanently adhere the first and second surfaces and create the blister card. In some embodiments, the blister card includes apertures for applying individual blister strip inserts to customize a blister card for a patient. In some embodiments, a pharmacist applies the blister strip inserts into the apertures to assemble the blister card. In some embodiments, the second surface is foldable relative the first surface and the pharmacist folds the second surface onto the first surface to close the blister card. In some embodiments, a pharmacist or medical practitioner inserts the assembled blister cards into the medication container.

In some embodiments, the medication container includes product image stickers applied to the inside covers of the medication container. In some embodiments, the medication container includes prescription labels that are applied to the product image labels. In some embodiments, the medication container includes a seven day dosing schedule that corresponds with the day the regimen starts. In some embodiments, the medication container includes a week label to be applied to the outside covers of the medication container.

In one embodiment, the medication container includes two small organizers, such as, for example, a week one organizer and a week two organizer. In some embodiments, labels are applied to the top cover of the organizers to identify the order in which medication is to be taken by a patient. In one embodiment, the organizers include a child and/or tamper resistant lock, such as, for example, two white plastic pieces on the outside of the organizer configured in a push and slide configuration.

In some embodiments, the medication container comprises up to six blister cards. In some embodiments, the medication container comprises fasteners to lock the blister cards into place. In some embodiments, each blister card folds up to allow a patient to easily dispense tablets.

In some embodiments, one or more medication containers may be stacked to facilitate transportation and storage. In some embodiments, the medical container has dimensions of about 8"H×8.5"W×0.9"D. In some embodiments, the medical container has dimensions of about 9.5"H×10.5"W×0.9"D. In some embodiments, the medical container has dimensions of about 9"H×9.5"W×0.9"D. In some embodiments, the medication container includes a first blister card attached to a top surface of the container and a second blister card attached to a bottom surface of the container. In some embodiments, the first blister card includes one or a plurality of rows of large receptacles and/or the second blister card includes one or a plurality of rows of small receptacles. In some embodiments, the first blister card includes two rows of large receptacles and the second blister card includes three rows of small receptacles. In some embodiments, pharmacy labels are positioned on inside surfaces of top and bottom covers of the medical container. In some embodiments, pharmacy labels are positioned on the front of the individual blister cards. In some embodiments, dosing schedule labels are applied to the blister cards. In some embodiments, dosing schedule pages are retained in front of the blister cards.

In some embodiments, the blister cards are permanently fixed in place relative to the medication container once installed to provide tamper resistance and/or child resistance features to the medication container. In some embodiments, the blister cards are removable from the medication container and are replaceable with other blister cards. In some embodiments, the blister cards are removable through use of a tool configured for removal of the blister cards from the medication container. In some embodiments, the blister cards are removable and/or replaceable through use of the tool. In some embodiments, the blister cards are removable and/or replaceable through use of the tool as part of a refillable system, which may include the cover or outer shell being re-useable. In some embodiments, a pharmacist or medical practitioner may remove or reposition blister cards as needed and permanently lock the cards by breaking off a tab from a clip holding the card in place to resist and/or prevent the patient from easily removing cards.

In some embodiments, the medical container comprises a flip book, as described herein, and has no added parts or added assembly. In some embodiments, the flip book automatically re-locks when the flip book is closed. In some embodiments, the flip book is opened by squeezing tabs from below with one hand while pulling up on a handle with the other hand. In some embodiments, the flip book includes tabs that are 5" apart, which comprise tamper resistance and/or child resistance features such that the tabs are too far apart for a child to squeeze with one hand. In some embodiments, the flip book includes a simplified tabbed opening design, which includes rounded shapes. In some embodiments, the flip book is paired with a case that holds discharge documents and accessories.

In some embodiments, the medical container comprises closures and opening tabs, and/or a tamper resistance and/or a child resistance push/slide lock. In some embodiments, the medical container comprises internal card retaining clips. In some embodiments, the clips include a hook, which does not allow cards to be removed. In some embodiments, the clips include a hook, which allow removable/replaceable cards. In some embodiments, the clips allow pharmacists to remove or reposition medicine cards as needed and permanently lock the cards by breaking off a tab from the clip to resist and/or prevent the patient from easily removing cards.

In one embodiment, the medication container includes a simple child resistant non-collapsible box filled with punch cards. In one embodiment, the medication container includes pharmacist insert strips of blisters and seal cards. In one embodiment, the medication container organizes medicines by week and/or by day and/or by time of day. In one embodiment, the medication container includes a simpler user interface. In one embodiment, the medication container includes a system to easily track medicine dosage compliance. In one embodiment, the medication container is manufactured with minimal material to reduce cost. In one embodiment, the medication container is configured to include various educational materials and/or blister cards.

In one embodiment, the medicament dispensing system provides a complex dosage regimen for medications for a period of time, such as, for example, two weeks. In some embodiments, the complex dosage regimen for the medications is provided for a period lasting until a patient's first outpatient visit following release from a hospital. In one embodiment, one or more medications are included in a medicament dispensing system. In one embodiment, medications prescribed to a patient following a medical procedure are included in a medicament dispensing system. In one embodiment, medications previously being taken by a patient are included in a medicament dispensing system.

In some embodiments, the present system comprises medication packaging that includes one or more medications. In some embodiments, the medication packaging includes a member, such as, for example, a unit dose page including indicia. In some embodiments, the indicia include information regarding medication and dosages required by a prescribed and/or non-prescribed regimen. In some embodiments, the indicia include a description of medication, which may include a name of a drug and a medical effect of a drug. In one embodiment, the unit dose page may include indicia that represent other medications or dosages to accommodate patients as needed. In one embodiment, the unit dose page may include space for adding indicia that represent other medications or dosages to accommodate patients as needed. In one embodiment, the indicia are screen printed on the unit dose page. In one embodiment, the indicia are hand written on the unit dose page.

In some embodiments, the medicament dispensing system is partially or entirely filled and packaged by a pharmacist. In some embodiments, the medicament dispensing system comprises a resilient material, such as, for example, cardboard. In some embodiments, the medicament dispensing system provides a child-resistant package while being easily accessible by an adult. In some embodiments, a method for accessing medication within the medicament dispensing system is provided. In some embodiments, the method includes the step of requiring consecutive and/or simultaneous motions difficult for children to perform but simple for an adult to perform. In one embodiment, the medication packaging comprises a slidable locking mechanism. In some embodiments, the locking mechanism is movable between a non-locked position and a locked position. In some embodiments, the locking mechanism provides audible indication of movement between a non-locked position and a locked position.

In one embodiment, the medication container comprises an outer sleeve and an inner container, such as, for example, a scroll pack. In some embodiments, the medication container is configured to organize multiple medicines in an easily understood manner. In some embodiments, the sleeve and/or the inner container are made from card stock. In some embodiments, the inner container is configured to be removed from the sleeve to allow a patient access to medicaments held therein. In some embodiments, the inner container is tethered to the sleeve. In some embodiments, the sleeve comprises an open face from which the inner container is removed. In some embodiments, the sleeve includes a tab to engage and lock the inner container in place. In some embodiments, the inner container comprises a plurality of medication cards and is configured to be unwound after being removed from the sleeve. In some embodiments, each of the medication cards is configured to fold over itself and forms a generally rectangular cross sectional shape. In some embodiments, the medication cards are folded along a longitudinal axis, such that a front-facing outer surface comprises a medication strip, and a front-facing inner surface comprises a medication information label. In some embodiments, the inner container is sized to fit a number of medication cards for a patient's treatment regimen. In some embodiments, the inner container is configured to hold five medication cards. In some embodiments, the inner container can be sized to fit at least one card.

In some embodiments, the inner container is a segmented strip having pre-made folding lines defining medication card portions arranged in an alternating pattern. In some embodiments, the medication card portions comprise folding flaps configured to fold over a medication card and hold it in place. In some embodiments, the medication card comprises cutouts corresponding to the folding flaps of the inner container. In some embodiments, inner surfaces of the folding flaps comprise an adhesive material to adhere to the medication card to the scroll. In some embodiments, when all medication cards are adhered to the scroll container, multiple medication dosages are presented in a grid to present a patient's dosage regimen in an easily read manner.

In some embodiments, each medication card comprises seven receptacles for medicament doses, one for each day of the week. In some embodiments, the medication cards are arranged with indicia illustrating the day of the week corresponding with the intended dosage. In some embodiments, the medication cards are arranged to facilitate compliance with a complex dosage regimen. In some embodiments, the medication cards are configured such that a patient may take one medication from each medication card each day. In some embodiments, the medication cards are configured such that a patient takes all 'Monday' dosages at once, which are organized along a vertical column of the grid. In some embodiments, the medication cards are configured such that after taking the dosages, the crushed remnants remaining in the receptacles indicate a compliance record and direct the patient to take the dosages for the next day.

In some embodiments, the medication container comprises an outer sleeve and an inner container having a plurality of medication cards arranged in a step-like manner. In some embodiments, the medication cards are arranged on a sloped structure such that each of the cards is partially visible to a patient. In some embodiments, the container comprises a plurality of medication cards. In some embodiments, each of the medication cards is configured to fold over itself to form a generally rectangular cross sectional shape. In some embodiments, the medication cards are folded along a longitudinal axis, such that a front-facing outer surface comprises a medication strip, and a front-facing inner surface comprises a medication information label. In some embodiments, the medication cards include a bottom member having a plurality of receptacles and a removable lid. In some embodiments, the medication cards comprise seven receptacles each, one for each day of the week. In some embodiments, the lid comprises a foil comprising seven strips, each of the strips configured to cover a corresponding receptacle. In some embodiments, the foil strips can be peeled from the bottom member to allow access to a medicament dosage held within the receptacle. In some embodiments, the strips comprise an end portion comprising indicia, such as color, a number, or a day of the week, to illustrate to a patient a day of the week corresponding with the intended dosage. In some embodiments, the strips are separable by perforated lines. In some embodiments, the receptacles are configured to be crushed or disfigured by a patient to release the medicament dosage held within. In some embodiments, the medication cards are overlaid on one another such that the indicia of each card is visible. In some embodiments, the medication cards are arranged such that a patient can easily discern which medicaments remain on a given day and which medicaments have been taken already. In some embodiments, the medication container has a length of about 8.25 inches, a width of about 4.754 inches, and a height of about 1.75 inches.

In some embodiments, the sleeve includes a surface having a locking mechanism. In some embodiments, the locking mechanism includes a press button and a gripping aperture. In some embodiments, the locking mechanism is actuated by a patient pressing the button to release the container from the sleeve. In some embodiments, the patient pulls from the gripping surface to separate the container from the sleeve.

In some embodiments, the medication container comprises closures and opening tabs, and/or a tamper resistance and/or a child resistance push/slide lock. In some embodiments, the medication container comprises internal card retaining clips. In some embodiments, the clips include a hook to prevent removal of the medication cards. In some embodiments, the clips include a hook that is configured to allow a patient to remove and/or replace medication cards. In some embodiments, the clips allow pharmacists to remove or reposition medicine cards as needed and permanently lock the cards by breaking off a tab from the clip to resist and/or prevent the patient from easily removing cards.

In some embodiments, the medication container includes a panel disposed on a top surface of the medication container. In some embodiments, the panel is configured to be opened and may include, such as, for example, additional product literature, a place for the patient to take notes about their experiences with the medicines, and/or helpful tips. In some embodiments, the panel can be utilized without opening the medication container.

In some embodiments, the medication container includes a closure panel having a flap configured for opening and closing the medication container. In some embodiments, the flap is configured to be tucked into the medication container. In some embodiments, the flap is configured to completely close the medication container during transit or when not in use.

In some embodiments, the medication container includes a flap having a half moon shaped opening configured to facilitate opening and closing. In some embodiments, the flap having a half moon shaped opening configured to facilitate opening with a dragging motion. In some embodiments, the medication container is manufactured from a single piece of card stock, which can include folded and/or glued components.

In one embodiment, the present system includes a medication treatment regimen comprising a plurality of medications. In one embodiment, the medicament dispensing system provides an organization of each medication in a patient's complex dosage regimen. In one embodiment, each distinct medication in the regimen is stored on separate unit dose pages contained in a medicament packaging container. In one embodiment, the present system is employed with a method that includes one or a plurality of days of therapy provided on each unit dose page. In one embodiment, the present system is employed with a method that includes fourteen days of therapy provided on each unit dose page. In one embodiment, medication packaging includes one or more unit dose pages assembled, filled and sealed by a pharmacist. In one embodiment, the medicament packaging container is child resistant and the unit dose pages are not child resistant.

The present disclosure may be understood more readily by reference to the following detailed description of the embodiments taken in connection with the accompanying drawing figures, which form a part of this disclosure. It is to be understood that this application is not limited to the specific devices, methods, conditions or parameters described and/or shown herein, and that the terminology used herein is for the purpose of describing particular embodiments by way of example only and is not intended to be limiting. Also, in some embodiments, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

As used in the specification and including the appended claims, "treating" or "treatment" of a disease or condition may include administering one or more medications to a patient (human or other mammal). Alleviation can occur prior to signs or symptoms of the disease or condition appearing, as well as after their appearance. Thus, treating or treatment includes preventing or prevention of disease or undesirable condition (e.g., preventing the disease from occurring in a patient, who may be predisposed to the disease but has not yet been diagnosed as having it). In addition, treating or treatment does not require complete alleviation of signs or symptoms, does not require a cure, and specifically includes procedures that have only a marginal effect on the patient. Treatment can include inhibiting the disease, e.g., arresting its development, or relieving the disease, e.g., causing regression of the disease. For example, treatment includes, but is not limited to, reducing acute or chronic inflammation, inducing an anti-platelet effect, reducing hypertension, and lowering cholesterol.

In some embodiments, a biologically-active substance includes any substance or substances comprising a medicament, medication or drug including an active therapeutic substance, metabolite, hormone, steroid, vitamin, fatty acid, amino acid, sugar, carbohydrate, polypeptide or mineral. In some embodiments, a biologically-active substance includes any substance used for treatment, prevention, diagnosis, cure or mitigation of disease or illness. In some embodiments, a biologically-active substance includes any substance that affects anatomical structure or physiological function. In some embodiments, a biologically-active substance includes any substance that alters the impact of external influences on an animal, or metabolite thereof. In some embodiments, a complex dosage regimen includes a systematic administration of multiple dosage units at designated times during the day. In some embodiments, a dose includes each individual release of substance into body tissue.

The following discussion includes a description of a medicament dispensing system including a medicament dispensing container, related components and methods of employing the medicament dispensing system. Alternate embodiments are also disclosed. Reference is made in detail to the exemplary embodiments of the present disclosure, which are illustrated in the accompanying figures. Turning to FIGS. 1-8, there are illustrated components of a medicament dispensing system 10.

The components of medicament dispensing system 10, individually or collectively, can be fabricated from materials suitable for storage and dispensing of medication. In some embodiments, such materials include metals, ceramics, synthetic polymers such as thermoplastics, semi-rigid and rigid materials, elastomers, fabric and/or their composites. Various components of medicament dispensing system 10 may have material composites, including the above materials, to achieve various desired characteristics such as strength, rigidity, elasticity, compliance, and durability. The components of medicament dispensing system 10, individually or collectively, may also be fabricated from a heterogeneous material such as a combination of two or more of the above-described materials. The components of medicament dispensing system 10 may be monolithically formed, integrally connected or include fastening elements and/or instruments, as described herein.

Medicament dispensing system 10 includes a medicament dispensing device, such as, for example, a medicament dispensing container 12. Medicament dispensing container 12 includes a wall, such as, for example, a cover 14 and a wall, such as, for example, cover 24. Cover 14 includes a bottom section 16, a front sidewall 18, and opposing sidewalls 20. Walls 18, 20 define a surface 22. In one embodiment, bottom section 16 comprises a rectangular shape. Sidewalls 20 are disposed on opposing sides of bottom section 16 such that sidewall 18 extends between sidewalls 20.

Cover 24 includes a top section 26, a front sidewall 28, and opposing sidewalls 30. Sidewalls 30 are disposed on opposing sides of top section 26 such that sidewall 28 extends between sidewalls 30. Walls 28, 30 define a surface 32. In one embodiment, top section 26 comprises a rectangular shape. Surface 22 is configured to mate with surface 32 to close medicament dispensing container 12. In some embodiments, surface 22 mates with surface 32 via clips, clasps, magnet, key/keyway, interference fit, friction fit, hinged part, male/female part and/or adhesive.

Figure 2:
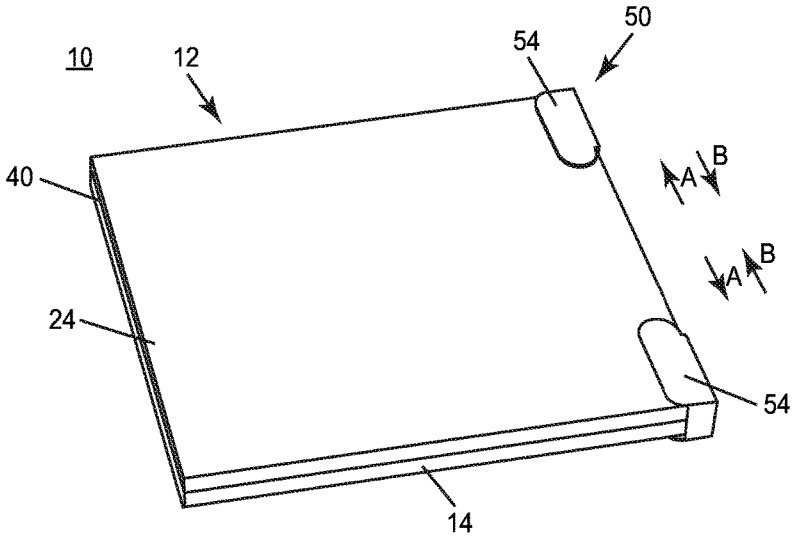
FIG. 2 is a perspective view of components of the system shown in FIG. 1.

In some embodiments, medicament dispensing container 12 includes a connecting portion, such as, for example, a spine 40. Spine 40 extends between cover 14 and cover 24 such that cover 24 is pivotable relative to cover 14. Cover 24 is attached to spine 40 at an end opposite sidewall 28, and cover 14 is attached to spine 40 at an end opposite sidewall 18. Cover 24 is pivotable relative to cover 14 between an open or non-locked configuration, as shown in FIG. 1, and a closed or locked configuration, as shown in FIG. 2. In some embodiments, the open or non-locked configuration includes a medication accessible configuration. In some embodiments, the closed or locked configuration includes a child resistant, tamper resistant, tamper evident and/or a medication non-accessible configuration. In some embodiments, medicament dispensing container 12 is disposable in a closed, locked and non-tamper and/or non-child resistant configuration with a locking mechanism 50.

In some embodiments, cover 24 is rotatable relative to cover 14 through an angular range of 0 through 360 degrees. In a closed configuration, as shown in FIG. 2, spine 40, sidewalls 18, 20, 28, 30, and sections 16, 26 define a substantially enclosed cavity 52 configured for disposal of unit dose pages 60 and/or information labels 70, as discussed herein, such that cover 24 and cover 14 prevent access to contents of medicament dispensing container 12. Spine 40 includes at least one unit dose page fixation member, such as, for example, clip 42. Clip 42 is disposed with spine 40 and projects into cavity 52 and is configured to hold a unit dose page 60 in place. In some embodiments, clip 42 comprises a permanent slide and lock interface to permanently lock page 60 in place. In some embodiments, clip 42 extends along the entire length of spine 40. Clip 42 includes two flanges extending parallel with one another to define a slot 44. In some embodiments, one of the flanges includes a projection extending along an inner surface configured to fit into a ridge 68 on a unit dose page 60 to hold page 60 in place, as discussed herein.

In some embodiments, in a closed configuration, similar to that described herein, cover 24 and cover 14 provide a child resistant medicament dispensing container. In an open configuration, similar to that described herein, cover 14 is rotated relative to cover 24 such that medicament dispensing container 12 rests flatly on a surface to facilitate ease of access to the contents of the cavity of container 12. In one embodiment, medicament dispensing container 12 is sized to facilitate carrying and storage of printer paper, such as, for example, 9 inches by 12 inches. In some embodiments, medicament dispensing container 12 is sized to facilitate carrying and storage of one or more unit dose packs, such as, for example, 9.5 inches by 9.5 inches by 0.9 inches.

Medicament dispensing container 12 includes a mechanism configured to connect cover 14 with cover 24 for disposal of the components of medicament dispensing container 12 in a closed configuration. In some embodiments, cover 14 and/or cover 24 is provided with indicia, such as, for example, instructions to aid a user patient in use of medicament dispensing container 12. The instructions may be presented in the form of a graphic, such as, for example, a bull's eye, or text, such as, for example, "push here".

Medicament dispensing container 12 includes locking mechanism 50 comprising a slide 54, such as, for example, two slides 54, disposed on opposite sides of covers 14, 24 at a corner defined by front walls 18, 28 and sidewalls 20, 30. Each slide 54 includes a male engagement portion, such as for example, a flange 56 configured to engage cover 24. Cover 24 includes an outer surface 42 that defines slots corresponding to each slide 54. The slots extend a distance from sidewalls 20, 30 toward each other along front walls 18, 28. The slots are configured to facilitate translation of flanges 56 such that slides 54 are translated, in the direction shown by arrow A in FIG. 2, to move medicament dispensing container 12 to an open or non-locked configuration, similar to that described herein, and slides 54 are translated, in the direction shown by arrow B in FIG. 2, to a closed or locked configuration, similar to that described herein.

In some embodiments, locking mechanism 50 audibly clicks to indicate a locked configuration, similar to that described herein. In some embodiments, locking mechanism 50 is provided with instructions to aid a patient in use of container 12. In some embodiments, the instructions may be presented in the form of a graphic, such as, for example, an arrow with a lock, or text, such as, for example, "slide to unlock". In some embodiments, the instructions may be printed on locking mechanism 50. Alternatively, in some embodiments, the instructions may be printed onto sidewall 18 adjacent locking mechanism 50.

Figure 3:
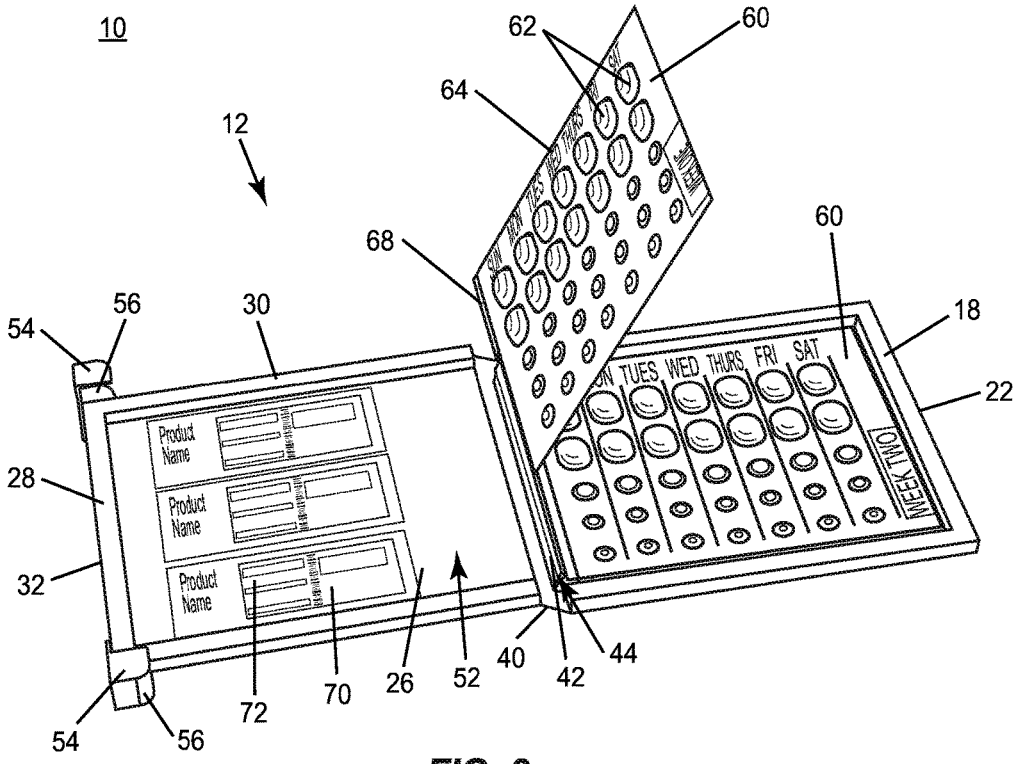
FIG. 3 is a perspective view of components of the system shown in FIG. 1.
Figure 4:
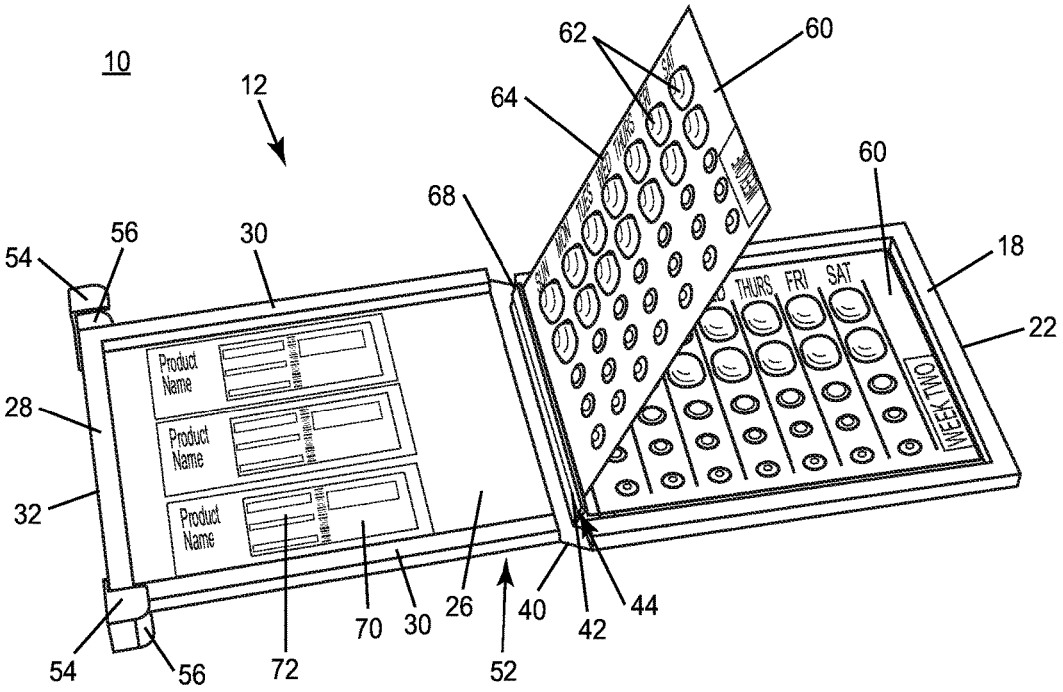
FIG. 4 is a perspective view of components of the system shown in FIG. 1.

Medicament dispensing container 12 comprises one or more unit dose pages 60 that store and/or contain one or more medications, such as, for example, a dose of at least one medication. The dose of medication(s) is enclosed and sealed in a plurality of receptacles 62. In some embodiments, medicament dispensing container 12 includes a plurality of pages 60. In one embodiment, each page 60 slides into slot 44 of clip 42 and includes a ridge 68 configured to correspond with a projection in slot 44, as shown in FIG. 3. In some embodiments, clip 42 comprises a permanent slide and lock interface to permanently lock page 60 in place. Ridge 68 is deflectable to define an axis of rotation for pages 60. As such, pages 60 can be rotated to view and access adjacent pages 60. In some embodiments, each page 60 encloses a different medication such that each medication that is part of a patient's dosage regimen is organized on separate pages 60. In some embodiments, page 60 comprises receptacles 62 indicating a patient's daily dosage of medication held within page 60. In some embodiments, page 60 comprises indicia 64, disposed with and displayed from a predetermined area adjacent one or more receptacles 62, indicating information regarding the medication enclosed within receptacles 62.

In some embodiments, medicament dispensing container 12 comprises a disposable dispensing device that provides therapeutic and/or nutritional support to a patient by increasing compliance with a dosing regimen, as described herein. In some embodiments, medicament dispensing container 12 and/or one or more pages 60 include blister packs, which comprise a plurality of receptacles 62. In some embodiments, each receptacle 62 accommodates a dosage unit and isolates that dosage unit from other dosage units. In some embodiments, a biologically-active substance within each dosage unit will not come into contact with the biologically-active substance of other dosage units.

In some embodiments, medicament dispensing container 12 and/or one or more pages 60 include a blister pack comprising at least one row of a plurality of receptacles 62 and/or areas including indicia 64. In some embodiments, each area defines at least one receptacle 62. In some embodiments, each receptacle 62 is designed to hold only one dosage unit having either only one biologically-active substance or multiple storage-compatible substances. In some embodiments, each receptacle 62 is designed to hold a plurality of dosage units.

In some embodiments, each predetermined area including one or more receptacles 62 may have an independently removable or breakable seal. In some embodiments, each receptacle 62 is moisture resistant and independently sealed. In some embodiments, one or more receptacles 62 may comprise a blister pack including a push-through pack, which has a lid material of aluminum foil or aluminum foil laminate. In some embodiments, a base of one or more receptacles 62 may be plastic, such as, for example, PVC, polyamides, polyolefins, polyesters and laminates or multi-layered materials. In some embodiments, the lid foil of a receptacle 62 may be provided with a line of weakness in a region of each receptacle 62 such that the line of weakness may be a tab for gripping that enables a receptacle 62 to be exposed by manipulation of the lid foil.

In some embodiments, receptacle 62 may be made embossed, cast deep drawn or vacuum formed out of plastic, plastic laminates, plastic/paper laminates or plastic/metal foil laminates. In some embodiments, receptacle 62 comprises a barrier layer against gases and vapors, which may be fabricated from a metal foil such as an aluminum foil embedded in a plastic laminate or ceramic layers or metallic layers embedded between two plastic layers.

In some embodiments, a dose of medicament, medication or drug can include, such as, for example, a chewable tablet, quick dissolve tablet, effervescent tablet, reconstitutable powder, elixir, liquid, solution, suspension, emulsion, tablet, multi-layer tablet, bi-layer tablet, capsule, soft gelatin capsule, hard gelatin capsule, caplet, lozenge, chewable lozenge, bead, powder, granules, dispersible granules, cachets, douche, suppository, cream, topical, inhalant, aerosol inhalant, patch, particle inhalant, implant, depot implant, dragee, ampoule, ingestible, injectable, infusion, health bar, liquid, food, nutritive food, functional food, yogurt, gelatin, cereal, cereal coating, animal feed and/or combinations thereof.

In some embodiments, indicia 64 of a medication regimen, direction, instruction and/or prescription for administration of the medication regimen may include dosage day indicia, a specific day of the week, such as Monday, Tuesday, Wednesday, Thursday, Friday, Saturday, Sunday or an abbreviation of said day, a specific date or a general succession of days, such as day 1, day 2, day 3. In some embodiments, indicia 64 may include time indicia that may be, such as, for example, a general time of the day corresponding to each of receptacles 62 or a specific time of the day corresponding to each of receptacles 62, such as, for example, AM, PM, morning, afternoon, evening, day, night, daytime, nighttime and combinations thereof. In some embodiments, indicia 64 may include each separate row or column of a page 60 indicating a time of day, such as AM doses and PM doses. In some embodiments, receptacle 62 and/or an adjacent area may be color coded for time indicia. In some embodiments, one or more components of medicament dispensing system 10 may include a key defining or explaining color coding.

In some embodiments, a dose unit may comprise vitamin A, B vitamins, vitamin C, vitamin D, vitamin E, vitamin K, essential fatty acids, folic acid, iron, calcium, magnesium, potassium, copper, chromium, zinc, molybdenum, iodine, boron, selenium, manganese, derivatives thereof and/or combinations thereof. In some embodiments, biologically-active substances may include thiamin, thiamin pyrophosphate, riboflavin, flavin mononucleotide, flavin adenine dinucleotide, niacin, nicotinic acid, nicotinamide, niacinamide, nicotinamide adenine dinucleotide, tryptophan, biotin, pantothenic acid, ascorbic acid, retinol, retinal, retinoic acid, beta-carotene, 1,25-dihydroxycholecalciferol, 7-dehyrdocholesterol, alpha-tocopherol, tocopherol, tocotrienol, menadione, menaquinone, phylloquinone, naphthoquinone, calcium, calcium carbonate, calcium sulfate, calcium oxide, calcium hydroxide, calcium apatite, calcium citrate-malate, calcium gluconate, calcium lactate, calcium phosphate, calcium levulinate, phosphorus, potassium, sulfur, sodium, docusate sodium, chloride, magnesium, magnesium stearate, magnesium carbonate, magnesium oxide, magnesium hydroxide, magnesium sulfate, copper, iodine, zinc, chromium, molybdenum, carbonyl iron, ferrous fumarate, polysaccharide iron, and/or combinations and derivatives thereof.

In some embodiments, a dose unit may be prescription and/or non-prescription substances. In some embodiments, the prescription substance may be a hormone replacement agent, a contraceptive agent, an osteoporotic agent, a chemotherapeutic agent, an anti-infective agent, analgesic, a steroid, an appetite suppressant, a weight loss agent, a tobacco antagonist, a cholesterol reducer and/or combinations thereof.

In some embodiments, the prescription substances may include, such as, for example, ticagrelor (anti-platelet), clopidogrel (anti-platelet), prasugrel (anti-platelet), carvedilol (beta blocker), metoprolol succinate (beta blocker), metoprolol tartrate (beta blocker), lisinopril (ACE inhibitor), losartan (angiotensin receptor blocker), valsartan (angiotensin receptor blocker), atorvastatin (statin), simvastatin (statin), spironolactone (aldosterone receptor blocker/diuretic), atenolol, erythromycin, penicillins, cephalosporins, theophylline, albuterol, terbutaline, diltiazem, propranolol, nifedepine, clonidine, thioridazine, diazepam, meclizine, ergoloid mesylates, chlorpromazine, carbidopa, levodopa, beclomethasone diproprionate, budesonide, dexamehasone, flunisolide, fluticasone proprionate, mometasone furoate, triamcinolone acetonide, beconase, pulmicort, rhinocort, decadron, aerobid/nasolide, flovent/flonase, azmacort, amprenavir, adefovir dipivoxil, zidovudine, azidothymidine, AZT, paclitaxel, cyclophosphamide, teniposide, taxol, cytoxan, vumon, methotrexate, methotrexate, cisplatin, carboplatin, oxaliplatin, platinol, paraplatin, adriamycin, bleomycin, dactinomycin, daunorubicin, doxorubicin, indarubicin, mitomycin, blenoxane, cosmegen, cerubidine, rubex, indamycin, mutamycin, BCNU, streptozocin, vinblastine, thiotepa, conjugated estrogens, esterified estrogens, estropipate, estradiol, ethinyl estradiol, medroxyprogesterone, meprobamate, desogestrel, levonorgestrel, norethindrone, norethindrone acetate, norgestimate, norgestrel, raloxifene, tamoxifen, methyltestosterone, quinapril, sotalol, alendronate, atorvastatin, colestipol, clofibrate, and/or combinations thereof.

In some embodiments, the non-prescription substance can be a vitamin or derivative thereof, and/or a mineral compound or derivative thereof. In some embodiments, the vitamin or mineral compound may be, such as, for example, thiamin, thiamin pyrophosphate, riboflavin, flavin mononucleoride, flavin adenine dinucleotide, niacin, nicotinic acid, nicotinamide, niacinamide, nicotinamide adenine dinucleotide, tryptophan, biotin, folic acid, pantothenic acid, ascorbic acid, retinol, retinal, retinoic acid, beta-carotene, 1,25-dihydroxycholecalciferol, 7-dehydrocholesterol, alpha-tocopherol, tocopherol, tocotrienol, menadione, menaquinone, phylloquinone, naphthoquinone, calcium, calcium carbonate, calcium sulfate, calcium oxide, calcium hydroxide, calcium apatite, calcium citrate-malate, calcium gluconate, calcium lactate, calcium phosphate, calcium levulinate, phosphorus, potassium, sulfur, sodium, docusate sodium, chloride, magnesium, magnesium stearate, magnesium carbonate, magnesium oxide, magnesium hydroxide, magnesium sulfate, copper, iodine, zinc, chromium, molybdenum, carbonyl iron, ferrous fumarate, polysaccharide iron, and combinations and derivatives thereof. In some embodiments, the derivatives of vitamin compounds include salts, alkaline salts, esters and chelates of any vitamin compound. In some embodiments, the nonprescription substance can be a herbal compound, herbal extract, derivative thereof and/or combinations thereof.

In some embodiments, a medication regimen can include a first dosage unit arrayed on a blister pack of receptacles 62 adjacent to a second dosage unit. In some embodiments, the medication regimen includes a first dosage unit disposed adjacent to a second dosage unit disposed with different receptacles 62.

In some embodiments, as shown in FIG. 1, page 60 comprises thirty-five receptacles 62. One dosage unit is enclosed in each receptacle 62. Receptacles 62 are horizontally arranged in five rows adjacent to one another. In one embodiment, the rows are organized into weeks such that each row comprises seven receptacles 62. Page 60 comprises indicia 64 indicating the time and order in which the medications are to be taken by the patient. In some embodiments, each receptacle 62 is labeled with an arrow having the day the dosage should be taken according to a dosage regimen. Indicia 64 are screen printed on page 60. In some embodiments, indicia 64 may be hand written. Sections of page 60 may be left blank to allow hand written notes or instructions by a patient, pharmacist or doctor.

In one embodiment, page 60 comprises twenty-eight receptacles 62. One dosage unit is enclosed in each receptacle 62. Receptacles 62 are vertically arranged in two groupings of two rows adjacent to one another. The groupings are organized into weeks such that each grouping comprises fourteen receptacles 62. Page 60 comprises indicia 64 indicating the time and order in which the medications are to be taken by the patient. Each receptacle 62 is labeled with a number to indicate the day of a dosage regimen the medications should be taken. Indicia 64 include graphics to indicate the time of day the medications should be taken. Indicia 64 are screen printed on page 60. In some embodiments, indicia 64 may be hand written. Sections of page 60 are left blank to allow hand written notes or instructions by a patient, pharmacist or doctor.

Figure 15:
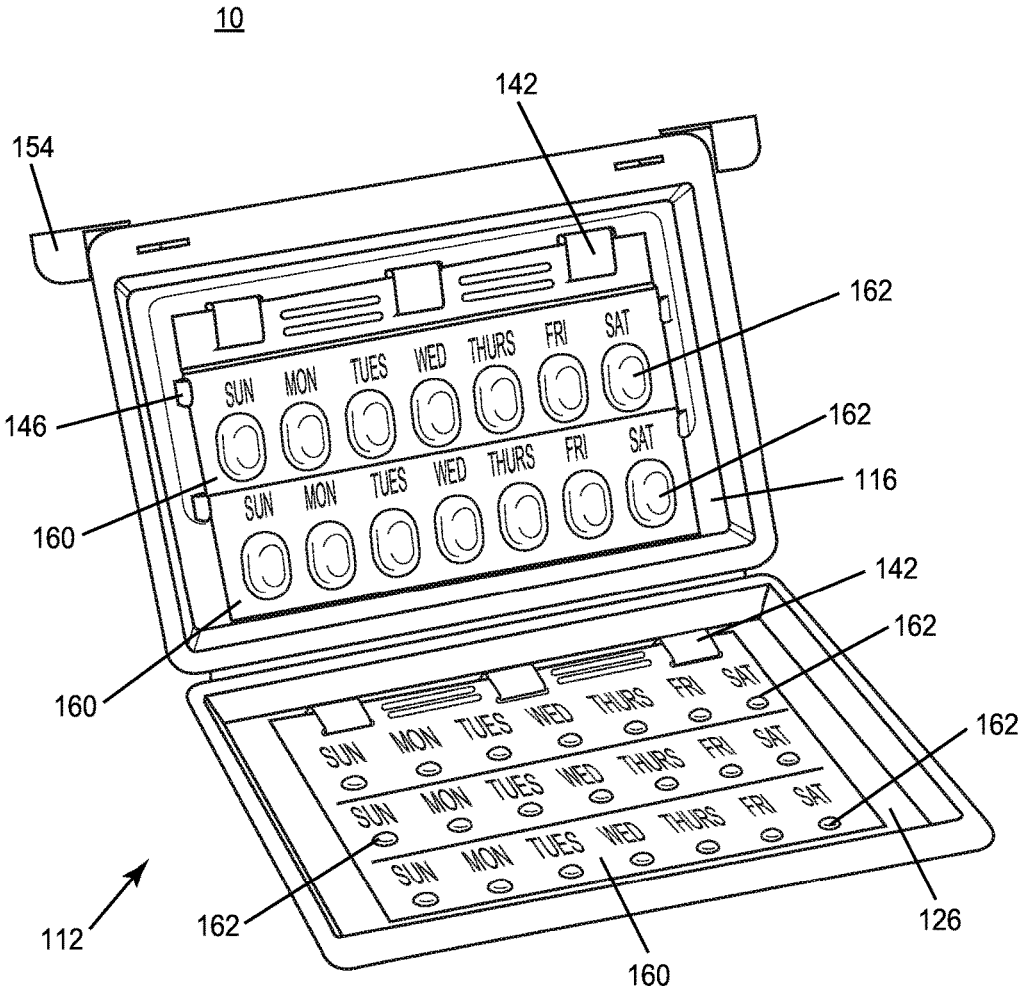
FIG. 15 is a perspective view of components of one embodiment of a system in accordance with the principles of the present disclosure.

In one embodiment, as shown in FIG. 15, page 60 comprises fourteen receptacles 62. One dosage unit is enclosed in each receptacle 62. Receptacles 62 are vertically arranged in two rows oppositely arranged from one another. The rows are organized into weeks such that each row comprises seven receptacles 62. Page 60 comprises indicia 64 indicating the time and order in which the medications are to be taken by the patient. Each receptacle 62 is labeled with a number to indicate the day a dosage regimen for the medications should be taken. Indicia 64 are screen printed on page 60. In some embodiments, indicia 64 may be hand written. Sections of page 60 are left blank to allow hand written notes or instructions by a patient, pharmacist or doctor.

In some embodiments, as shown in FIG. 1, page 60 comprises indicia 64 to indicate the name and/or nature of the medications being administered. In some embodiments, indicia 64 include a list of possible side effects of the medications being administered. In some embodiments, indicia 64 provide instructions on how long a patient should take the medication being administered.

In some embodiments, as shown in FIG. 1, medicament dispensing system 10 comprises one or more information labels 70 to educate a patient about a medication being administered in the dosage regimen. In some embodiments, label 70 comprises indicia 72 to indicate the name and/or nature of the medicine being administered. In some embodiments, indicia 72 include a list of possible side effects of the medications being administered. In some embodiments, indicia 72 provide instructions on how long a patient should take the medication being administered. In some embodiments, label 70 is a sticker that is adhered onto an inner surface of surface 16 and/or 26 to be viewed in tandem with a page 60.

In one embodiment, unit dose page 60 is configured to be inserted into a loading unit 80 configured to hold page 60 in place while a pharmacist or a medical practitioner fills receptacles 62 with medicaments, as shown in FIGS. 5-8. Loading unit 80 includes a front sidewall 82 and opposing sidewalls 84. Walls 82, 84 define an insertion plane. In one embodiment, the insertion plane comprises a rectangular shape to conform to the shape of unit dose page 60. Sidewalls 20 are disposed on opposing sides of the insertion plane such that sidewall 18 extends between sidewalls 20.

Figure 5:
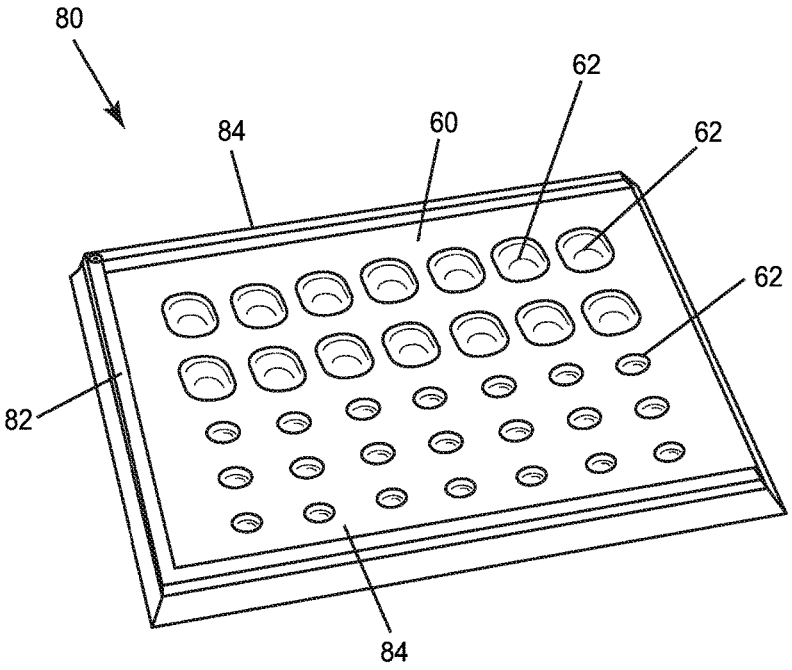
FIG. 5 is a perspective view of components of one embodiment of a system in accordance with the principles of the present disclosure.

Walls 82, 84 comprise a channel 88 along an inner surface to receive a page 60. Channel 88 runs along the entire length of the inner surfaces of walls 82, 84 and is wide enough to accommodate the thickness of a page 60. As shown in FIG. 5, unit 80 includes only three sidewalls configured to surround a page 60 on three sides. The fourth side does not include a sidewall to facilitate insertion and removal of page 60. In some embodiments, walls 82, 84 do not include a channel 88 and page 60 rests on a flat surface that extends between walls 82, 84.

Figure 6:
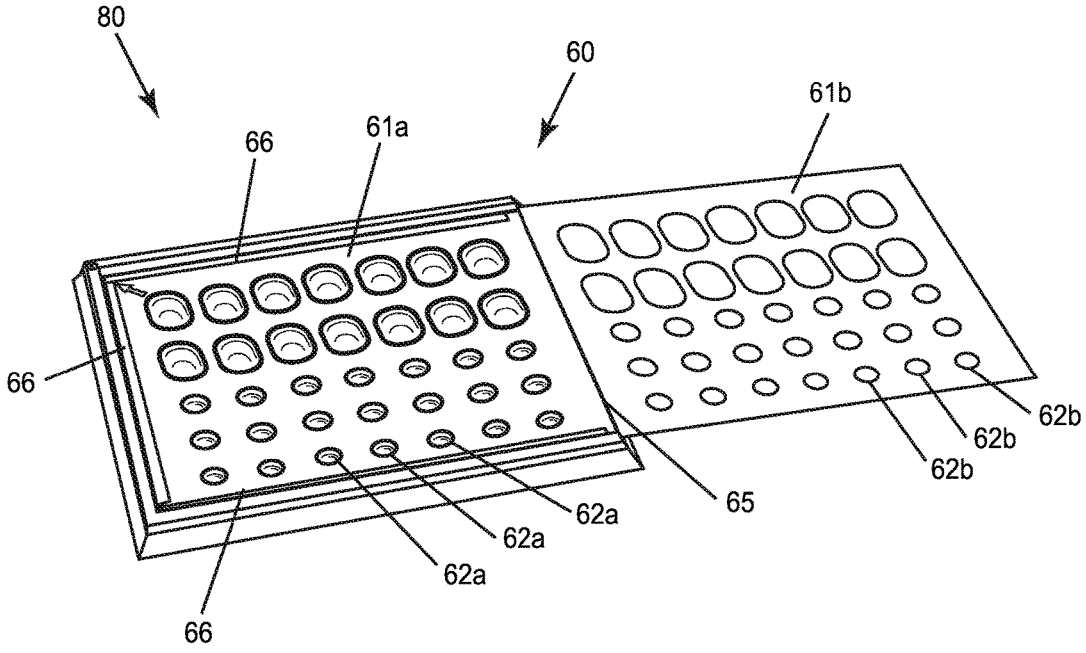
FIG. 6 is a perspective view of components of the system shown in FIG. 5.

In one embodiment, as shown in FIG. 6, a unit dose page 60 has a bottom surface 61*a* and an upper surface 61*b*. Surface 61*a* is joined to surface 61*b* at a folding line 65. In some embodiments, line 65 may be variously configured. For example, line 65 may comprise a line of perforations or a breaking line. Surface 61*b* is configured to be rotatable relative to surface 61*a* along line 65. In some embodiments, surfaces 61*a* and 61*b* are not joined together, but exist as two separate pieces. In some embodiments, surface 61*a* includes a weather resistant material configured to maintain a closed environment for medicaments held therein. Surface 61*a* includes receptacles 62*a* which define depressions sized to hold one or more medicaments therein. Surface 61*b* includes a resilient material configured to form a barrier to hold medicaments in receptacles 62*a*. In some embodiments, surface 61*b* includes a foil layer, a laminate layer, and a resilient layer. In some embodiments, the resilient layer comprises a thin layer of paper or cardboard. Surface 61*b* includes tear areas 62*b* configured to align with receptacles 62*a*. In some embodiments, surface 61*b* includes a continuous foil layer and a resilient layer extending between areas 62*b* so that ripping through surface 61*b* to obtain medicaments will be localized to areas 62*b*.

Figure 8:
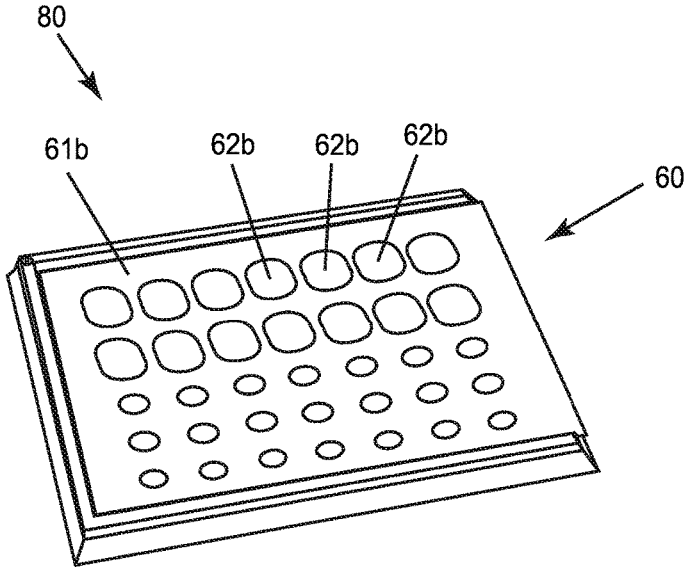
FIG. 8 is a perspective view of components of the system shown in FIG. 5.

Surfaces 61*a* and 61*b* are movable between a drug loading configuration, as shown in FIG. 6, and a drug storage configuration, as shown in FIG. 8. While in the drug loading configuration, surfaces 61*a* and 61*b* are open so that a pharmacist or a medical practitioner can freely place medicaments into receptacles 62*a*. While in the drug storage configuration, surface 61*b* is adhered to surface 61*a* to enclose the medicaments in receptacles 62. When moving page 60 from the drug loading configuration to the drug storage configuration, areas 62*b* are aligned with areas 62*a* to created localized ripping zones directly over receptacles 62*a*.

In some embodiments, as shown in FIG. 6, surface 61*a* includes one or more adhesive strips 66. Adhesive strips 66 are positioned along the sides of surface 61*a* adjacent walls 82, 84 of loading unit 80. In some embodiments, surfaces 61*a* and 61*b* are separate from one another. In some embodiments, an additional adhesive strip may be placed along a fourth edge of surface 61*a* in place of line 65. Adhesive strips 66 include a peelable layer, which is peeled off from strips 66 before surface 61*b* is pressed against surface 61*a* and adhered thereto. In some embodiments, surface 61*a* may comprise additional adhesive material between receptacles 62*a* to adhere to surface 61*b* between areas 62*b*.

Figure 7:
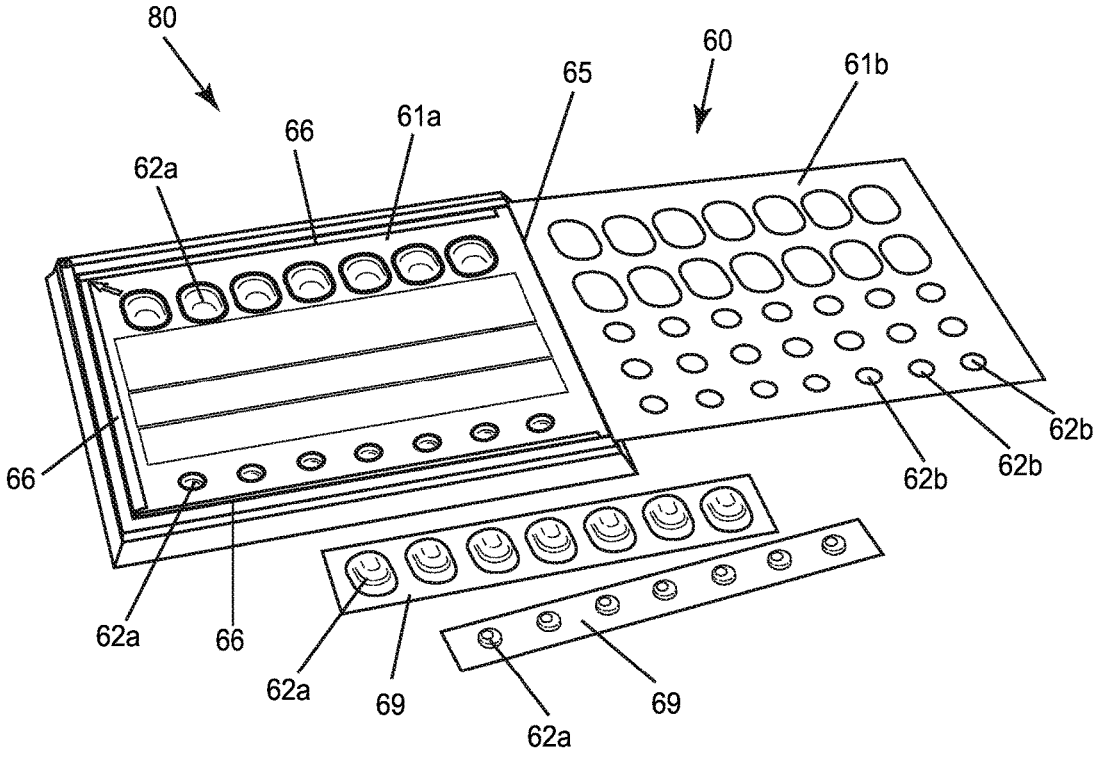
FIG. 7 is a perspective view of components of the system shown in FIG. 5.

In some embodiments, as shown in FIG. 7, unit dose page 60 is customizable by a pharmacist or medical practitioner as required by a complex dosage regimen. For example, surface 61*a* may include apertures 67 configured to receive receptacle inserts 69. Apertures 67 are sized to fit inserts 69. In some embodiments, inserts 69 include variously sized receptacles 62*b* to receive medicaments sized accordingly. A pharmacist or medical practitioner assembling page 60 may choose inserts 69 sized as necessary for a patient's complex dosage regimen.

In one embodiment, medicament dispensing system 10, similar to the systems and methods as described herein, including medicament dispensing container 12, as described herein, is employed in connection with treatment of a disease, illness and/or ailment of a patient. The components of medicament dispensing system 10 facilitate user/patient compliance with a medication regimen, as described herein, upon discharge from a health care facility, such as, for example, a hospital. In one embodiment, a patient utilizes medicament dispensing system 10 after being discharged from a hospital following a myocardial infarction and may be prescribed and/or directed to administer one or a plurality of prescription and/or non-prescription medications. For example, a patient may be prescribed an antiplatelet agent, aspirin, warfarin (anti-coagulant), a beta-blocker, an ACE inhibitor, a statin, nitro-glycerin, a docusate, and/or antidepressants in connection with treatment for the myocardial infarction.

In some embodiments, a medical practitioner and/or pharmacist reviews and/or considers medications including one or more prescriptions in connection with treatment for the myocardial infarction, one or more non-prescribed medications directed for administration by the patient in connection with treatment for the myocardial infarction, one or more existing prescriptions and/or one or more non-prescription medications and supplements being taken by the patient. The medical practitioner and/or pharmacist determine a medication regimen based on these medications using medicament dispensing system 10 to facilitate user/patient compliance with the medication regimen.

In some embodiments, based on the determined medication regimen, health care personnel, such as, for example, pharmacy personnel prepare selected unit dose pages 60 and/or labels 70, as described herein, for disposal with a selected medicament dispensing container 12 specifically created for the myocardial infarction and the user/patient upon discharge from the hospital.

Medicament dispensing container 12 is portable such that the user/patient transports and/or carries medicament dispensing container 12 upon discharge. Locking mechanism 50 is moved from a closed configuration, similar to that described herein, to an open configuration, similar to that described herein. The contents of container 12, which may include unit dose pages 60 and/or inserts 70, as described herein, are accessible to the user/patient. The user/patient employs the components of medicament dispensing system 10, for example, following direction via indicia 64 for administering dosage units from receptacles 62 and/or following instruction from indicia 64 and/or inserts 70, to facilitate user/patient compliance with the medication regimen in connection with treatment for the myocardial infarction. In some embodiments, locking mechanism 50 can be moved to a locked position such that medicament dispensing container 12 is disposable in a locked configuration, similar to that described herein, for storage and subsequent use.

In one embodiment, as shown in FIGS. 9-16, medicament dispensing system 10, similar to the systems and methods as described herein, includes a medicament dispensing container 112. Medicament dispensing container 112 includes a cover 114 and a cover 124. Cover 114 includes a bottom section 116, a front sidewall 118, and opposing sidewalls 120. Walls 118, 120 define a surface 122. Sidewalls 120 are disposed on opposing sides of bottom section 116 such that sidewall 118 extends between sidewalls 120.

Cover 124 includes a top section 126, a front sidewall 128, and opposing sidewalls 130. Sidewalls 130 are disposed on opposing sides of top section 126 such that sidewall 128 extends between sidewalls 130. Walls 128, 130 define a surface 132. Surface 122 is configured to mate with surface 132 to close medicament dispensing container 112.

Figure 11:
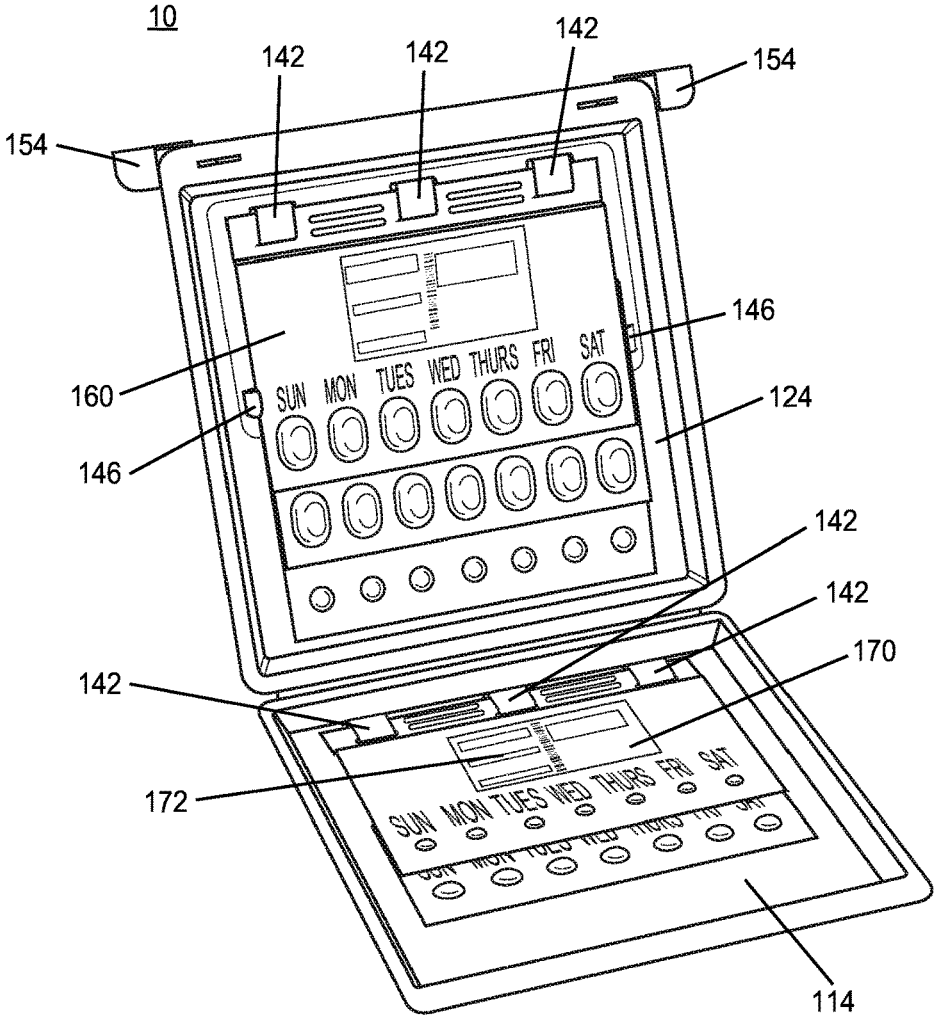
FIG. 11 is a perspective view of components of the system shown in FIG. 9.
Figure 14:
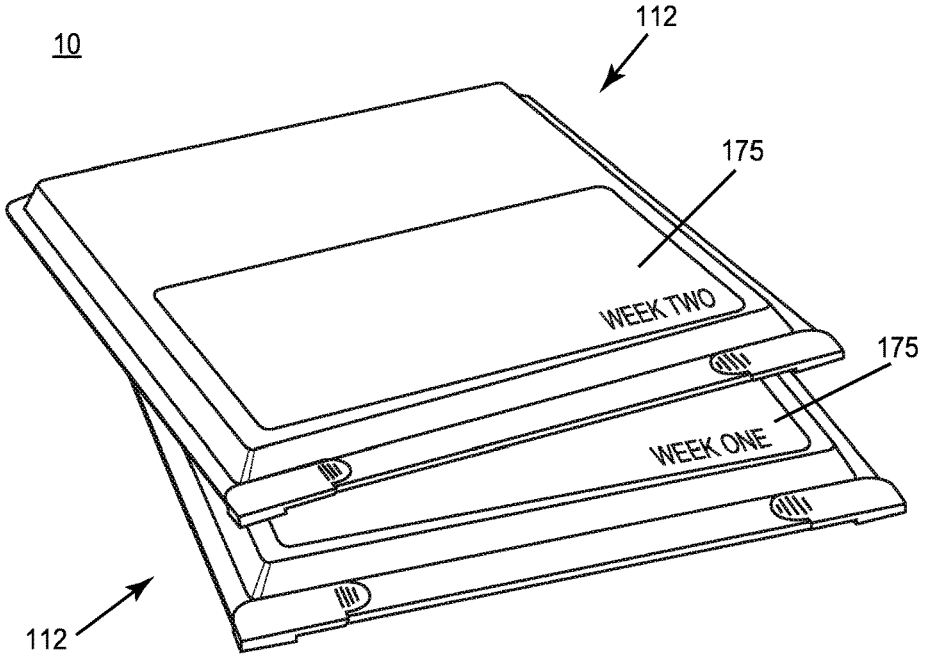
FIG. 14 is a perspective view of components of one embodiment of a system in accordance with the principles of the present disclosure.
Figure 14A:
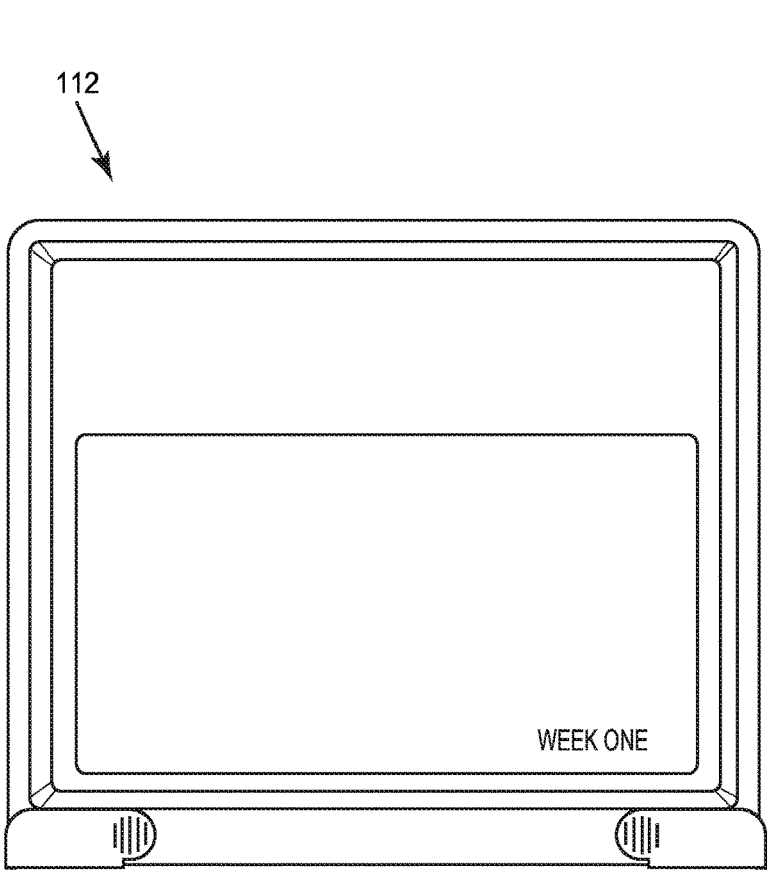
FIG. 14A is a perspective view of components of one embodiment of a system in accordance with the principles of the present disclosure.
Figure 14B:
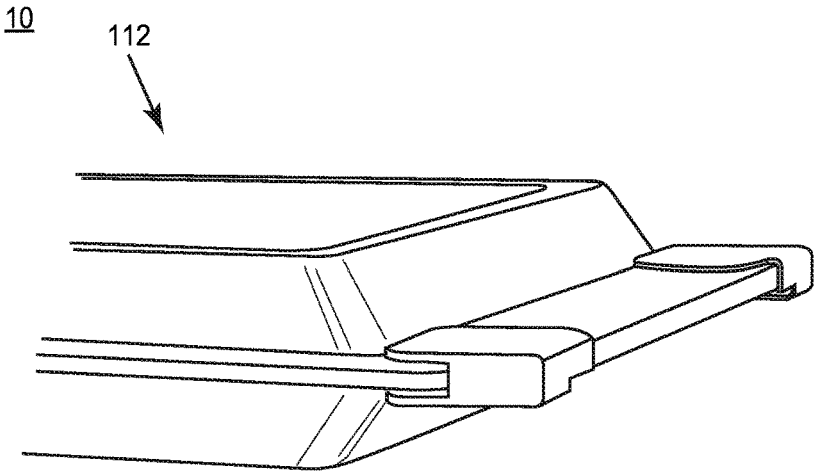
FIG. 14B is a perspective view of components of one embodiment of a system in accordance with the principles of the present disclosure.

In some embodiments, medicament dispensing container 112 includes a connecting portion, such as, for example, a spine 140. Spine 140 extends between cover 114 and cover 124 such that cover 124 is pivotable relative to cover 114. In some embodiments, spine 140 comprises a hinge. Cover 124 is attached to spine 140 at an end opposite sidewall 128, and cover 114 is attached to spine 140 at an end opposite sidewall 118. Cover 124 is pivotable relative to cover 114 between an open or non-locked configuration, similar to that described herein, as shown in FIG. 11, and a closed or locked configuration, similar to that described herein, as shown in FIG. 14. In some embodiments, medicament dispensing container 112 is disposable in a closed, locked configuration, similar to that described herein, with a locking mechanism 150, as described herein.

Figure 9:
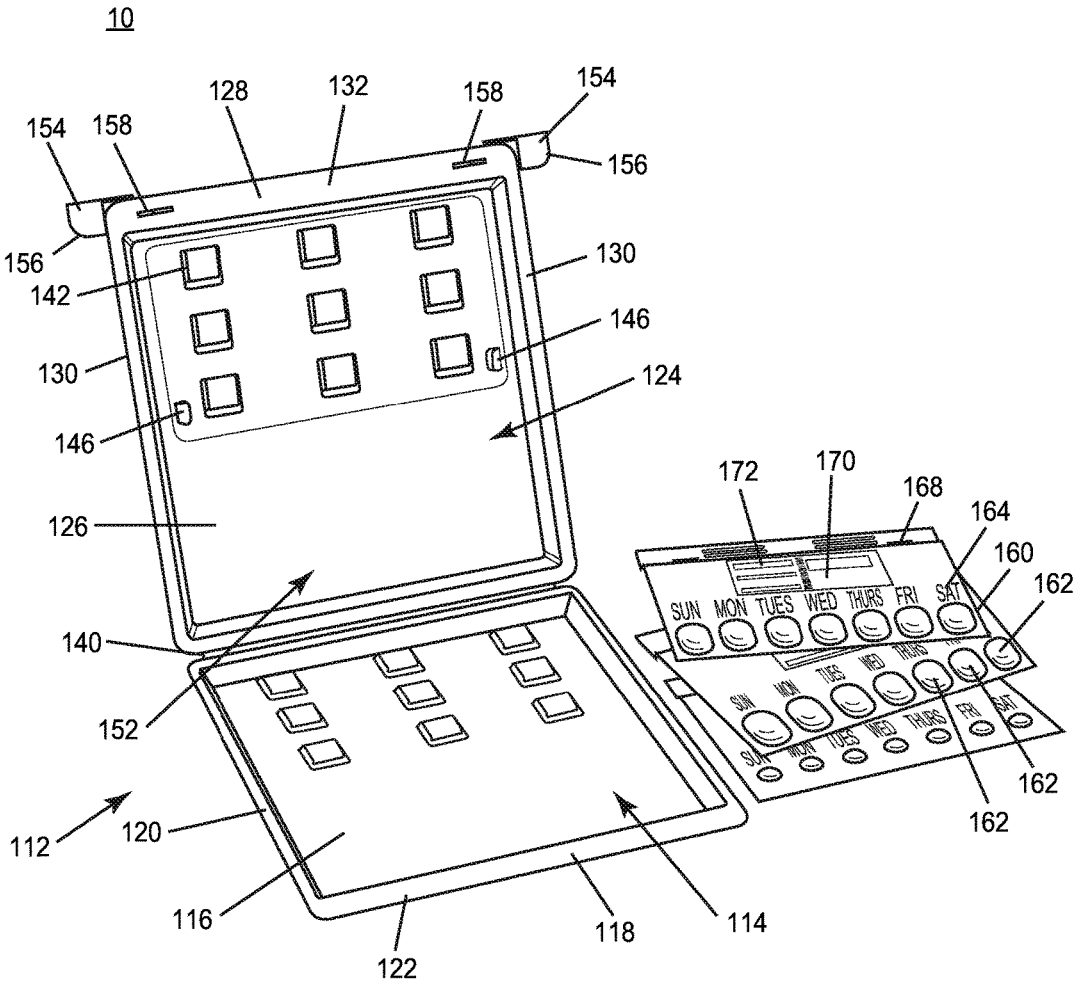
FIG. 9 is a perspective view of components of one embodiment of a system in accordance with the principles of the present disclosure.
Figure 10:
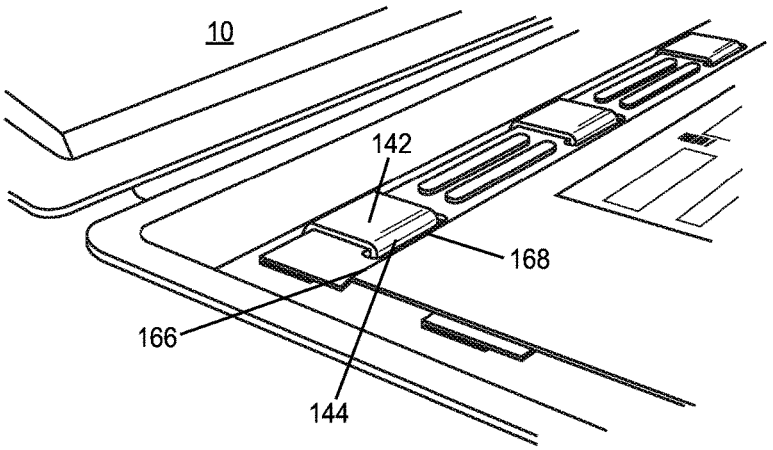
FIG. 10 is a break away perspective view of components of the system shown in FIG. 9.

In some embodiments, cover 124 is rotatable relative to cover 114 through an angular range of 0 through 360 degrees. In a closed configuration, as shown in FIG. 14, spine 140, sidewalls 118, 120, 128, 130, and sections 116, 126 define a substantially enclosed cavity 152 configured for disposal of unit dose pages 160 and/or information labels 170, as discussed herein, such that cover 124 and cover 114 prevent access to contents of medicament dispensing container 112. Section 116 and/or section 126 include at least one unit dose page fixation member, such as, for example, fastener 142. A fastener 142 projects from section 116 or section 126 into cavity 152 and is configured to hold a unit dose page 160 in place. In some embodiments, fastener 142 extends in a cantilever configuration from section 116 or section 126 into cavity 152. In some embodiments, sections 116, 126 include a plurality of fasteners 142. Fasteners 142 are present in rows of three to capture and retain a page 160. Each fastener 142 includes a hook 144 configured for disposal with an opening 168 for capture of a page 160, as discussed herein. In some embodiments, section 116 and/or section 126 include projections 146 to prevent pages 160 from unfolding. In some embodiments, sections 116 and 126 include several rows of fasteners 142 to hold multiple pages 160 in place. For example, in one embodiment, as shown in FIG. 9, section 116 includes three rows of fasteners 142 to hold three pages 160 and section 126 also includes three rows of fasteners 142 to hold three additional pages 160. In some embodiments, section 116 and/or section 126 include one row of fasteners 142 to hold pages 160, as shown in FIG. 15. In some embodiments, section 116 and/or section 126 include two rows of fasteners 142 to hold pages 160. In some embodiments, section 116 includes a different number of rows of fasteners 142 than section 126. In some embodiments, fastener 142 is movable relative to section 116 and/or section 126, which may include deflection, resilient bias, elasticity and/or plastic deformation.

In some embodiments, in a closed configuration, cover 124 and cover 114 provide a child and/or tamper resistant medicament dispensing container. In an open configuration, cover 114 is rotated relative to cover 124 such that medicament dispensing container 112 rests flatly on a surface to facilitate ease of access to the contents of the cavity of container 112.

Medicament dispensing container 112 includes a mechanism configured to connect cover 114 with cover 124 for disposal of the components of medicament dispensing container 112 in a closed configuration. In some embodiments, cover 114 and/or cover 124 is provided with indicia, such as, for example, instructions to aid a user patient in use of medicament dispensing container 112. The instructions may be presented in the form of a graphic, such as, for example, a bull's eye, or text, such as, for example, "push here".

Medicament dispensing container 112 includes locking mechanism 150 comprising a slide 154, such as, for example, two slides 154, disposed on opposite sides of covers 114, 124 at a corner defined by front walls 118, 128 and sidewalls 120, 130. Each slide 154 includes a male engagement portion, such as for example, a flange 156 configured to engage cover 124. Surface 132 includes slots 158 that extend a distance from sidewalls 130 towards each other along front walls 118, 128. Slots 158 are configured to facilitate translation of flanges 156 such that slides 154 are translated, similar to the direction shown by arrow A in FIG. 2, to move medicament dispensing container 112 to an open or non-locked configuration, similar to that described herein, and slides 154 are translated, similar to the direction shown by arrow B in FIG. 2, to a closed or locked configuration, similar to that described herein.

In some embodiments, locking mechanism 150 audibly clicks to indicate a locked position. In some embodiments, locking mechanism 150 is provided with instructions to aid a patient in use of container 112. In some embodiments, the instructions may be presented in the form of a graphic, such as, for example, an arrow with a lock, or text, such as, for example, "slide to unlock". In some embodiments, the instructions may be printed on locking mechanism 150. Alternatively, in some embodiments, the instructions may be printed onto sidewall 118 adjacent locking mechanism 150.

Figure 12:
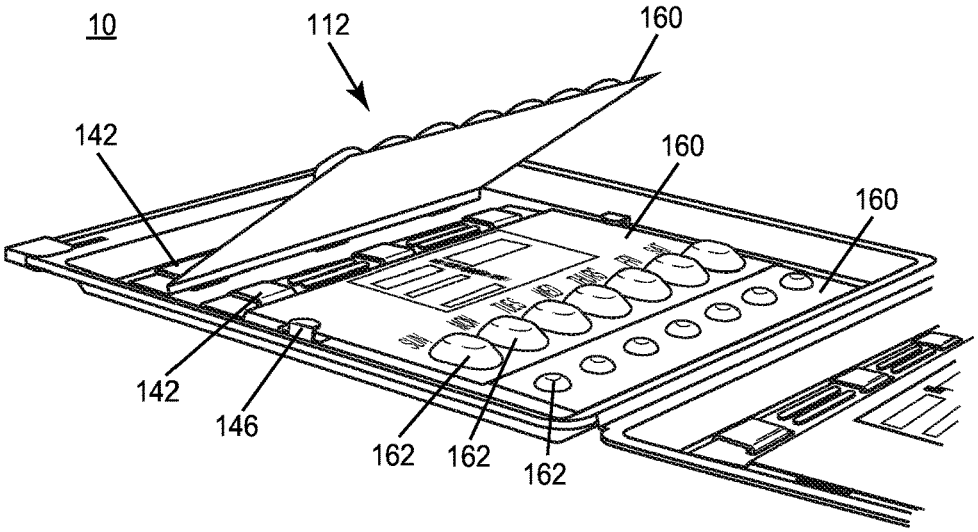
FIG. 12 is a break away perspective view of components of the system shown in FIG. 9.

Medicament dispensing container 112 comprises one or more unit dose pages 160, similar to page 60 as described herein, which store and/or contain one or more medications, such as, for example, a dose of at least one medication. The dose of medication(s) is enclosed and sealed in a plurality of receptacles 162, similar to receptacles 62 as described herein. In some embodiments, medicament dispensing container 112 includes a plurality of pages 160. In one embodiment, the plurality of pages 160 is disposed in a tri-fold configuration, as shown in FIG. 12. In some embodiments, each page 160 encloses a different medication such that each medication that is part of a patient's dosage regimen and is organized on separate pages 160. In some embodiments, page 160 comprises receptacles 162 indicating a patient's daily dosage of medication held within page 160. In some embodiments, page 160 comprises indicia 164, disposed with and displayed from a predetermined area adjacent one or more receptacles 162, indicating information regarding the medication enclosed within receptacles 162.

Page 160 includes three openings 168 that are sized to be received by fasteners 142. Hooks 144 are configured to be disposed within openings 168 and under page 160 to capture page 160. Hooks 144 include an arcuate portion configured to fit through an opening 168. In some embodiments, page 160 includes a folding line 166, which allows page 160 to be folded to access the medicaments held within receptacles 162 of the page 160 and/or additional pages 160 attached to container 112 and positioned adjacent to the page 160. A first page 160 is held by a bottom row of fasteners 142 on section 116 or 126, and a second page 160 is held by a row of fasteners 142 above the bottom row such that the second page 160 must be folded up to gain access to the first page 160. In some embodiments, a third page 160 is applied to a third row of fasteners 142 in a similar fashion. In some embodiments, as shown in FIG. 11, label 170 is applied to the front of page 160 adjacent to receptacles 162. By rotating a second page 160 along folding line 166, a user can view label 170 of a first page 160. Similarly, a label 170 of a third page 160 can be viewed by rotating first and second pages 160 along respective folding lines 166.

Figure 13:
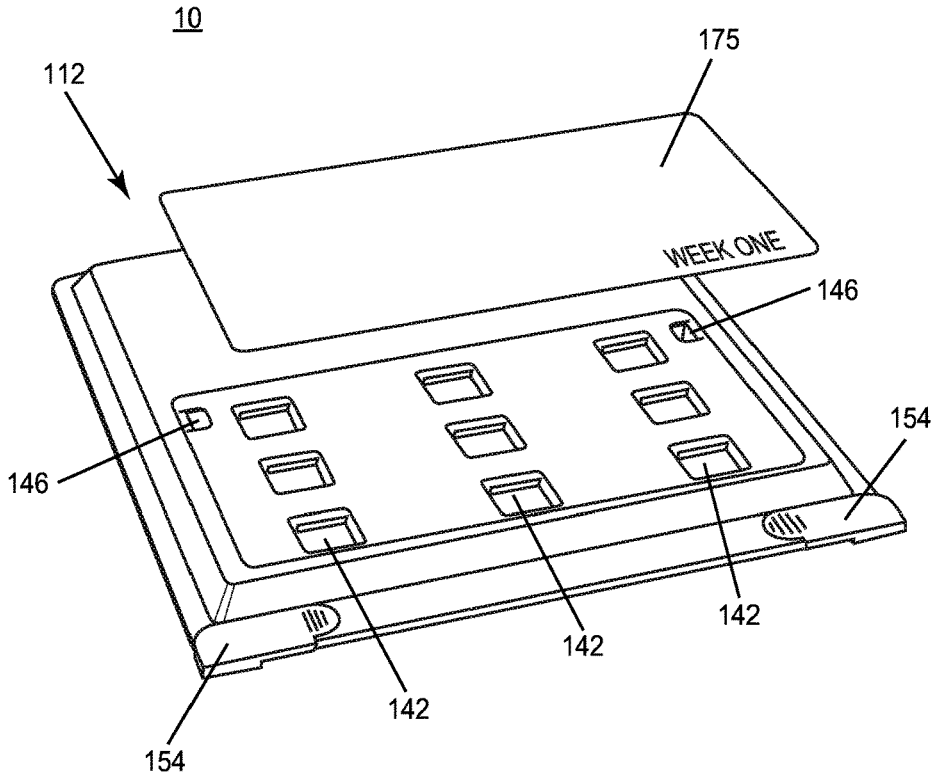
FIG. 13 is a perspective view of components of the system shown in FIG. 9.

As shown in FIGS. 13 and 14, medication container 112 includes an outer label 175. Label 175 may be applied to an outer surface of section 116 and/or section 126 and comprises indicia to present information to a user. In some embodiments, label 175 includes the ordinal week of dosages contained within container 112. In some embodiments, the indicia include information regarding medication and dosages required by a prescribed and/or non-prescribed regimen contained within container 112. In some embodiments, the indicia include a description of medication, which may include a name of a drug and a medical effect of a drug contained within container 112. In some embodiments, label 175 includes blank space to allow a pharmacist or medical practitioner to write personalized notes or reminders to a patient.

Figure 16:
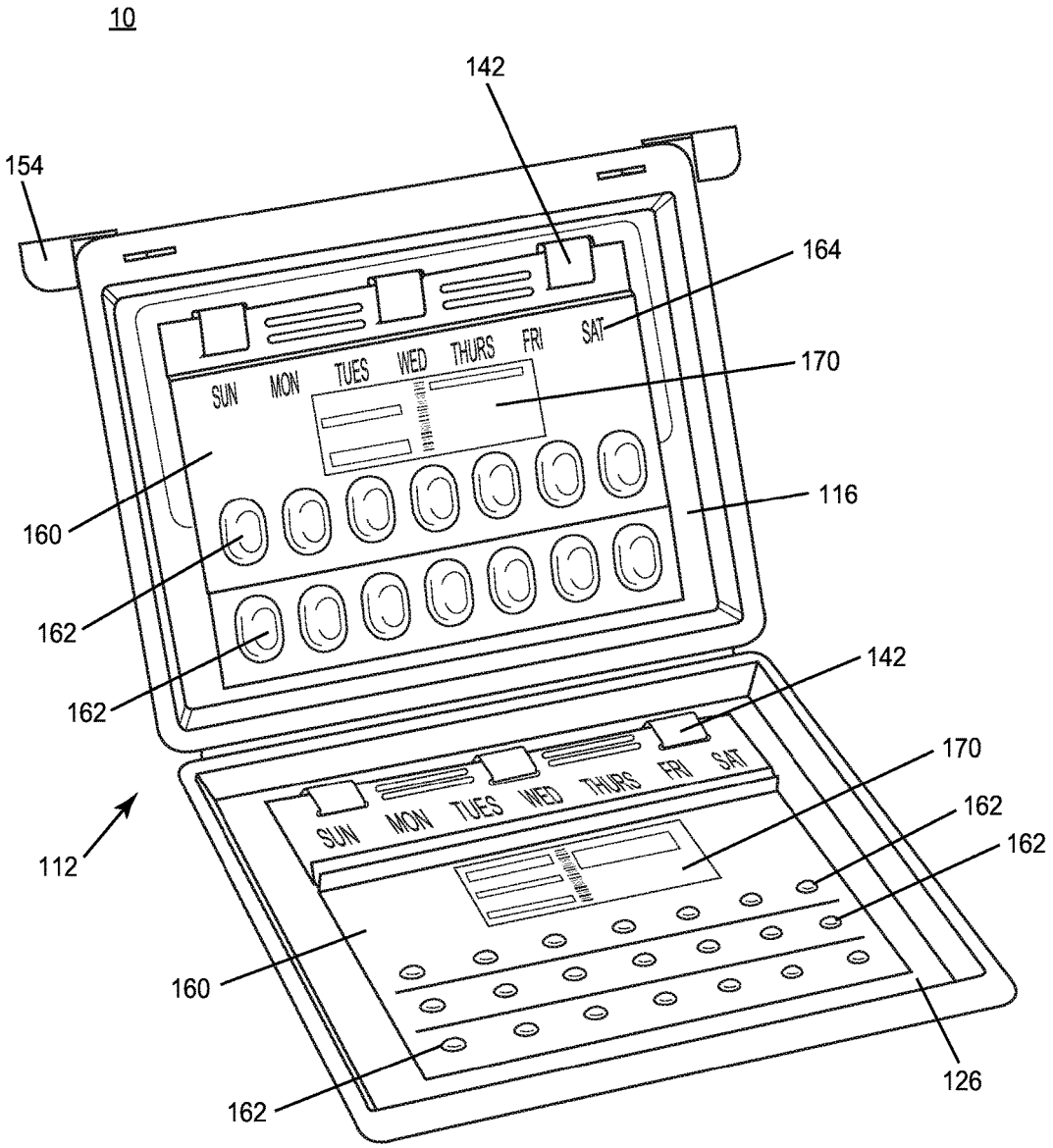
FIG. 16 is a perspective view of components of one embodiment of a system in accordance with the principles of the present disclosure.

In some embodiments, as shown in FIGS. 15 and 16, container 112 may include variously sized pages 160 to create a compact profile for container 112. As shown in FIG. 15, container 112 includes two pages 160 attached to section 116 and a single page 160 attached to section 126. The two pages 160 attached to section 116 each includes a row of receptacles 162 sized for large medications and the single page 160 attached to section 126 includes three rows of receptacles 162 sized for small medications. In some embodiments, as shown in FIG. 16, container 112 includes a page 160 having two rows of receptacles 162 sized for large medications attached to section 116 and a page 160 having three rows of receptacles 162 sized for small medications attached to section 126. Labels 170 are positioned on each of pages 160.

Figure 17:
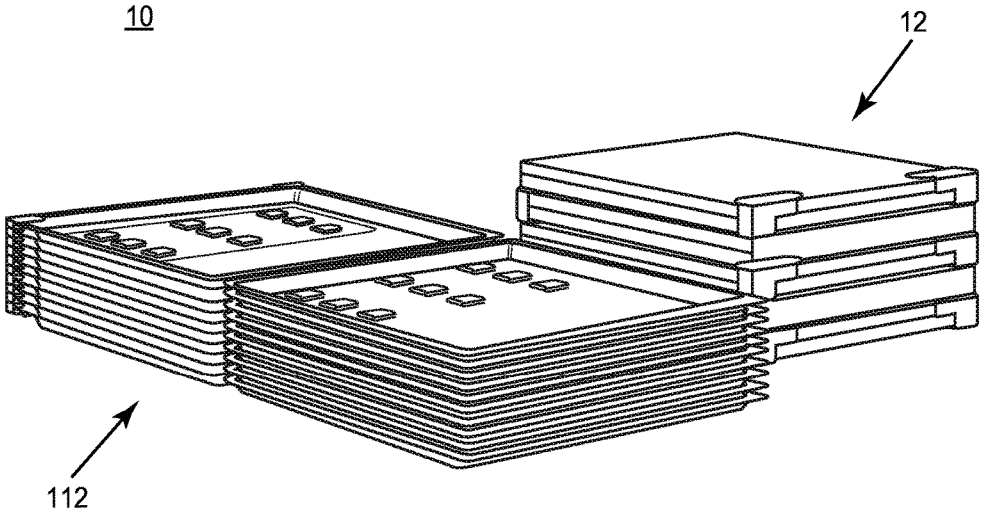
FIG. 17 is a perspective view of components of one embodiment of a system in accordance with the principles of the present disclosure.

In some embodiments, medicament dispensing containers 12, 112 are configured to be stackable, as shown in FIG. 17. Containers 12 include flat surfaces defined by sections 16 and 26 to facilitate stacking. Containers 112 include cup-shaped portions with centrally flat surfaces defined by sections 116 and 126. The stackability of containers 12, 112 facilitates flat packing for logistics, such as shipping and storing.

Figure 18:
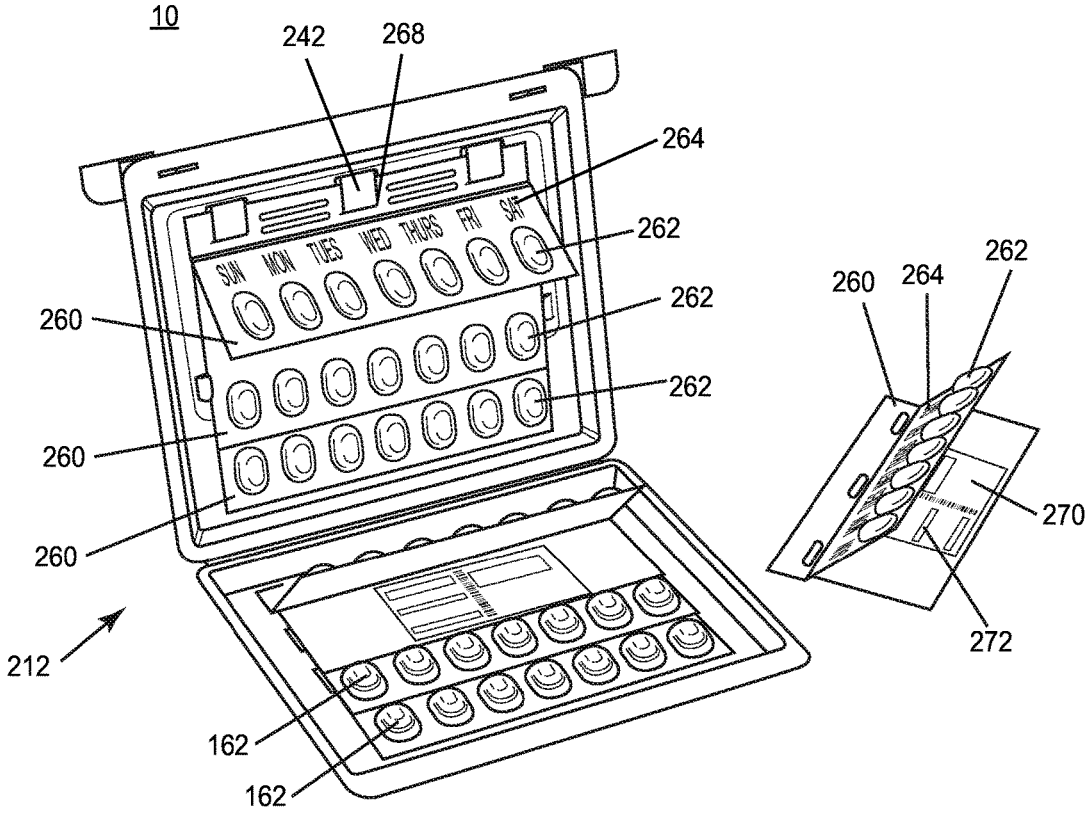
FIG. 18 is a perspective view of components of one embodiment of a system in accordance with the principles of the present disclosure.
Figure 19:
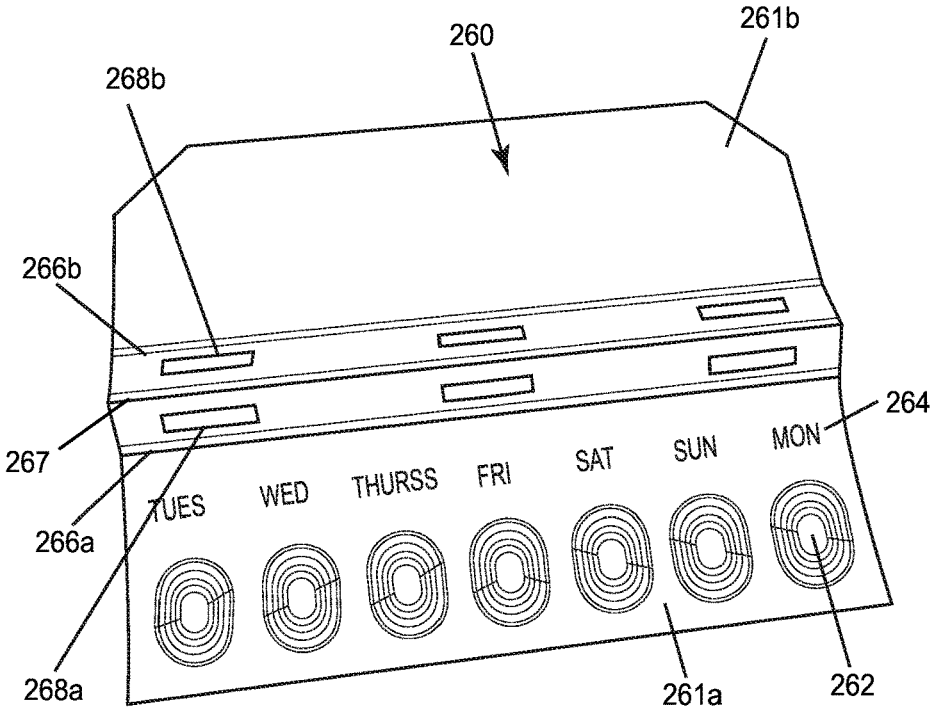
FIG. 19 is a perspective view of components of the system shown in FIG. 18.

In one embodiment, as shown in FIGS. 18-25, medicament dispensing system 10, similar to the systems and methods as described herein, includes a medicament dispensing container 212. Medicament dispensing container 212 comprises one or more unit dose pages 260, similar to pages 60, 160 as described herein, which store and/or contain one or more medications, such as, for example, a dose of at least one medication. The dose of medication(s) is enclosed and sealed in a plurality of receptacles 262, similar to receptacles 62, 162 as described herein. In some embodiments, page 260 comprises indicia 264, disposed with and displayed from a predetermined area adjacent one or more receptacles 262, indicating information regarding the medication enclosed within receptacles 262. In some embodiments, medicament dispensing container 212 includes a plurality of pages 260. In some embodiments, the plurality of pages 260 are disposed in a folding configuration, as shown in FIG. 18.

Figure 20:
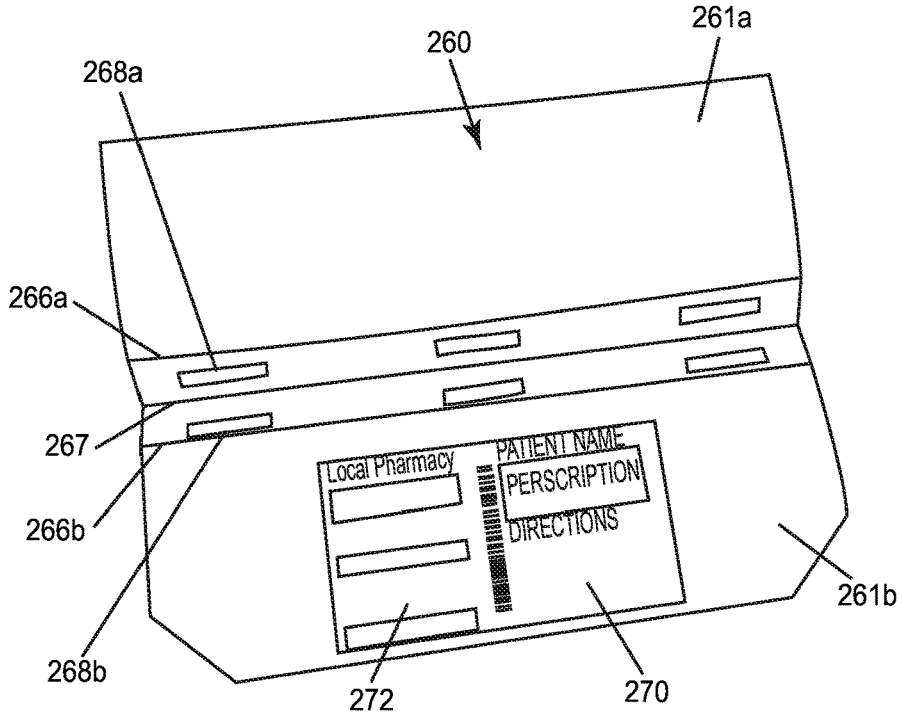
FIG. 20 is a perspective view of components of the system shown in FIG. 18.
Figure 21:
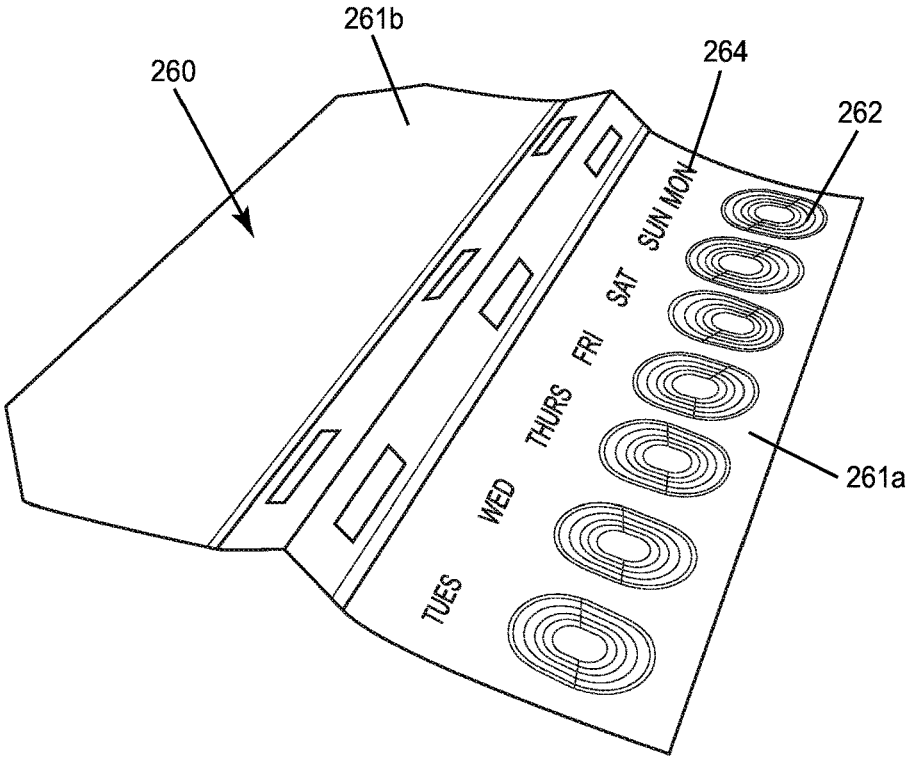
FIG. 21 is a perspective view of components of the system shown in FIG. 18.

In some embodiments, page 260 includes an upper surface 261*a* and a bottom surface 261*b*. Surface 261*a* is joined to surface 261*b* at a folding line 267. In some embodiments, line 267 may be variously configured. For example, line 267 may comprise a line of perforations or a breaking line. Surface 261*b* is configured to be rotatable relative to surface 261*a* along line 267 such that surfaces 261*a*, 261*b* abut one another. Page 260 includes an opening 268*a* on surface 261*a* and an opening 268*b* on surface 261*b* that are configured to align when surface 261*a* and 261*b* are rotated to abut one another. The hole formed by openings 268*a*, 268*b* is sized to be received by fasteners 242. In some embodiments, surface 261*a* includes a weather resistant material configured to maintain a closed environment for medicaments held therein. Surface 261*a* includes receptacles 262, which define depressions sized to hold one or more medicaments therein. Surface 261*b* includes a resilient material configured to abut surface 261*a*. In some embodiments, surface 261*a* includes a foil layer, a laminate layer, and a resilient layer. In some embodiments, the resilient layer comprises a thin layer of paper or cardboard. In some embodiments, as shown in FIG. 20, label 270 has indicia 272 that is applied to surface 261*b*.

Figure 22:
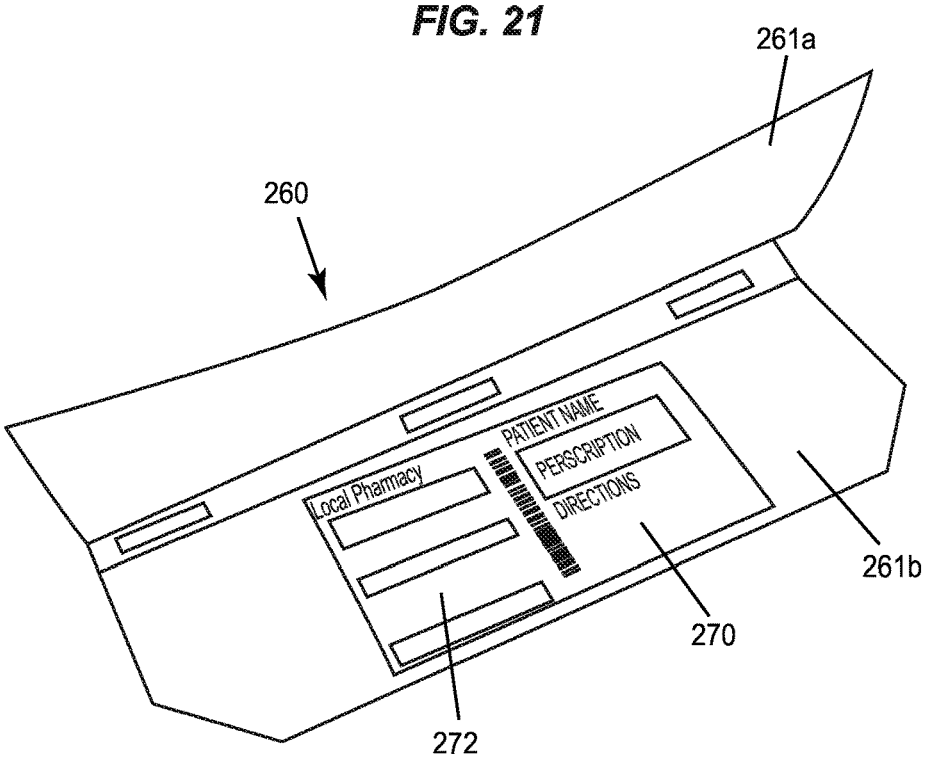
FIG. 22 is a perspective view of components of the system shown in FIG. 18.
Figure 23:
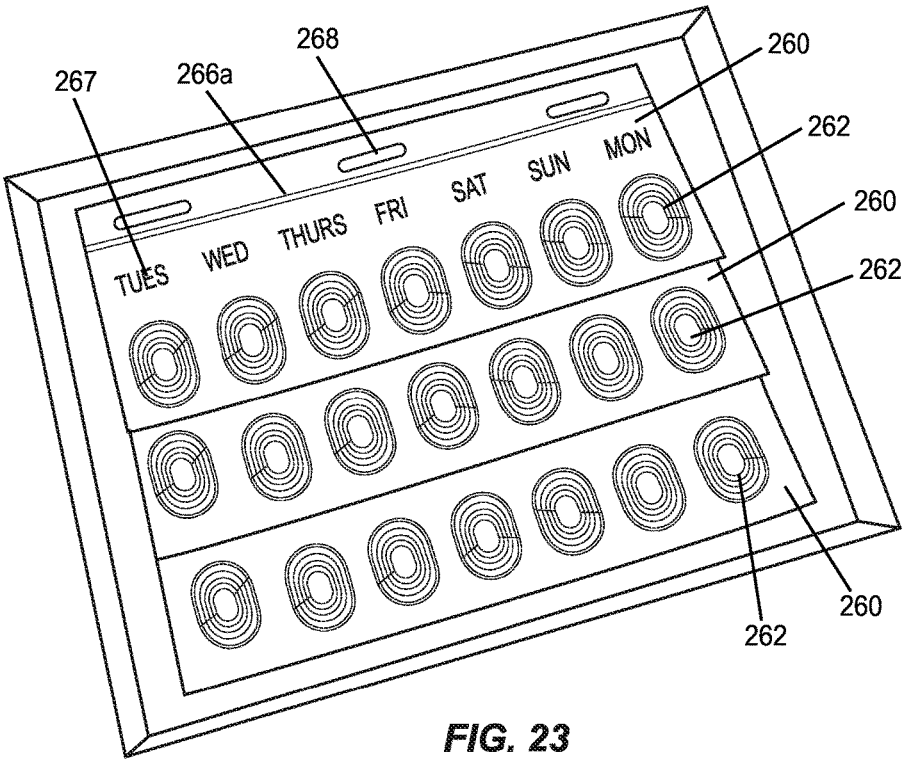
FIG. 23 is a perspective view of components of the system shown in FIG. 18.
Figure 24:
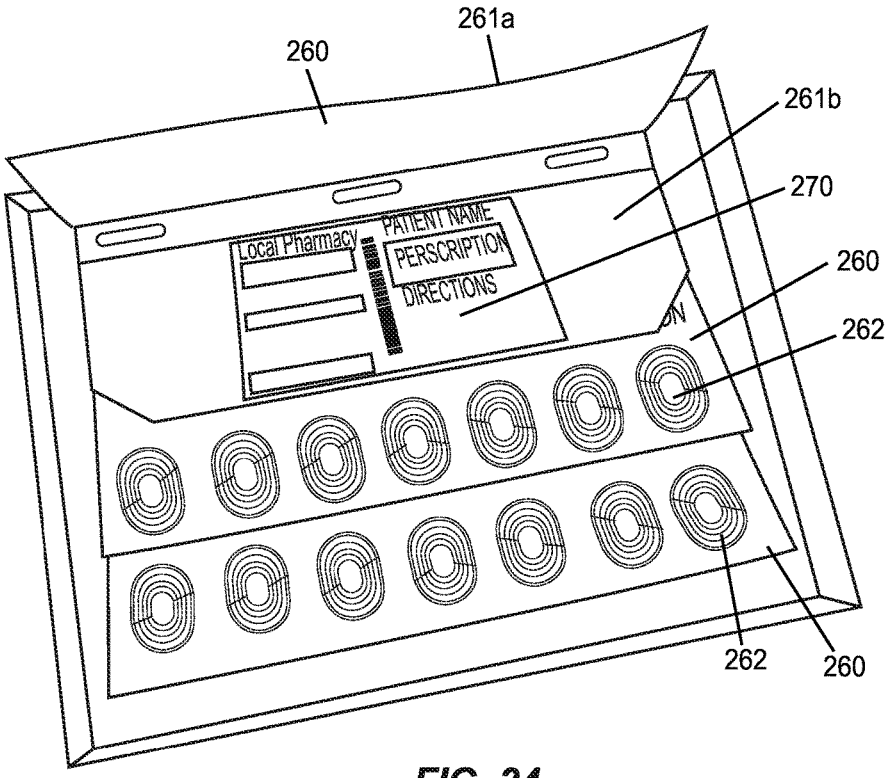
FIG. 24 is a perspective view of components of the system shown in FIG. 18.
Figure 25:
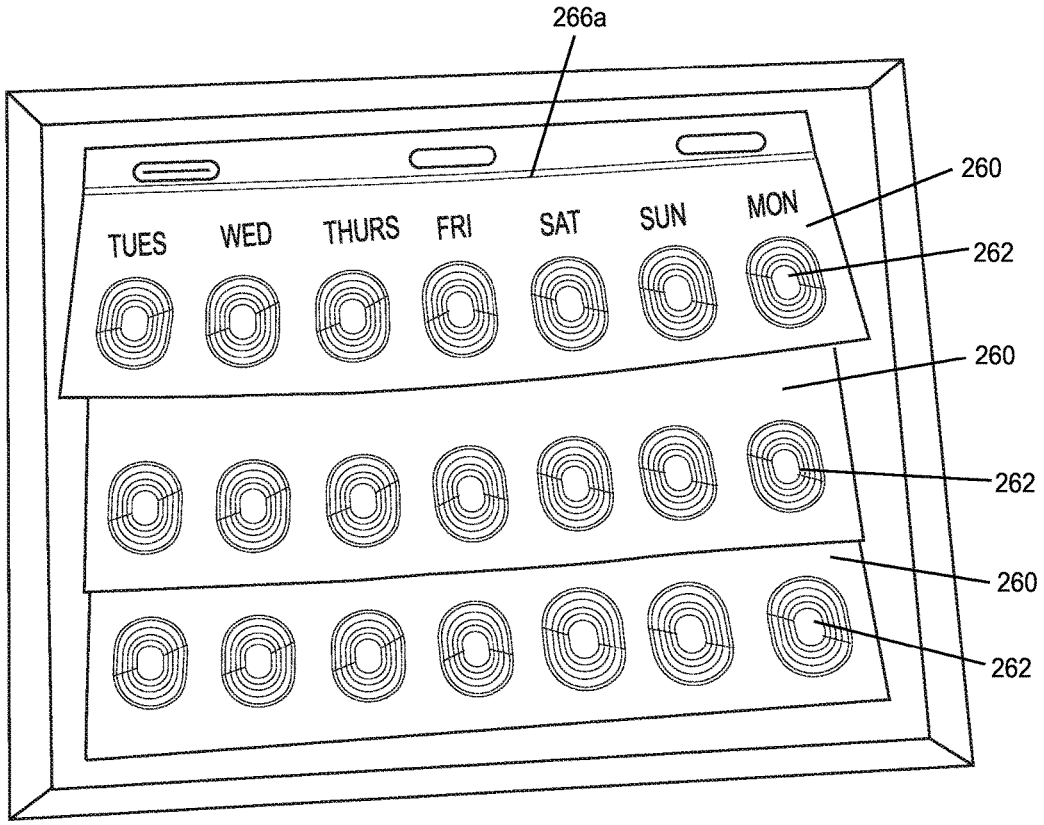
FIG. 25 is a perspective view of components of the system shown in FIG. 18.
Figure 26:
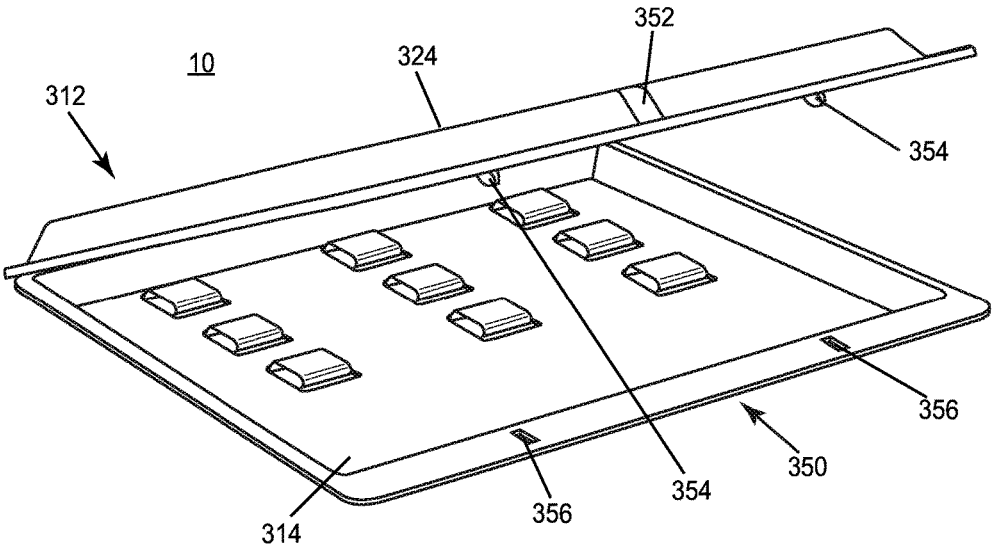
FIG. 26 is a perspective view of components of one embodiment of a system in accordance with the principles of the present disclosure.
Figure 27:
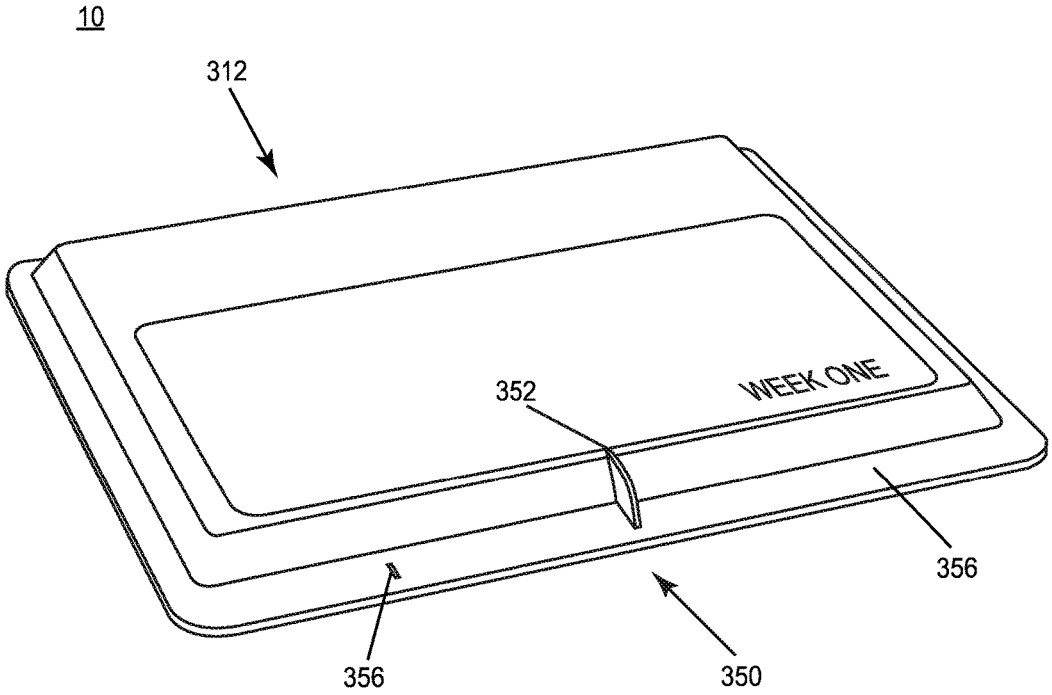
FIG. 27 is a perspective view of components of the system shown in FIG. 26.
Figure 28:
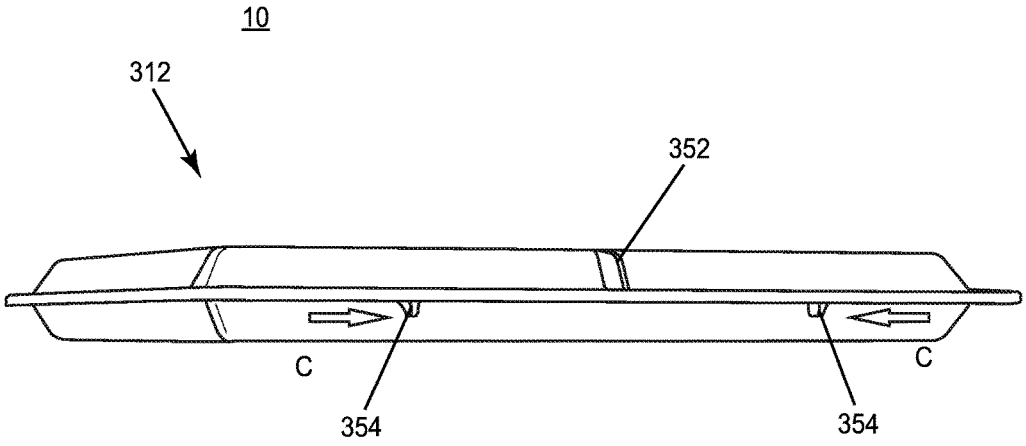
FIG. 28 is a side view of components of the system shown in FIG. 26.
Figure 29:
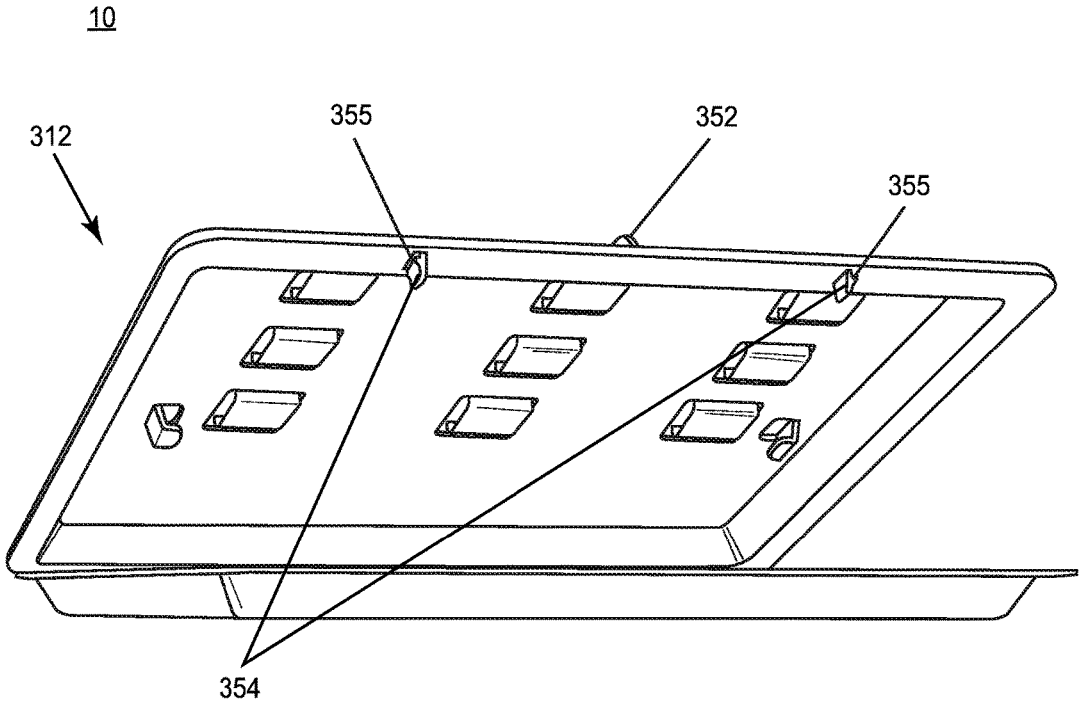
FIG. 29 is a perspective view of components of the system shown in FIG. 26.
Figure 30:
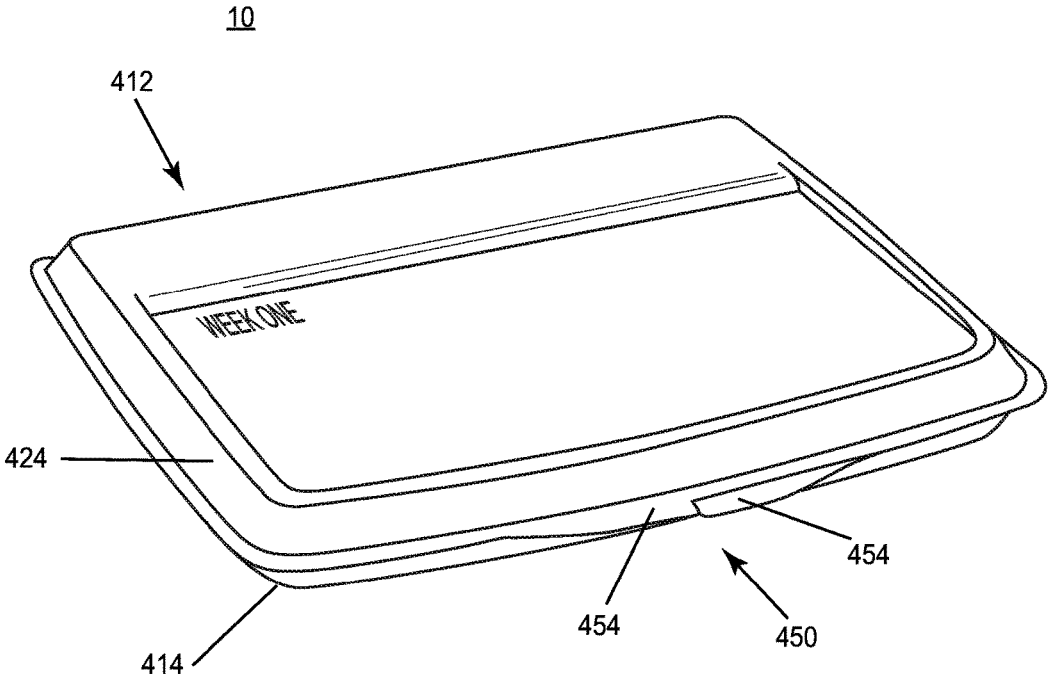
FIG. 30 is a perspective view of components of one embodiment of a system in accordance with the principles of the present disclosure.
Figure 31:
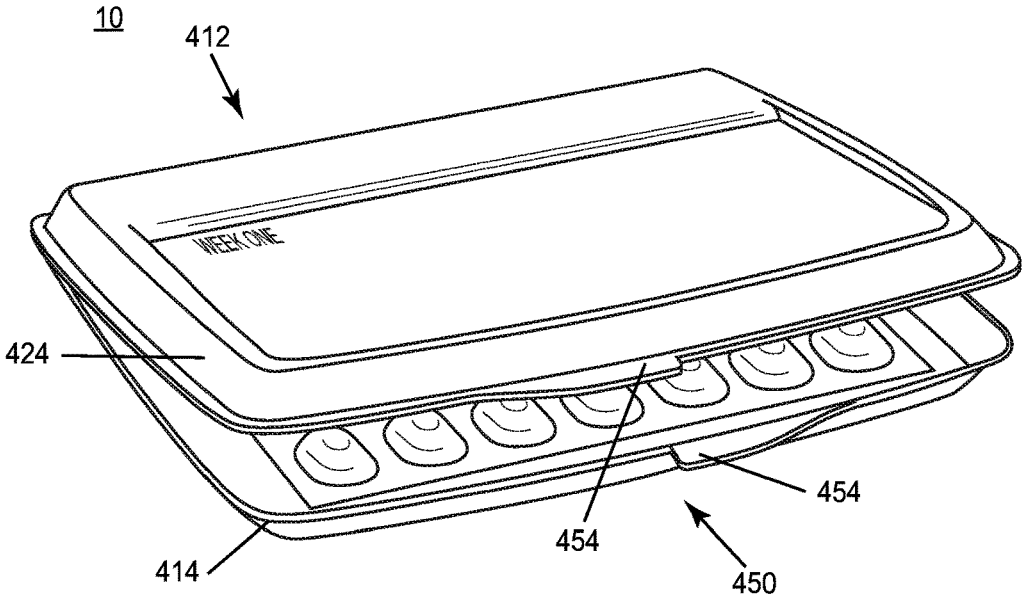
FIG. 31 is a perspective view of components of the system shown in FIG. 30.
Figure 32:
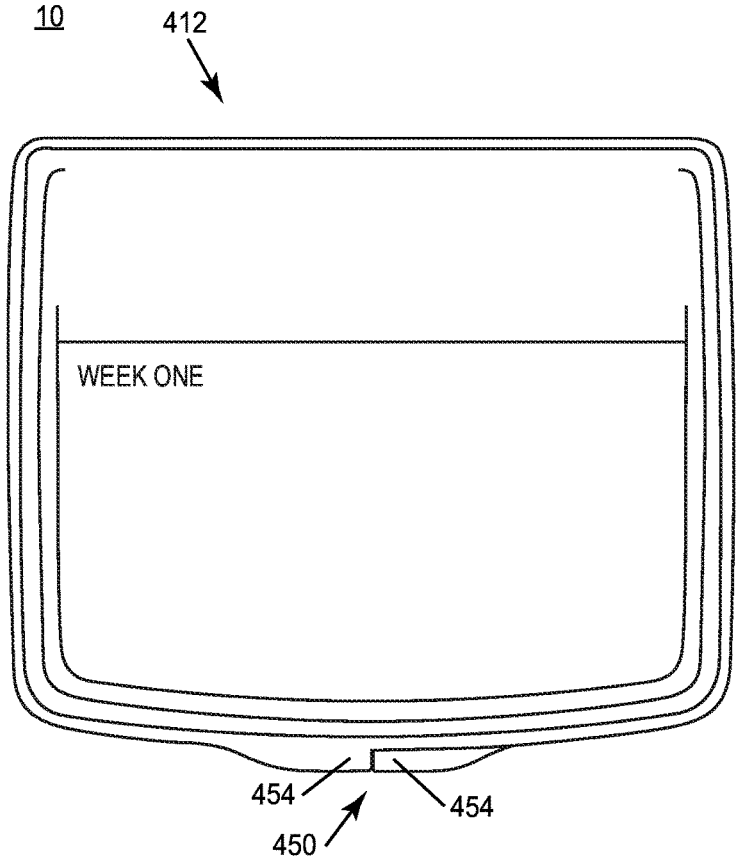
FIG. 32 is a side view of components of the system shown in FIG. 30.
Figure 33:
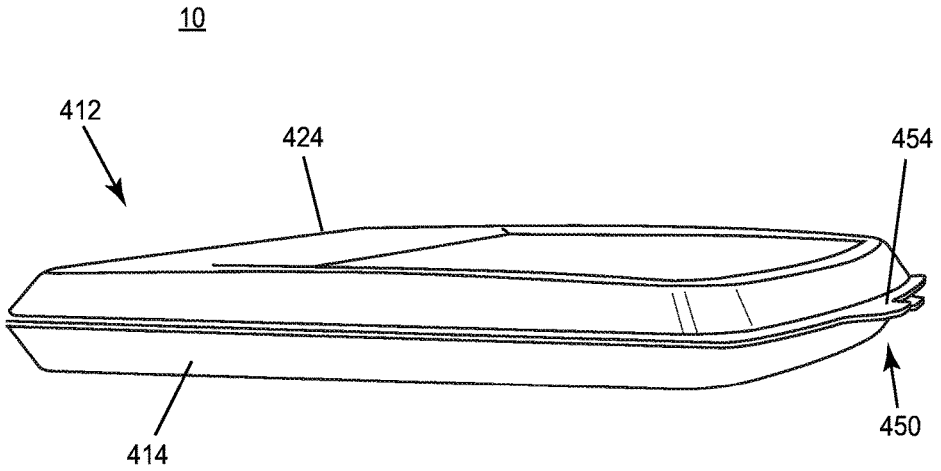
FIG. 33 is a perspective view of components of the system shown in FIG. 30.

In some embodiments, page 260 includes a folding line 266*a* on surface 261*a* and a folding line 266*b* on surface 261*b*. Line 266*a* provides an axis of rotation to allow surface 261*a* to be rotated to access the medicaments held within receptacles 262 of the surface 261*a*, as shown in FIG. 25, and/or to allow a user to view surface 261*b* and information contained on surface 261*b*, as shown in FIGS. 22 and 24. Line 266*b* provides an axis of rotation to allow surface 261*b* to be rotated to access a page 260 attached to container 212 and positioned adjacent to page 260. In some embodiments, similar to configurations of containers 12, 112, a first page 260 is held by a bottom row of fasteners 242 in container 212, and a second page 260 is held by a row of fasteners 242 above the bottom row such that the second page 260 is folded up to gain access to the first page 260. In some embodiments, a third page 260 is applied to a third row of fasteners 242 in a similar fashion. In some embodiments, as shown in FIG. 24, label 270 is applied to surface 261*b*. By rotating a second page 260 along folding lines 266*a*, 266*b*, a user can access a first page 260.

In one embodiment, as shown in FIGS. 26-29, medicament dispensing system 10, similar to the systems and methods as described herein, includes a medicament dispensing container 312. Medicament dispensing container 312 includes locking mechanism 350 comprising a latch 354, such as, for example, two latches 354, oppositely disposed on cover 324. Each latch 354 includes an engagement surface, such as, for example, a flange 355 configured to engage slots 356. Slots 356 are located on cover 314 and align with latches 354. Cover 324 is rotatable relative to cover 314 such that latches 354 are received in slots 356.

Container 312 is movable between an open or non-locked configuration, similar to that described herein, and a closed or locked configuration, similar to that described herein. When in the open configuration, latches 354 are disengaged from slots 356 such that cover 324 is freely rotatable relative to cover 314. When in the closed configuration, latches are snapped into slots 356 such that cover 324 is locked relative to cover 314. Latches 354 protrude from and are resiliently biased relative to cover 324. As container 312 is moved between the open configuration and the closed configuration, engagement of latches 354 with slots 356 cause latches 354 to bow and/or flex to fit into slots 356. To move container 312 from the closed configuration to the open configuration, a user presses latches 354, in the direction shown by arrows C in FIG. 28, and lifts cover 324 from cover 314 by gripping and pulling handle 352.

In some embodiments, locking mechanism 350 audibly clicks to indicate a locked position. In some embodiments, locking mechanism 350 is provided with instructions to aid a patient in use of container 312. In some embodiments, the instructions may be presented in the form of a graphic, such as, for example, an arrow with a lock, or text, such as, for example, "press to unlock". In some embodiments, the instructions may be printed on locking mechanism 350.

In one embodiment, as shown in FIGS. 30-33, medicament dispensing system 10, similar to the systems and methods described herein, includes a medicament dispensing container 412. Medicament dispensing container 412 includes locking mechanism 450 comprising interlocking clasps 454. The interlocking clasps 454 include a first clasp 454 disposed with cover 414 and a second clasp 454 disposed with cover 424. Container 412 is movable between an open or non-locked configuration, similar to that described herein, and a closed or locked configuration, similar to that described herein. The first clasp 454 is configured to be offset from the second clasp 454 to allow a user to grip each clasp 454 to pull covers 414, 424 apart when container 412 is in the closed configuration or push covers 414, 424 together when container 412 is in the open configuration. In some embodiments, clasps 454 include beveled surfaces that overlap one another. The overlap is sized to allow clasps 454 to lock into one another.

Figure 34:
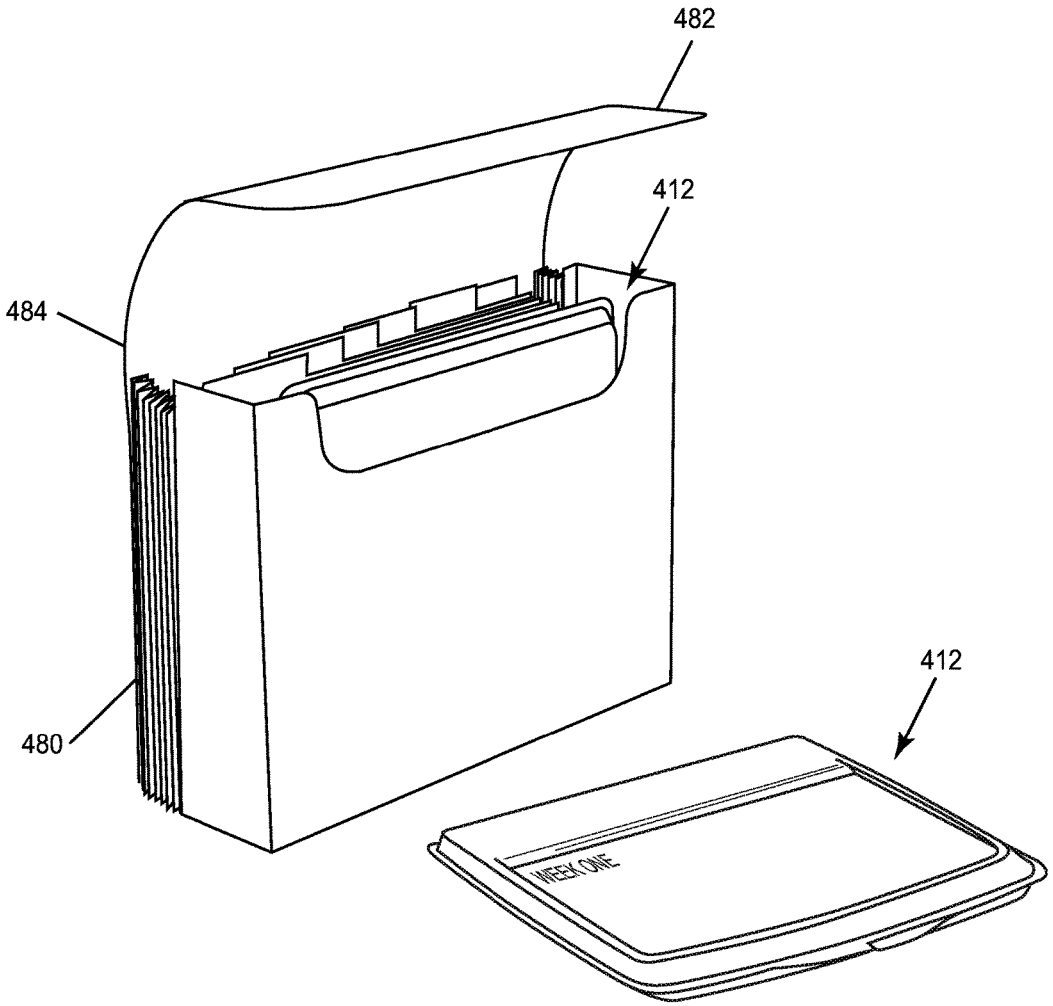
FIG. 34 is a perspective view of components of one embodiment of a system in accordance with the principles of the present disclosure.

In some embodiments, medicament dispensing container 412 includes a plurality of medicament dispensing containers 412, as shown in FIG. 34, configured for disposal with a receptacle, such as, for example, an organizer 480. Organizer 480 is divided into sections that include compartments separated by partitions. Each compartment includes a wall and an opening configured to receive a container 412. In some embodiments, each compartment is equally sized and configured. In some embodiments, one or more compartments is larger to store at least two medicament dispensing containers 412 in a top to bottom configuration to facilitate efficient storage of medicament dispensing containers, such as, for example, containers 412. In some embodiments, organizer 480 is configured for disposal of medicament dispensing containers 412 in a linear orientation. In some embodiments, organizer 480 is configured for disposal of containers 412 in a staggered, offset, row or column orientation.

In one embodiment, organizer 480 includes a folder flap 482 attached to organizer 480 at a connecting portion, such as, for example, a spine 484. Spine 484 is disposed such that flap 482 is pivotable relative to spine 484. Flap 482 is pivotable relative to organizer 480 between an open or non-locked configuration, such as, for example a medication accessible configuration, and a closed or locked configuration, similar to that described herein.

Figure 35:
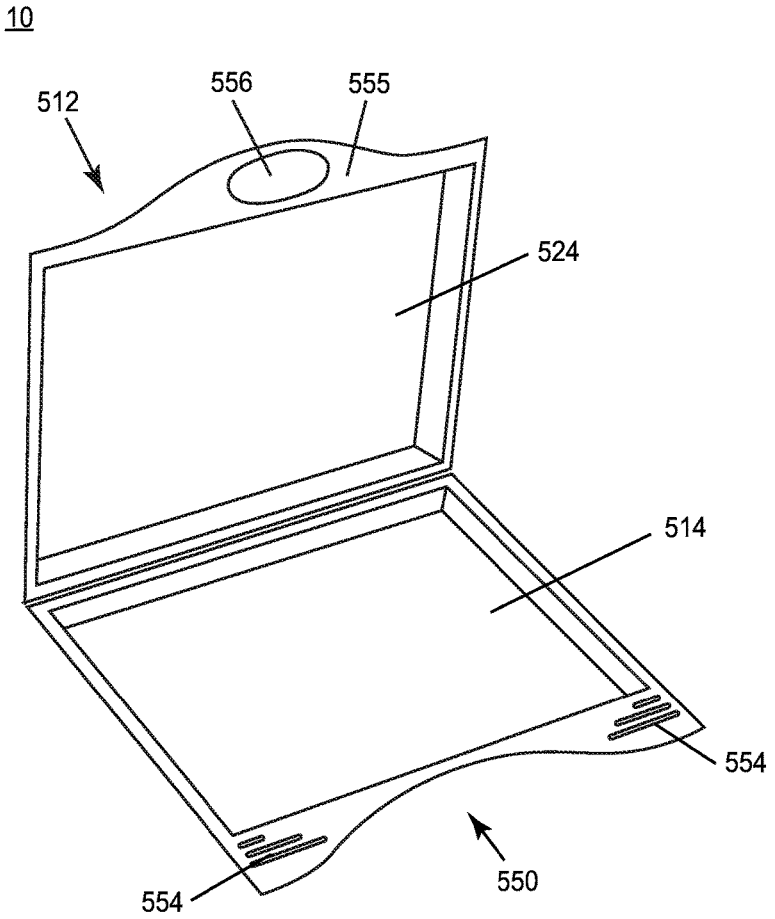
FIG. 35 is a perspective view of components of one embodiment of a system in accordance with the principles of the present disclosure.
Figure 36:
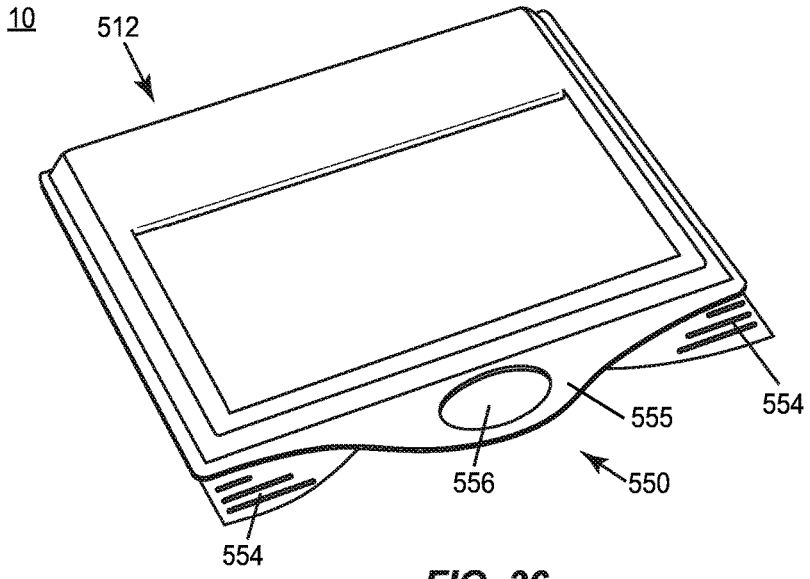
FIG. 36 is a perspective view of components of the system shown in FIG. 35.
Figure 37:
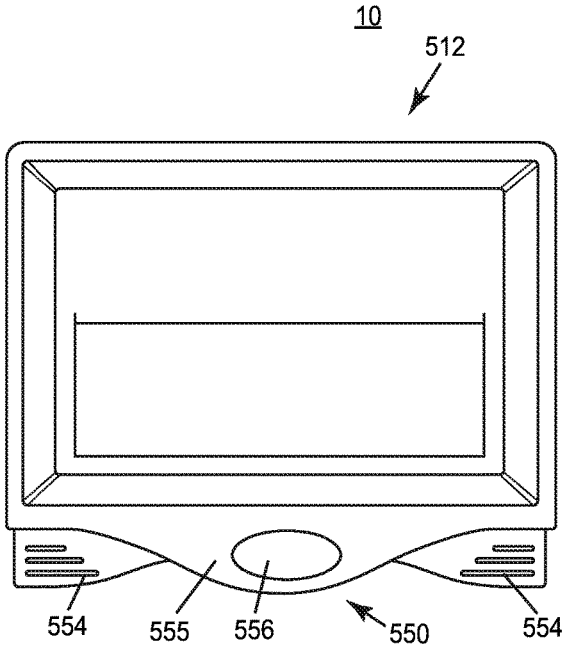
FIG. 37 is a top view of components of the system shown in FIG. 35.

In one embodiment, as shown in FIGS. 35-37, medicament dispensing system 10, similar to the systems and methods as described herein, includes a medicament dispensing container 512. In some embodiments, medicament dispensing container 512 includes a locking mechanism 550, similar to the locking features as described herein. For example, in some embodiments, locking mechanism 550 includes interlocking tabs comprising a pair of oppositely arranged tabs 554 disposed with cover 514 and a centrally disposed tab 555 disposed with cover 524. Container 512 is movable between an open or non-locked configuration, similar to that described herein, and a closed or locked configuration, similar to that described herein. Tab 555 is configured to be aligned between tabs 554 to allow a user to leverage tab 555 against tabs 554 to pull covers 514, 524 apart when container 512 is in the closed configuration or push covers 514, 524 together when container 512 is in the open configuration. In some embodiments, tab 555 includes a central window 556 to facilitate a user's grip of tab 555. In some embodiments, tabs 554, 555 include rounded surfaces to provide ergonomic design and increase comfort for a user. In some embodiments, tabs 554, 555 include ridged surfaces to enhance a user's grip. In some embodiments, locking mechanism 550 includes covers 514, 524 being resiliently biased to a closed configuration via a spring or other biasing member, for example, disposed along the spine of medicament dispensing container 512.

Figure 38:
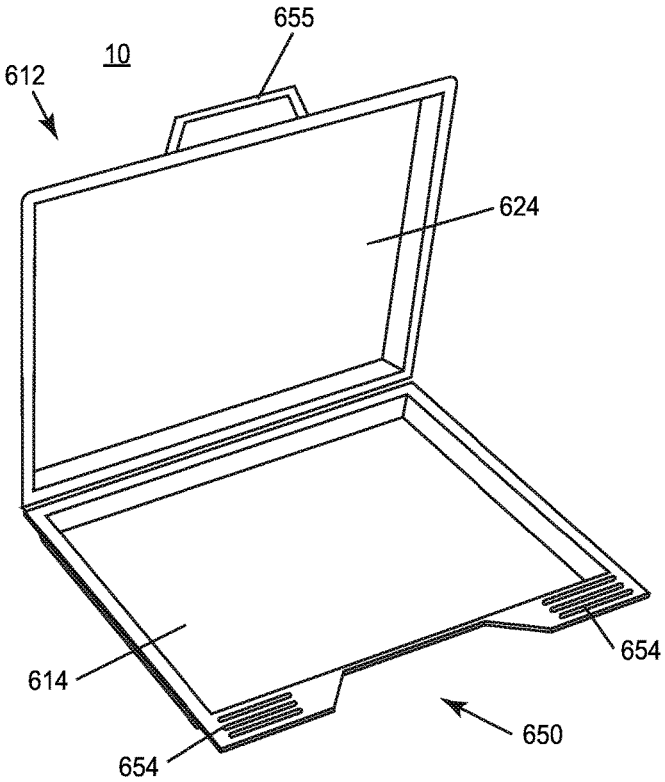
FIG. 38 is a perspective view of components of one embodiment of a system in accordance with the principles of the present disclosure.
Figure 39:
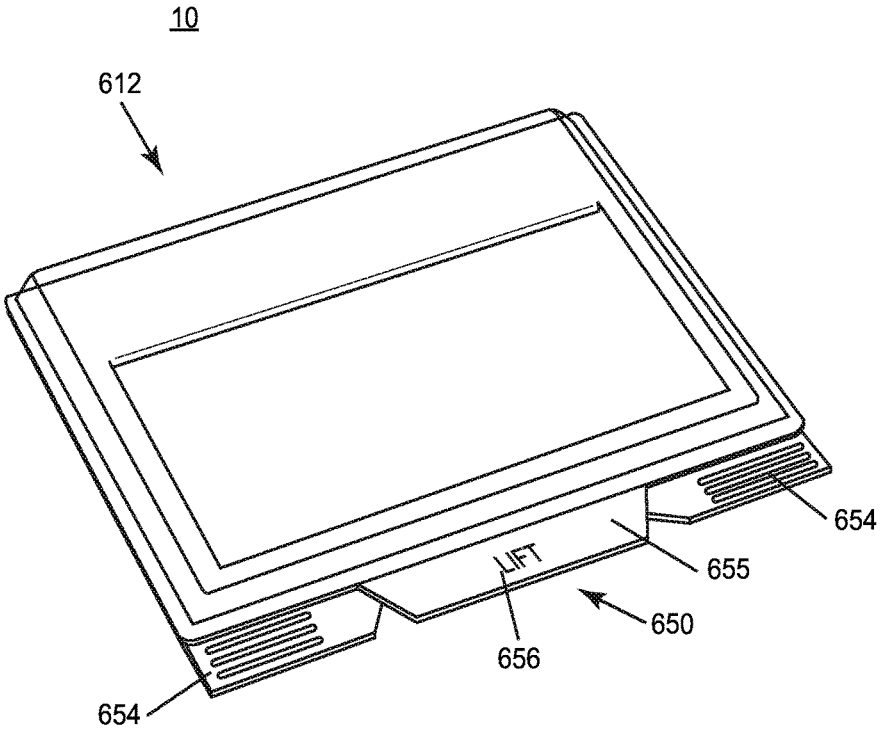
FIG. 39 is a perspective view of components of the system shown in FIG. 38.
Figure 40:
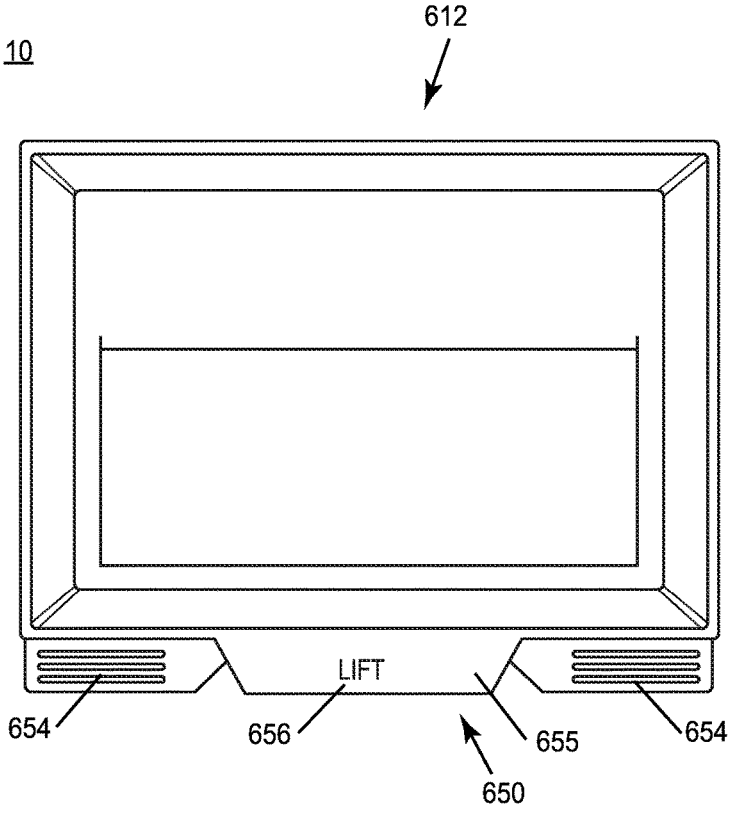
FIG. 40 is a top view of components of the system shown in FIG. 38.

In one embodiment, as shown in FIGS. 38-40, medicament dispensing system 10, similar to the systems and methods as described herein, includes a medicament dispensing container 612. Medicament dispensing container 612 includes locking mechanism 650, similar to the locking features as described herein. For example, in some embodiments, locking mechanism 650 includes interlocking tabs comprising a pair of oppositely arranged tabs 654 disposed with cover 614 and a centrally disposed tab 655 disposed with cover 624. Container 612 is movable between an open or non-locked configuration, similar to that described herein, and a closed or locked configuration, similar to that described herein. Tab 655 is configured to be aligned between tabs 654 to allow a user to leverage tab 655 against tabs 654 to pull covers 614, 624 apart when container 612 is in the closed configuration or push covers 614, 624 together when container 612 is in the open configuration. In some embodiments, tab 655 includes indicia 656 to provide instructions for use of container 612. In some embodiments, tabs 654, 655 include surfaces which provide maximum surface area for gripping by a user. In some embodiments, tabs 654, 655 include ridged surfaces to enhance a user's grip. In some embodiments, locking mechanism 650 includes covers 614, 624 being resiliently biased to a closed configuration via a spring or other biasing member, for example, disposed along the spine of medicament dispensing container 612.

Figure 41:
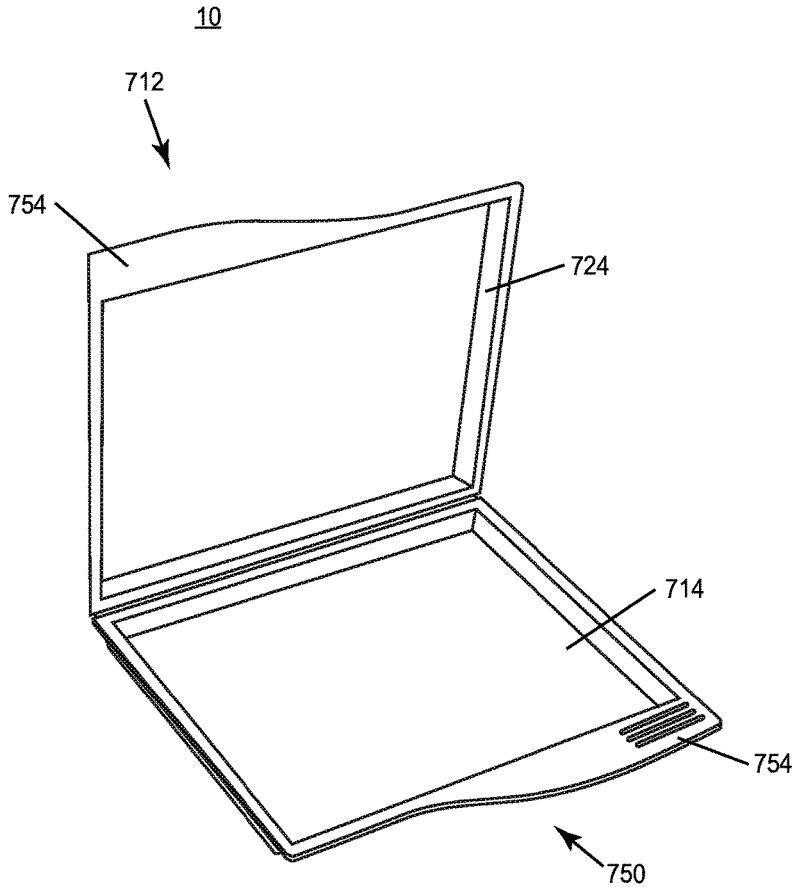
FIG. 41 is a perspective view of components of one embodiment of a system in accordance with the principles of the present disclosure.
Figure 42:
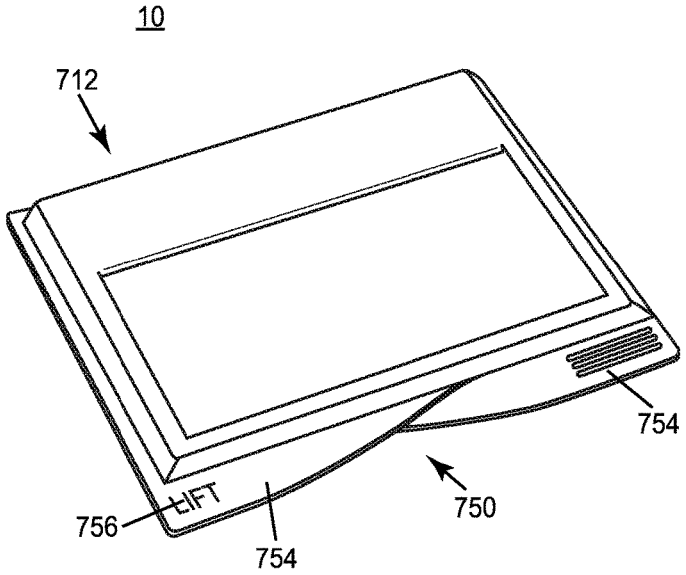
FIG. 42 is a perspective view of components of the system shown in FIG. 41.
Figure 43:
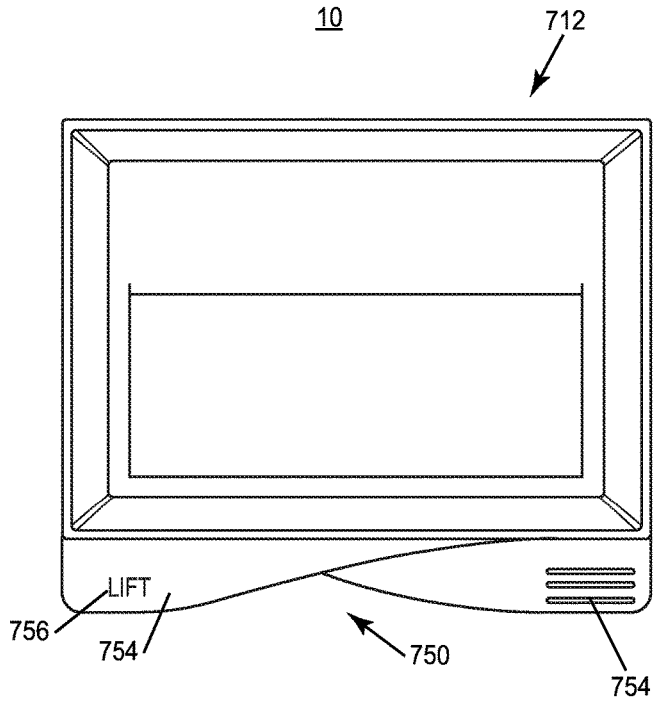
FIG. 43 is a top view of components of the system shown in FIG. 41.
Figure 44:
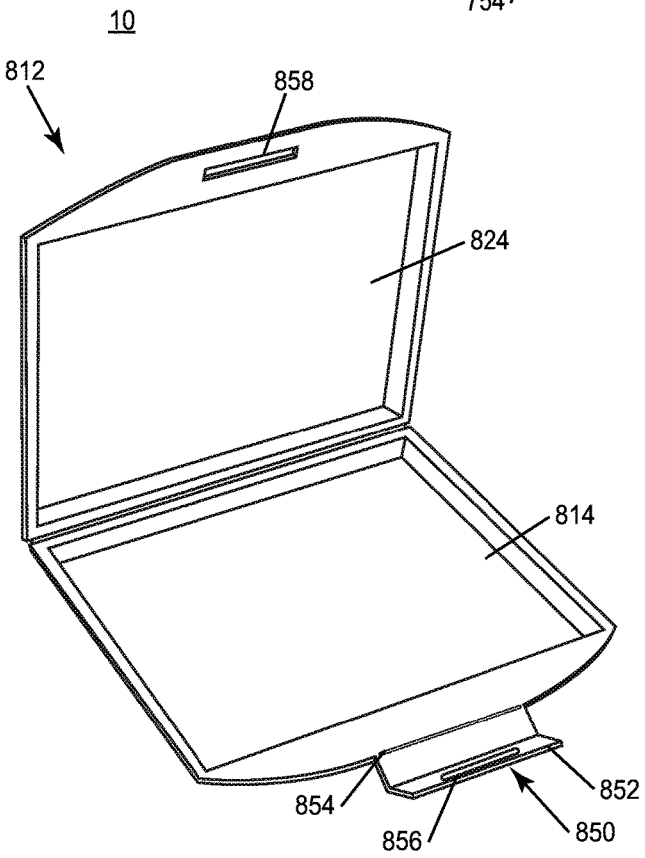
FIG. 44 is a perspective view of components of one embodiment of a system in accordance with the principles of the present disclosure.
Figure 45:
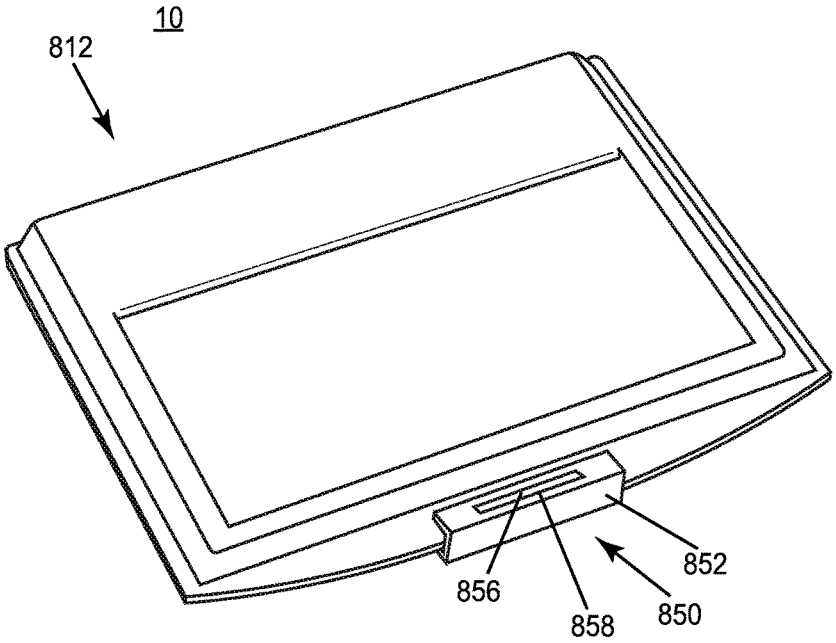
FIG. 45 is a perspective view of components of the system shown in FIG. 44.
Figure 46:
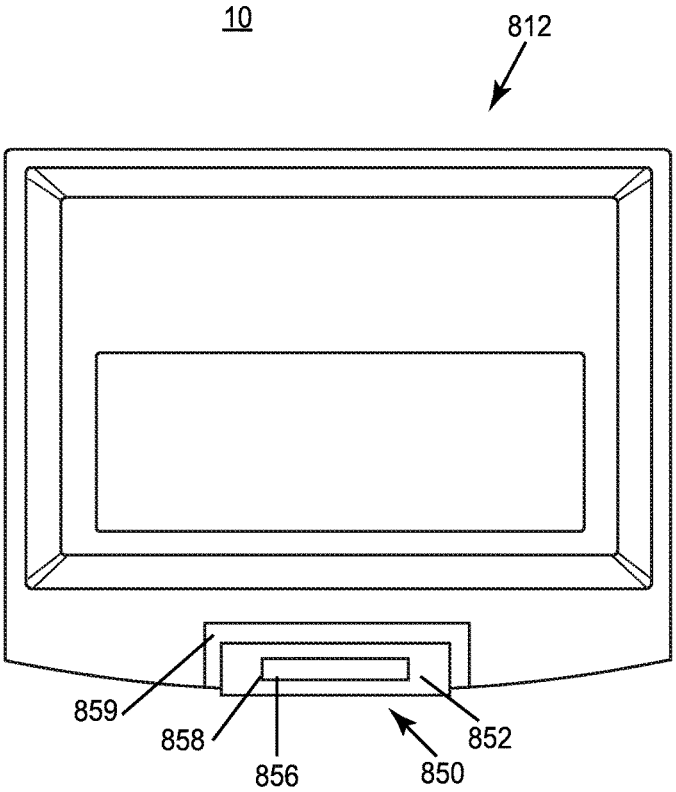
FIG. 46 is a top view of components of the system shown in FIG. 44.
Figure 47:
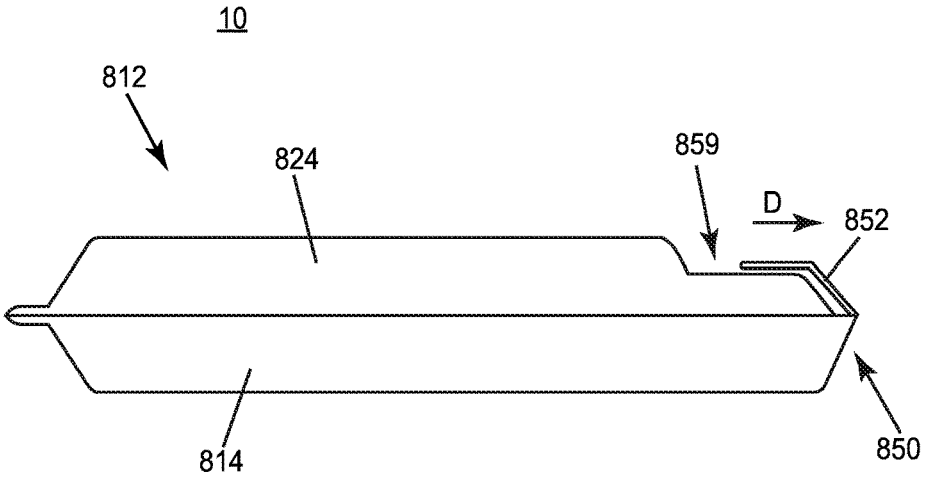
FIG. 47 is a side view of components of the system shown in FIG. 44.
Figure 48:
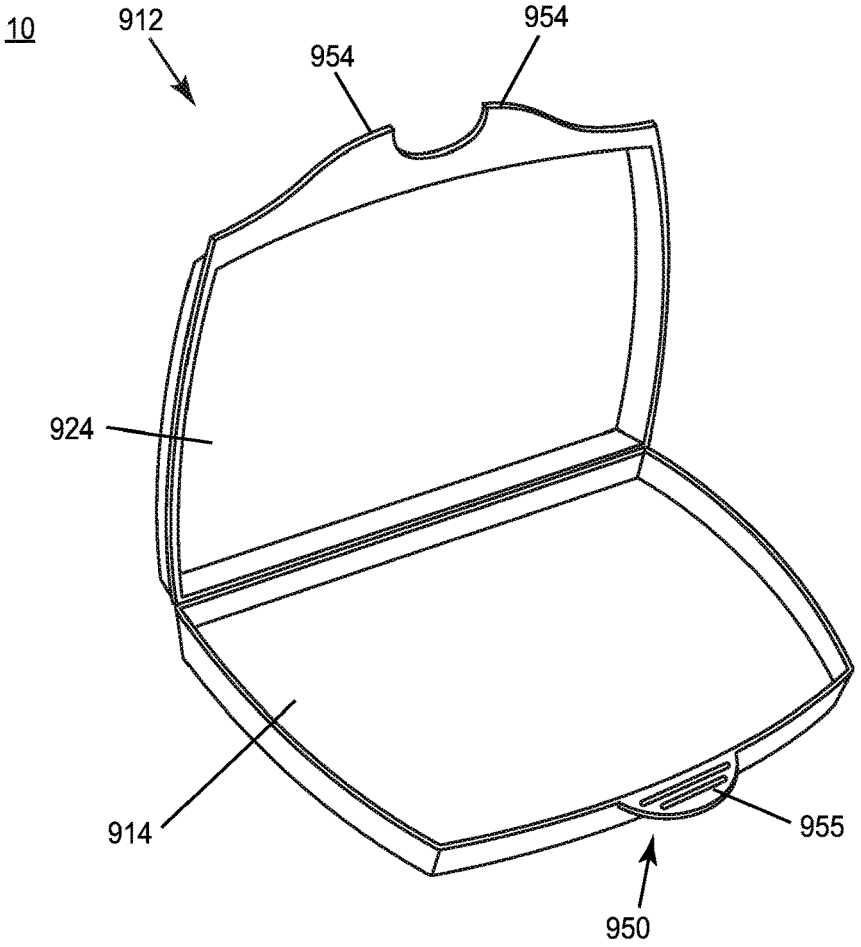
FIG. 48 is a perspective view of components of one embodiment of a system in accordance with the principles of the present disclosure.
Figure 49:
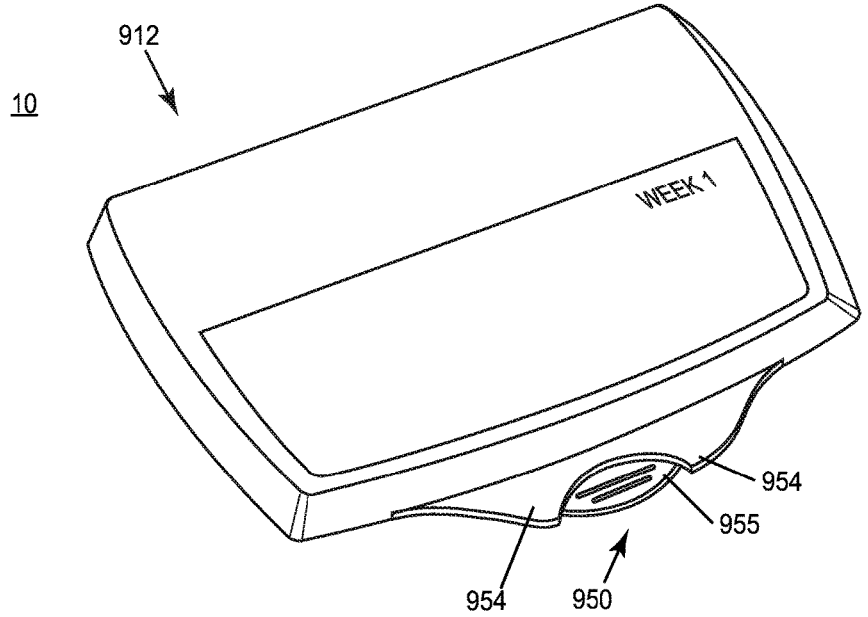
FIG. 49 is a perspective view of components of the system shown in FIG. 48.
Figure 50:
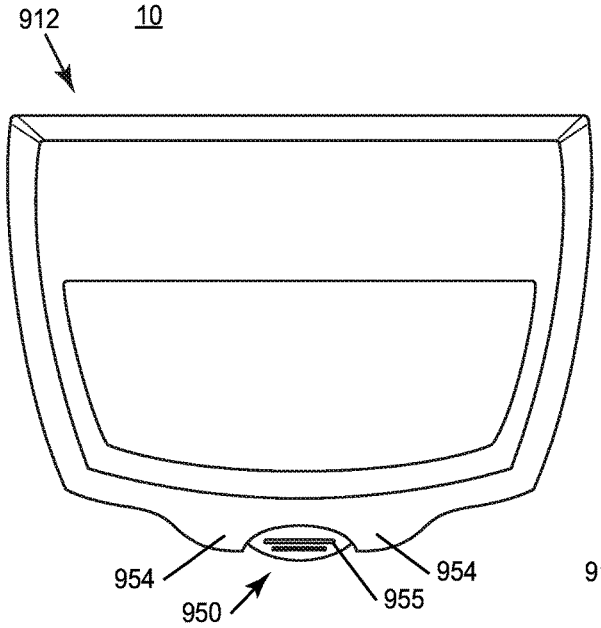
FIG. 50 is a top view of components of the system shown in FIG. 48.
Figure 51:
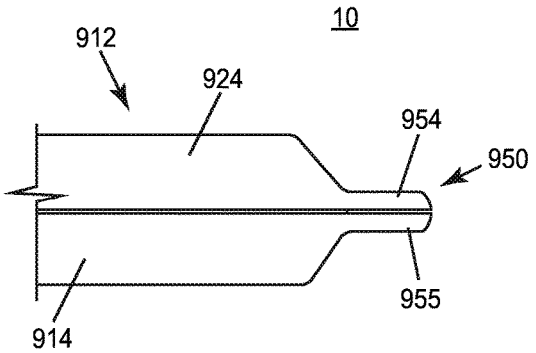
FIG. 51 is a side view of components of the system shown in FIG. 48.

In one embodiment, as shown in FIGS. 41-43, medicament dispensing system 10, similar to the systems and methods as described herein, includes a medicament dispensing container 712. Medicament dispensing container 712 includes locking mechanism 750, similar to the locking features as described herein. For example, in some embodiments, locking mechanism 750 includes interlocking tabs comprising a first tab 754 disposed with cover 714 and a second tab 754 disposed with cover 724. Container 712 is movable between an open or non-locked configuration, similar to that described herein, and a closed or locked configuration, similar to that described herein. The first tab 754 is configured to be offset from the second tab 754 to allow a user to grip each tab 754 to pull covers 714, 724 apart when container 712 is in the closed configuration or push covers 714, 724 together when container 712 is in the open configuration. In some embodiments, tabs 754 include rounded surfaces to provide ergonomic design and increase comfort for a user. In some embodiments, tabs 754 include ridged surfaces to enhance a user's grip. In some embodiments, locking mechanism 750 includes covers 714, 724 being resiliently biased to a closed configuration via a spring or other biasing member, for example, disposed along the spine of medicament dispensing container 712.

In one embodiment, as shown in FIGS. 44-47, medicament dispensing system 10, similar to the systems and methods as described herein, includes a medicament dispensing container 812. Medicament dispensing container 812 includes locking mechanism 850 comprising a rotatable tab 852. Tab 852 is attached to cover 814 via hinge 854. Hinge 854 provides an axis of rotation for tab 852. Tab 852 includes an aperture 856 configured to receive a locking protrusion 858 disposed with cover 824. Container 812 is movable between an open or non-locked configuration, similar to that described herein, and a closed or locked configuration, similar to that described herein. Tab 852 is rotated to the open configuration away from cover 814, in a direction shown by arrow D in FIG. 47, to disengage from locking protrusion 858 such that cover 824 is freely rotatable relative cover 814. In the closed configuration, tab 852 is rotated to align with protrusion 858. Tab 852 is pressed into protrusion 858 to snap protrusion 858 into aperture 856 such that cover 824 is locked relative to cover 814. To move container 812 from the closed configuration to the open configuration, a user fits a finger into finger space 859 and pulls tab 852, in the direction indicated by arrow D, to separate protrusion 858 from aperture 856.

In one embodiment, as shown in FIGS. 48-51, medicament dispensing system 10, similar to the systems and methods as described herein, includes a medicament dispensing container 912. Medicament dispensing container 912 includes locking mechanism 950, similar to the locking features as described herein. For example, in some embodiments, locking mechanism 950 includes interlocking tabs comprising a pair of spaced apart tabs 954 disposed with cover 924 and a centrally disposed tab 955 disposed with cover 914. Container 912 is movable between an open or non-locked configuration, similar to that described herein, and a closed or locked configuration, similar to that described herein. Tab 955 is configured to be aligned between tabs 954 to allow a user to leverage tab 955 against tabs 954 to pull covers 914, 924 apart when container 912 is in the closed configuration or push covers 914, 924 together when container 912 is in the open configuration. In some embodiments, tabs 954, 955 include rounded surfaces to provide ergonomic design and increase comfort for a user. In some embodiments, tabs 954, 955 include ridged surfaces to enhance a user's grip. In some embodiments, tabs 954 include a greater thickness than tab 955. In some embodiments, locking mechanism 950 includes covers 914, 924 being resiliently biased to a closed configuration via a spring or other biasing member, for example, disposed along the spine of medicament dispensing container 912.

Figure 52:
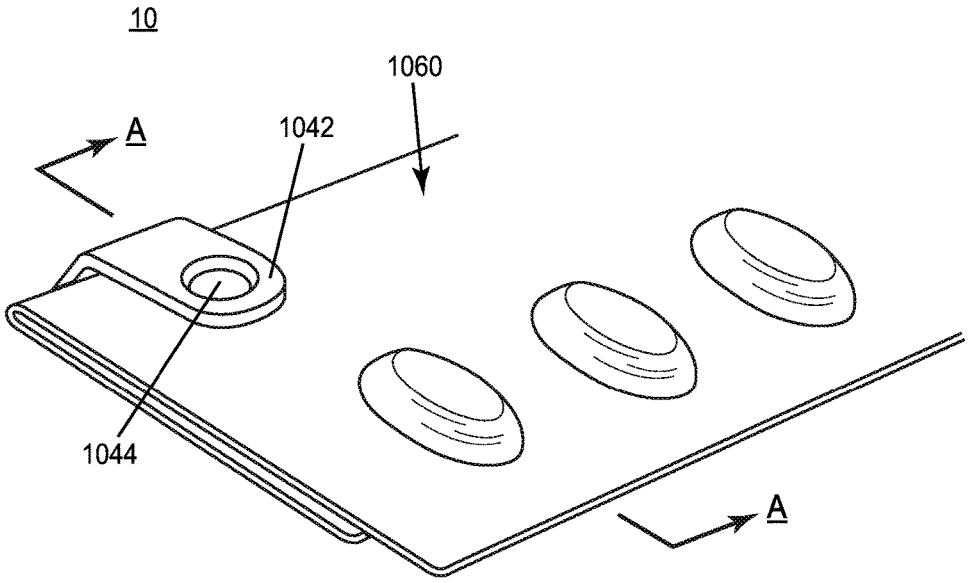
FIG. 52 is a perspective view of components of one embodiment of a system in accordance with the principles of the present disclosure.
Figure 53:
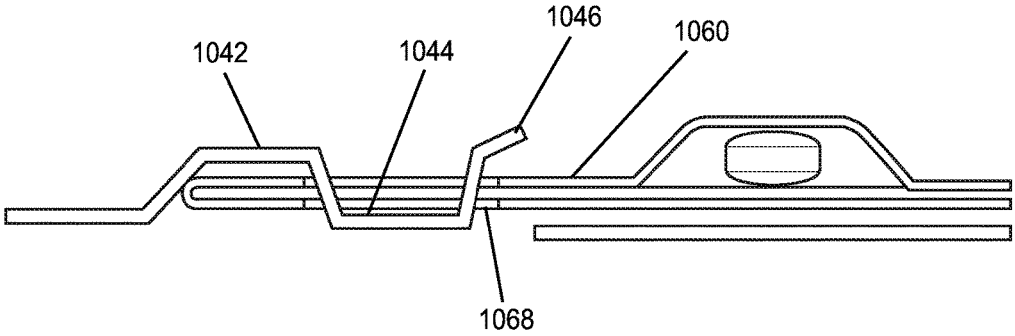
FIG. 53 is a side view of components of the system shown in FIG. 52 along cross section AA.

In one embodiment, as shown in FIGS. 52-53, medicament dispensing system 10, similar to the systems and methods as described herein, includes a medication container including a fastener 1042. Fastener 1042 includes a depression 1044 configured to engage a complementary opening 1068 of a unit dose page 1060. In some embodiments, depression 1044 includes a circumferential surface and a flat bottom surface to abut a cover of the medication container. Depression 1044 is configured to be disposed within openings 1068 to hold page 1060 in place. In some embodiments, fastener 1042 includes a tag 1046 configured to allow a user to pull fastener 1042 away from page 1060 to free a page 1060 and/or insert another page 1060. In some embodiments, tag 1046 is removable from fastener 1042 to prevent page 1060 from being removed from fastener 1042.

Figure 54:
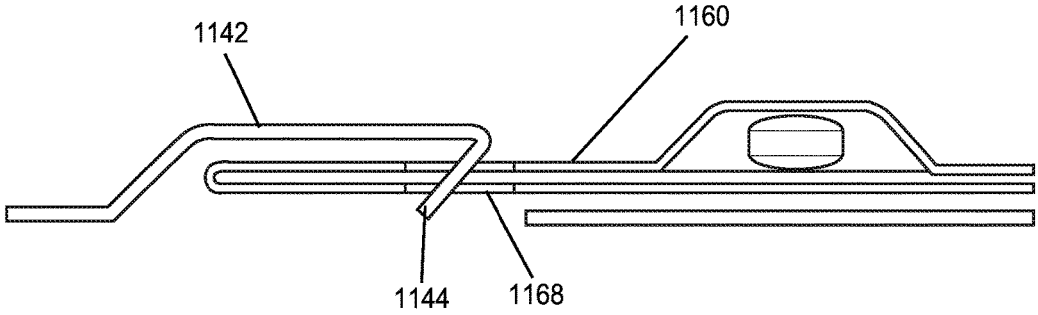
FIG. 54 is a perspective view of components of one embodiment of a system in accordance with the principles of the present disclosure.

In one embodiment, as shown in FIG. 54, medicament dispensing system 10, similar to the systems and methods as described herein, includes a medication container including a fastener 1142. Fastener 1142 includes a hook 1144 configured to engage a complementary opening 1168 of a unit dose page 1160. In some embodiments, hook 1144 includes a surface to abut a cover of the medication container. Hook 1144 is configured to be disposed within openings 1168 to hold page 1160 in place.

Figure 55:
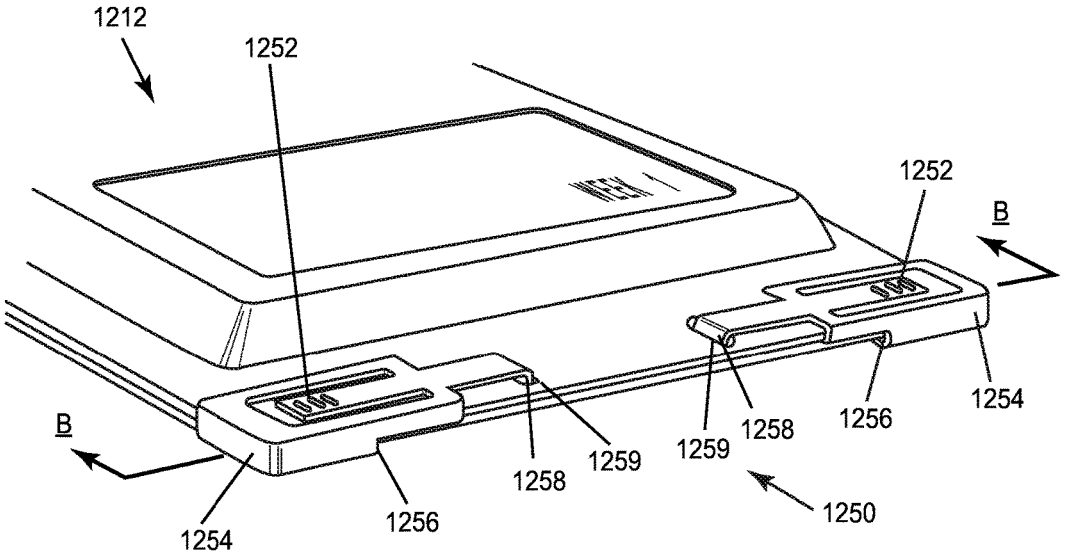
FIG. 55 is a perspective view of components of one embodiment of a system in accordance with the principles of the present disclosure.
Figure 56:
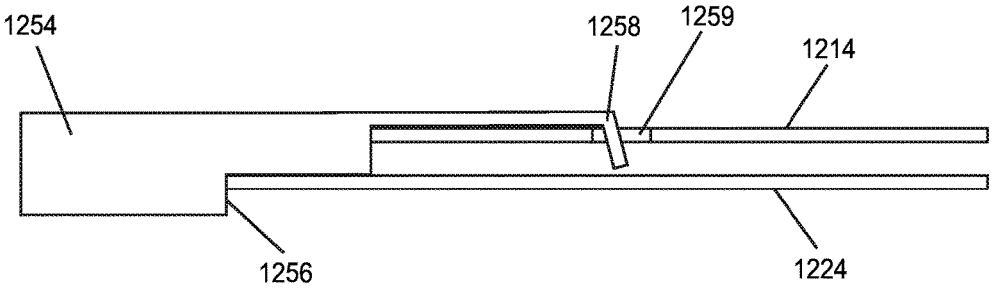
FIG. 56 is a breakaway side view of components of the system shown in FIG. 55 along cross section BB.
Figure 57:
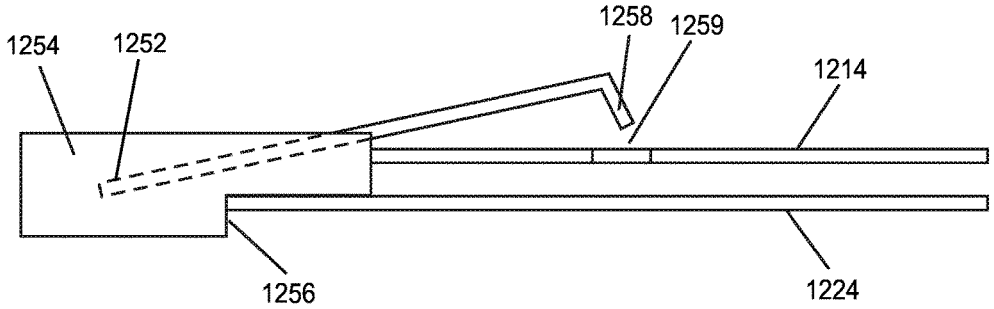
FIG. 57 is a breakaway side view of components of the system shown in FIG. 55 along cross section BB.

In one embodiment, as shown in FIGS. 55-57, medicament dispensing system 10, similar to the systems and methods as described herein, includes a medicament dispensing container 1212. Medicament dispensing container 1212 includes locking mechanism 1250 comprising slides 1254, oppositely disposed on container 1212. Each slide 1254 includes a male engagement portion, such as for example, a flange 1256 configured to engage cover 1224. Slides 1254 are translatable along the sides of container 1212 to move container 1212 between an open configuration, similar to that described herein, and a closed configuration, similar to that described herein.

Slides 1254 are lockable in the closed configuration, as shown in FIG. 56. Slide 1254 includes a catch 1258 corresponding with an opening 1259 in the surface of cover 1214. Catch 1258 is rotatable relative to slide 1254 to allow slide 1258 to disengage from opening 1259. Catch 1258 is movable between a non-locked configuration, similar to that described herein, and a locked configuration, similar to that described herein. When in the locked configuration, catch 1258 is received in opening 1259 such that translation of slide 1254 is resisted and/or prevented. When in the non-locked configuration, a user presses push surface 1252 to release catch 1258 from opening 1259 and slides 1254 are translatable to move container 1212 to the open configuration.

In one embodiment, as shown in FIGS. 58-65, medicament dispensing system 10, similar to the systems and methods as described herein, includes a housing, such as, for example, a pocket and/or sleeve 1312 having a generally rectangular cross-sectional shape. Sleeve 1312 includes a top face 1314, a bottom face 1316 and sidewalls 1318. In one embodiment, top face 1314 and bottom face 1316 have rectangular shapes. Sleeve 1312 includes a surface that defines an inner cavity 1320. Inner cavity 1320 includes a passageway configured to receive a medication container, such as, for example, a scroll container 1332, as discussed herein. Sleeve 1312 includes an opening 1321 disposed between top face 1314 and bottom face 1316 configured to provide access to inner cavity 1320. In some embodiments, all or only a portion of sleeve 1312, top face 1314 and/or bottom face 1316 may have alternate cross section configurations, such as, for example, oval, oblong triangular, square, polygonal, irregular, uniform, non-uniform, offset, staggered, and/or tapered.

Scroll container 1332 is configured for disposal within inner cavity 1320, as described herein. Scroll container 1332 is attached with sleeve 1312 by a fixation member, such as, for example, a tether 1333. Tether 1333 is configured such that scroll container 1332 is drawn from sleeve 1312 but not detachable from sleeve 1312. In some embodiments, scroll container 1332 is attached to an inner surface of a sidewall 1318 positioned opposite the opening to inner cavity 1320. In some embodiments, scroll container 1332 is attached to an inner surface of top face 1314 or bottom face 1316 adjacent the opening to inner cavity 1320. Tether 1333 may be made from a material similar to that of sleeve 1312 and/or scroll container 1332, such as, for example, card stock that is adhered to an inner surface of sleeve 1312 with an adhesive material. In some embodiments, tether 1333 may comprise a material that is different from that of sleeve 1312 and scroll container 1332, such as, for example, a fabric or a polymer composite, such as nylon.

Tether 1333 is configured to provide a range of motion for movement of scroll container 1332 relative to sleeve 1312. In some embodiments, scroll container 1332 is pivotable about tether 1333 in an angular range of 0 to 360 degrees. In some embodiments, tether 1333 is configured to provide movement of scroll container 1332 within a predetermined distance from sleeve 1312 to allow scroll container 1332 to be unrolled.

Figure 58:
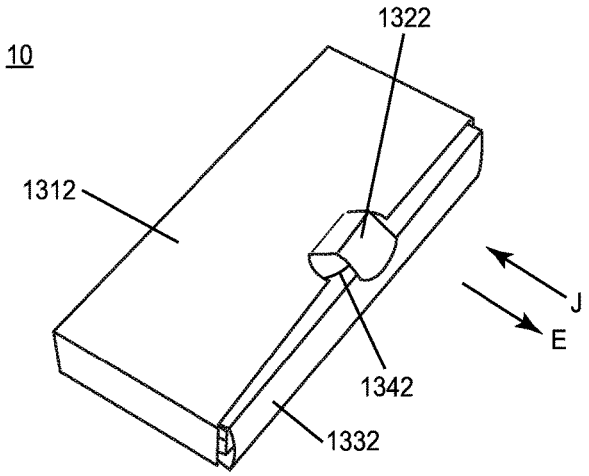
FIG. 58 is a perspective view of components of one embodiment of a system in accordance with the principles of the present disclosure.

In some embodiments, indicia is provided on sleeve 1312 to provide instructions to aid a user in removing scroll container 1332 from sleeve 1312. In some embodiments, the indicia are positioned on a surface of scroll container 1332 visible from an opening in sleeve 1312. For example, the indicia may be in the form of instructive text such as "pull here" that may be printed onto the surface of scroll container 1332. As shown in FIG. 58, scroll container 1332 is translated out of inner cavity 1320, in a direction indicated by arrow E, to display the contents of scroll container 1332, as described herein.

In some embodiments, medicament dispensing system 10 is movable between a locked configuration, similar to that described herein, and a non-locked configuration, similar to that described herein. In some embodiments, sleeve 1312 includes a tab 1322 positioned at an edge of sleeve 1312 adjacent to inner cavity 1320. Tab 1322 is configured for disposal in a corresponding slot 1342 of scroll container 1332 accessible when scroll container 1332 is position within inner cavity 1320. Tab 1322 is rotatable relative to sleeve 1312 through an angular range of 0 through about 360 degrees. In some embodiments, tab 1322 is shaped to facilitate engagement with corresponding slot 1342. In some embodiments, tab 1322 is generally rectangular and may have a curved front edge to make engagement and disengagement with slot 1342 easier for a user. In some embodiments, tab 1322 may include alternate configurations, such as, for example, oval, oblong, triangular, rectangular, square, polygonal, irregular, uniform, non-uniform, variable, tubular and/or tapered. Tab 1322 is oriented on sleeve 1312 such that upon rotation of tab 1322 into the locked configuration, tab 1322 slides into corresponding slot 1342 to move from the non-locked configuration to the locked configuration. In some embodiments, instructive indicia are positioned adjacent tab 1322 to aid a user in moving medicament dispensing system 10 from the locked to the non-locked configuration. In some embodiments, the indicia are positioned on tab 1322. In some embodiments, the indicia are positioned on a surface of sleeve 1312 and/or scroll container 1332 adjacent tab 1322. In some embodiments, the indicia may be marked by an arrow indicating the direction of necessary movement to move tab 1322. In some embodiments, instructive text such as "lift here" may be printed on or adjacent to tab 1322 to indicate the direction of necessary movement to move tab 1322.

Figure 61:
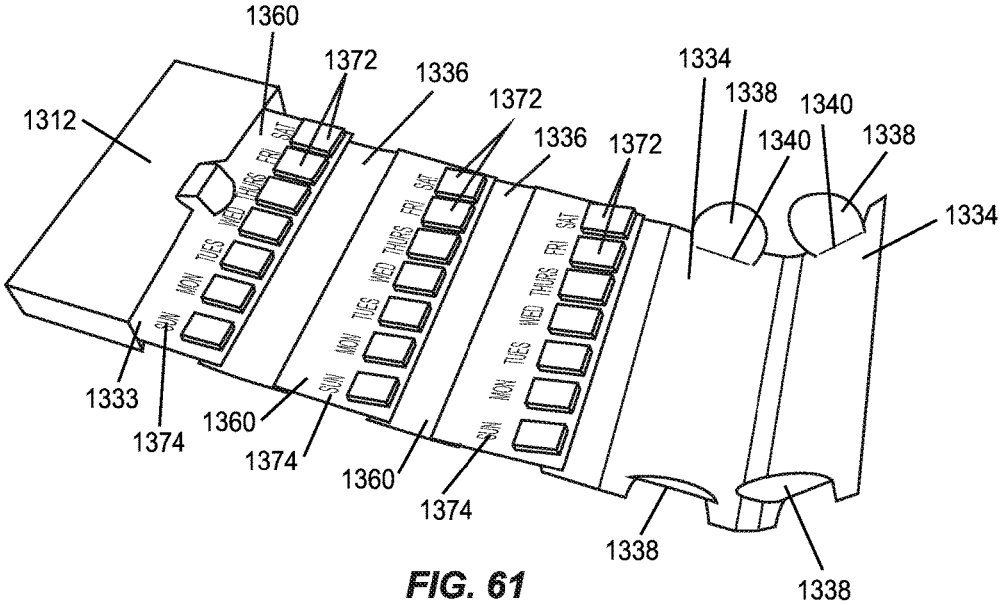
FIG. 61 is a perspective view of components of the system shown in FIG. 58.

In some embodiments, scroll container 1332 comprises a plurality of medication card portions 1334 and spine portions 1336 in an alternating pattern. Medication card portions 1334 are sized to receive medication cards 1360, as discussed herein. When fully unrolled, scroll container 1332 extends from opening 1321 of sleeve 1312 to an end 1344 with spine portions 1336 being positioned between medication cards 1360. In various embodiments, medication card portions 1334 are wider than spine portions 1336. Portions 1334, 1336 are sized to allow rolling of scroll container 1332, as shown in FIG. 61. In some embodiments, adjacent spine portions 1336 include varying lengths to accommodate extension of a plurality of unit dose pages, such as, for example, medication cards 1360. In some embodiments, as shown in FIG. 61, spine portions 1336 are narrower toward end 1344, such that first spine portion 1336 includes a width configured to accommodate two medication cards when extended, second spine portion 1336 includes a width configured to accommodate three medication cards when extended, third spine portion 1336 includes a width configured to accommodate four medication cards when extended.

Figure 62:
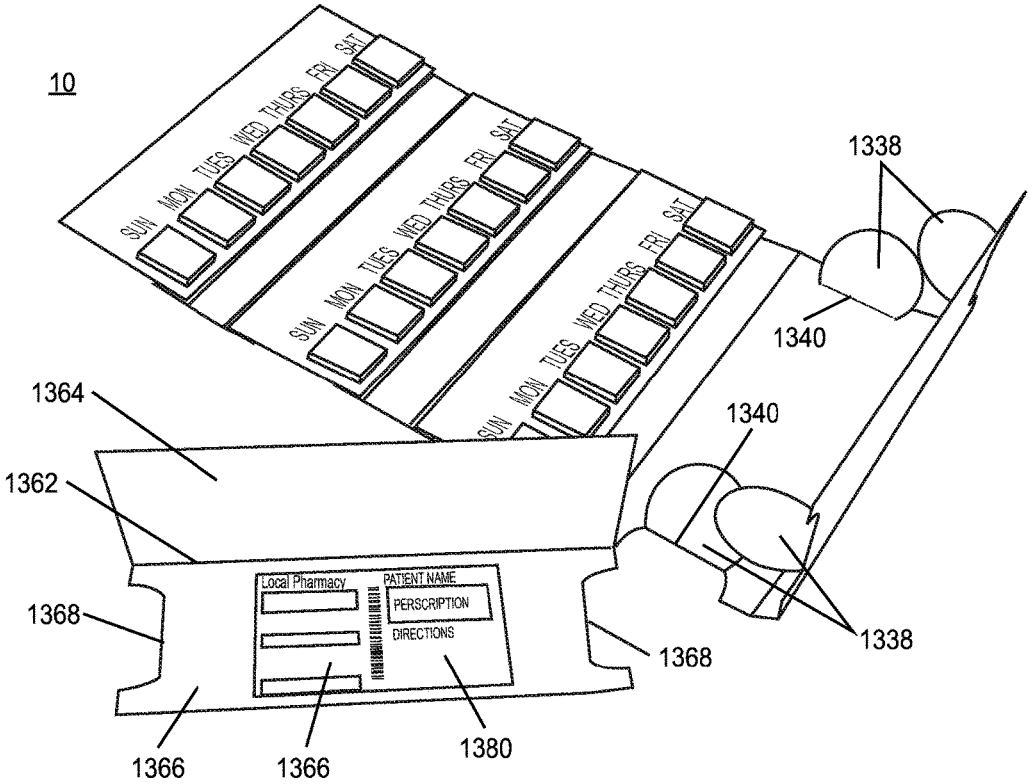
FIG. 62 is a perspective view of components of the system shown in FIG. 58.

In some embodiments, medication cards 1360 are attachable to designated portions on scroll container 1332, such as medication card portions 1334. In some embodiments, medication cards 1360 are adhered to medication card portions 1334 with an adhesive material. In some embodiments, scroll container 1332 includes oppositely positioned flaps 1338 at each medication card portion 1334. Flaps 1338 are attached with scroll container 1332 at a fold line 1340, and extend beyond a width of medication card portions 1334 of scroll container 1332. Flaps 1338 are rotatable about folding lines 1340 relative to medication card portions 1334 through an angular range of 0 through about 360 degrees. Flaps 1338 are configured to receive an adhesive material such that when folded along folding lines 1340 and onto a medication card 1360, flaps 1338 will hold medication card 1360 in place, as discussed herein. Folding lines 1340 are indented from the edges of medication card portions 1334 to increase the reach of flaps 1338 over medication card 1360 placed over card portion 1334 for increased stability. In some embodiments, flaps 1338 extend from the edges of card portion 1334 such that folding lines 1340 are flush with the edges. In some embodiments, this configuration may be advantageous in manufacture involving certain materials. In some embodiments, as shown in FIG. 62, flaps 1338 include a rounded shape, however, flaps 1338 may be alternately shaped as oval, oblong, triangular, rectangular, square, polygonal, irregular, uniform.

Figure 59:
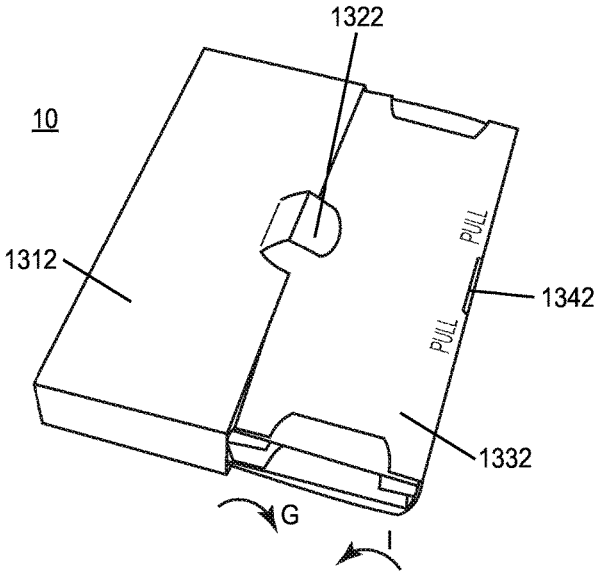
FIG. 59 is a perspective view of components of the system shown in FIG. 58.
Figure 60:
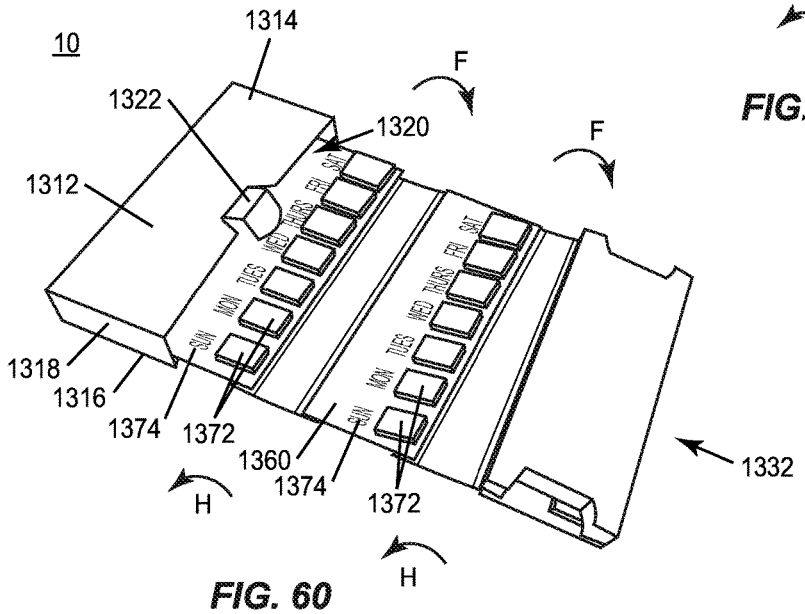
FIG. 60 is a perspective view of components of the system shown in FIG. 58.

In some embodiments, medicament dispensing system 10 is movable between an open configuration, similar to that described herein, and a closed configuration, similar to that described herein, as shown in FIGS. 58-65. In a closed configuration, scroll container 1332 is wound or rolled up, as shown in FIGS. 58 and 59, to prevent access to contents of medicament dispensing system 10, such as, for example, medication cards 1360 contained therein. In some embodiments, in a closed configuration, scroll container 1332 provides a child and/or tamper resistant medicament dispensing container. As shown in FIG. 60, when in an open configuration, scroll container 1332 is rotatable, in the direction indicated by arrows F, to facilitate ease of access to the contents of inner cavity 1320 of sleeve 1312.

When moving to the closed configuration, medication card portions 1334 and spine portions 1336 are rotated toward one another, in a direction shown by arrow H. The user rotates each medication card portion 1334 along folding lines positioned between medication card portions 1334 and spine portions 1336. A user rotates each consecutive medication card portion 1334 and spine portion 1336 in turn starting at terminal end 1344 until all medication cards 1360 are enclosed on the inside of scroll container 1332.

Figure 63:
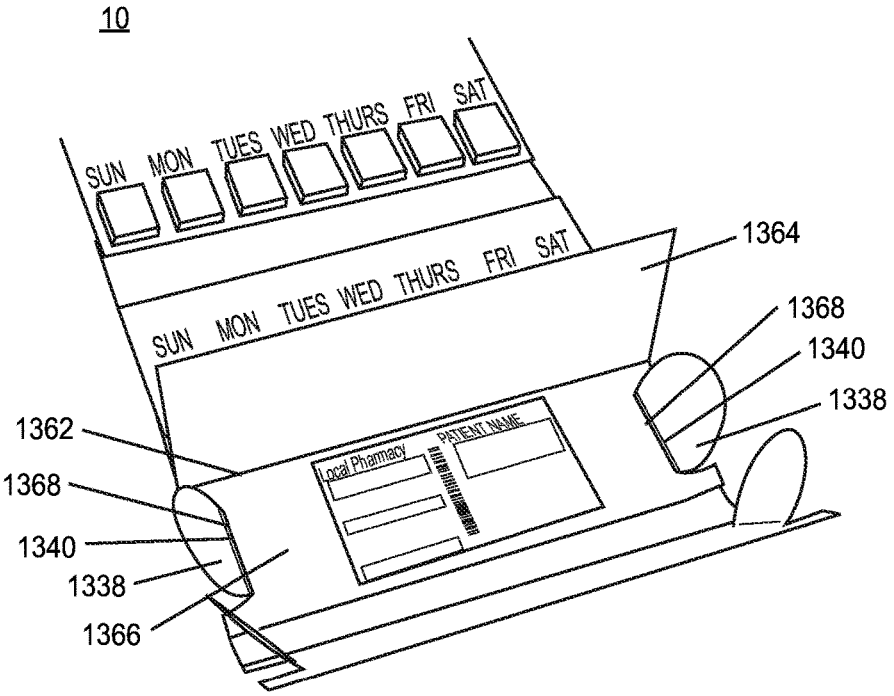
FIG. 63 is a perspective view of components of the system shown in FIG. 62.
Figure 64:
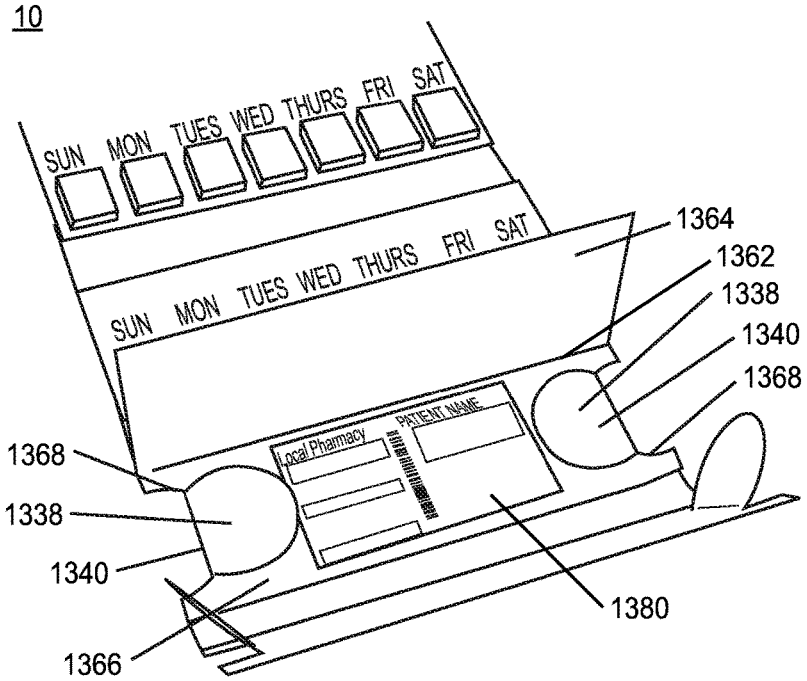
FIG. 64 is a perspective view of components of the system shown in FIG. 58.
Figure 65:
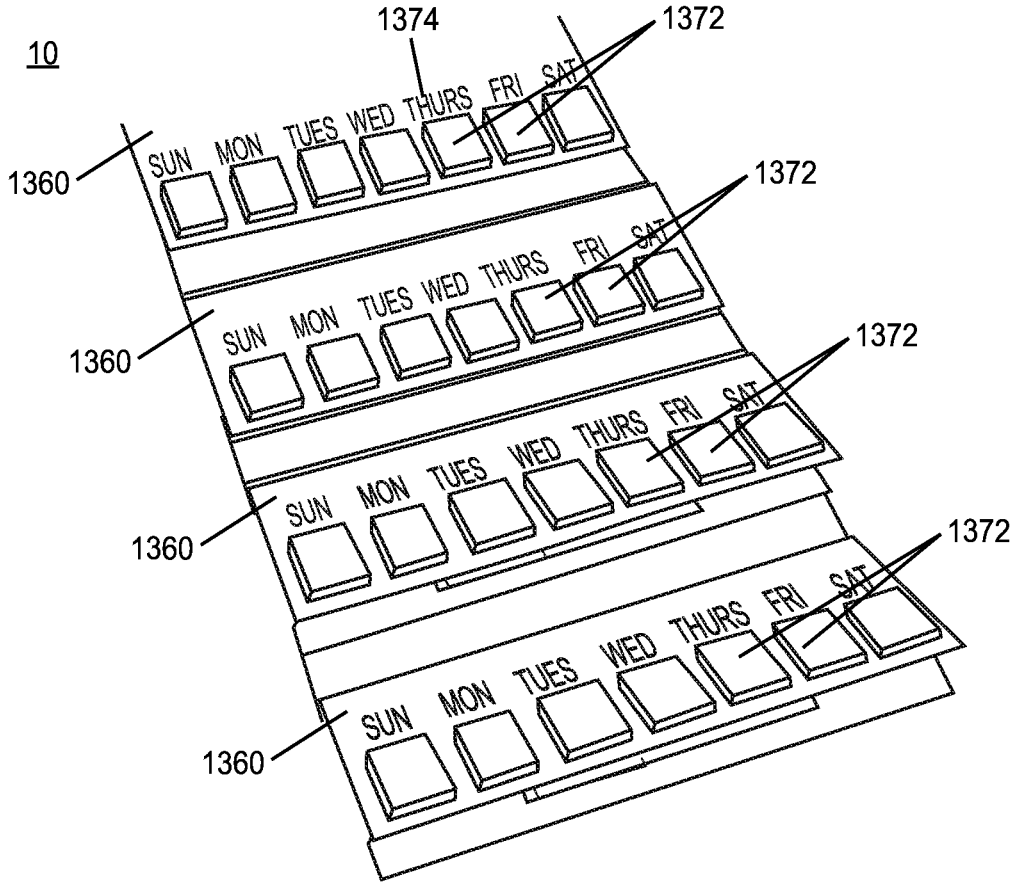
FIG. 65 is a perspective view of components of the system shown in FIG. 58.

Scroll container 1332 comprises one or more medication cards 1360 that store and/or contain one or more medications, such as, for example, a dose of at least one medication. The dose of medication(s) is enclosed and sealed in a plurality of receptacles 1372. In some embodiments, scroll container 1332 includes a plurality of medication cards 1360. In some embodiments, medication cards 1360 include a central fold along a ridge 1362 to define a front portion 1364 and a rear portion 1366. In some embodiments, rear portion 1366 includes oppositely positioned cutouts 1368 sized and configured to receive flaps 1338 sized to fit within cutout 1368 of scroll container 1332, as shown in FIG. 63. Each medication card 1360 is placed onto a corresponding medication card portion 1334 adjacent one or two spine portions 1336. Each medication card 1360 is held in place by oppositely positioned flaps 1338 that are folded to contact and adhere to a front-facing inner surface of medication card 1360. Ridge 1362 is deflectable to define an axis of rotation for medication cards 1360 allowing for rotation of medication cards 1360 to view and access information disposed on a rear-facing surface of portion 1364 or a front-facing surface of portion 1366. In some embodiments, each medication card 1360 encloses a different medication such that each medication that is part of a patient's dosage regimen is organized on separate medication cards 1360.

In some embodiments, medication card 1360 comprises receptacles 1372 indicating a patient's daily dosage of medication held within medication card 1360. In some embodiments, medication card 1360 comprises indicia 1374, disposed with and displayed from a predetermined portion adjacent one or more receptacles 1372, indicating information regarding the medication enclosed within receptacles 1372. In some embodiments, receptacles 1372 are transparent or translucent and extend from a front-facing surface of portion 1364 to allow a user to easily view whether a medicament has been taken.

In some embodiments, medication card 1360 comprises seven receptacles 1372. One dosage unit is enclosed in each receptacle 1372. Receptacles 1372 are horizontally arranged in a row adjacent to one another. Medication card 1360 comprises indicia 1374 indicating the time and/or order in which the medications are to be taken by the patient. In some embodiments, each receptacle 1372 is labeled with an arrow having the day the dosage should be taken according to a dosage regimen. Indicia 1374 can be screen printed on medication card 1360. In some embodiments, indicia 1374 may be hand written. Sections of medication card 1360 may be left blank to allow hand written notes or instructions by a patient, pharmacist or doctor.

In some embodiments, scroll container 1332 includes several medication cards 1360 adhered to medication card portions 1334 and spaced apart by spine portions 1336. In some embodiments, each medication card 1360 includes one row of seven receptacles 1372. Each receptacle 1372 is positioned adjacent indicia 1374 to provide information relating to the medicaments held within the receptacles. Medication cards 1360 are aligned on the surface of scroll container 1332 such that each row of receptacles 1372 align into columns such that a first receptacle 1372 of each medication card 1360 is aligned into a first column, a second receptacle 1372 of each medication card 1360 is aligned into a second column, a third receptacle 1372 of each medication card 1360 is aligned into a third column, etc. The arrangement of receptacles 1372 aids a user in maintaining compliance with a complex dosage regimen. Thus, compliance with a complex dosage regimen, such as a regimen requiring multiple medications each day, is made easier by having visibility of each of the medications required to be taken at once in a column view. Similarly, a patient can easily tell which medicaments have been taken already, and which medicaments have yet to be taken by looking to the columns of receptacles 1372 which have been broken.

In some embodiments, medicament dispensing system 10 comprises one or more information labels 1380 to educate a patient about a medication being administered in the dosage regimen. In some embodiments, label 1380 comprises indicia, similar to that described herein, to indicate the name and/or nature of the medicine being administered. In some embodiments, the indicia include a list of possible side effects of the medications being administered. In some embodiments, the indicia provide instructions on how long a patient should take the medication being administered. In some embodiments, label 1380 is a sticker that is adhered onto a front-facing surface of portion 1366 and/or a rear-facing surface of portion 1364. Thus, label 1380 is positioned so that it may be viewed upon a user flipping open medication card 1360 to expose inner information surfaces.

In use, scroll container 1332 is portable such that the user/patient transports and/or carries scroll container 1332 upon discharge. Tab 1322 is moved from a locked configuration to a non-locked configuration, and scroll container 1332 is drawn from sleeve 1312, in the direction shown by arrow E in FIG. 58. As scroll container 1332 translates from sleeve 1312, scroll container 1332 is extended such that scroll container 1332 rotates about tether 1333, in a direction shown by arrow G in FIG. 59, relative to sleeve 1312. In the open configuration, scroll container 1332 is rotated, in the direction shown by arrows F in FIG. 60, to expose medication cards 1360. The contents of scroll container 1332, which may include medication cards 1360 and/or information labels 1380, as described herein, are accessible to the user/patient. The user/patient employs the components of medicament dispensing system 10, for example, following direction via indicia 1374 for administering dosage units from receptacles 1372 and/or following instruction from indicia 1374 and/or labels 1380, to facilitate user/patient compliance with the medication regimen in connection with treatment for the myocardial infarction.

Once a patient has accessed the medication required for the dosage regimen, scroll container 1332 is wound or rolled, in the direction shown by arrows H in FIG. 60, to close scroll container 1332. Scroll container 1332 is rotated relative to tether 1333, in a direction shown by arrow I in FIG. 59, to a closed configuration. Scroll container 1332 is translated into inner cavity 1320 of sleeve 1312, in a direction shown by arrow J in FIG. 58. Tab 1322 is moved to a locked configuration such that scroll container 1332 is disposable in a child and/or tamper resistant configuration for storage and subsequent use.

In one embodiment, as shown in FIGS. 66-72, medicament dispensing system 10, similar to the systems and methods as described herein, includes a sleeve 1412 having a generally trapezoidal cross-sectional shape. Sleeve 1412 includes a top face 1414, a bottom face 1416, a tapered front face 1418, and a back face 1420. In one embodiment, top face 1414 and bottom face 116 have rectangular shapes. Tapered front face 1418 extends substantially between top face 1414 and bottom face 1416 at an angle sloping downward toward the front of sleeve 1412 to securely accommodate a container 1432 configured to hold a tiered arrangement of medication cards 1460, as described herein. Sleeve 1412 includes an inner surface that defines an inner cavity 1426. Inner cavity 1426 includes a passageway configured to receive medication cards 1460. Sleeve 1412 includes an opening between top face 1414 and bottom face 1416 configured to provide access to inner cavity 1426.

Container 1432 includes a plurality of medication cards 1460 disposed in a tiered configuration. Container 1432 includes opposing side walls 1434 which have a profile configured to slide into inner cavity 1426. In some embodiments, fasteners 1442 are configured to attach medication cards 1460 with container 1432, as described herein.

Container 1432 is configured for disposal within inner cavity 1426, as described herein. Container 1432 is attached with sleeve 1412 by a tether 1433. Tether 1433 is configured such that container 1432 is extendable from inner cavity 1426 but not detachable from sleeve 1412. Tether 1433 is configured to provide a range of motion for movement of container 1432 relative to sleeve 1412. In some embodiments, container 1432 is pivotable about tether 1433 in an angular range of 0 to 360 degrees. In some embodiments, tether 1433 is configured to provide movement of container 1432 within a predetermined distance from sleeve 1412 to allow container 1432 to be extended.

In some embodiments, instructive indicia are positioned adjacent an opening in sleeve 1412 to aid a user in removing container 1432 from sleeve 1412. In some embodiments, the indicia are positioned on a surface of container 1432 visible from an opening in sleeve 1412. For example, the indicia may be in the form of instructive text such as "pull here" that may be printed onto the surface of container 1432.

In some embodiments, medicament dispensing system 10 is movable between a locked configuration, similar to that described herein, and an non-locked configuration, similar to that described herein, as shown in FIGS. 66-72. In some embodiments, sleeve 1412 includes a button 1422 positioned on back face 1420 of sleeve 1412. Button 1422 is configured to actuate an internal locking mechanism that releasably fixes sleeve 1412 with container 1432 in the locked configuration. Actuation of button 1422 causes container 1432 to disengage from sleeve 1412. In some embodiments, instructive indicia are positioned adjacent button 1422 to aid a user in moving medicament dispensing system 10 from the locked to the non-locked configuration. In some embodiments, the indicia are positioned on button 1422. In other embodiments, the indicia are positioned on a surface of sleeve 1412 adjacent button 1422. In some embodiments, instructive text such as "press here" may be printed on or adjacent to button 1422. In some embodiments, instructive text such as "pull here" with an accompanying arrow may be printed adjacent button 1422.

Figure 66:
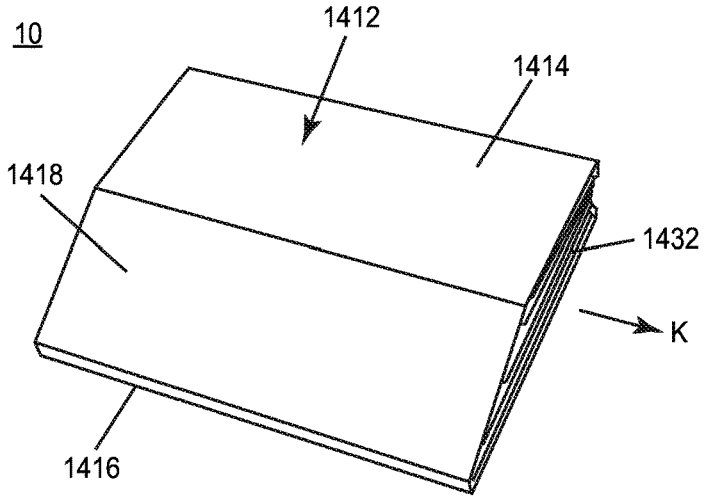
FIG. 66 is a perspective view of components of one embodiment of a system in accordance with the principles of the present disclosure.
Figure 67:
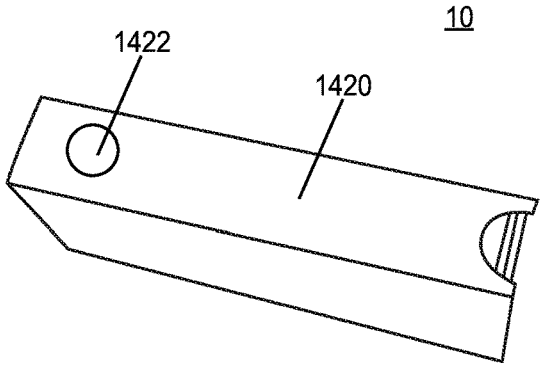
FIG. 67 is a perspective view of components of the system shown in FIG. 66.

In the non-locked configuration, container 1432 is translated out of sleeve 1412, in a direction shown by arrow K in FIG. 66. Container 1432 is configured to rotate about tether 1433, in directions shown by arrows L and M in FIG. 68, relative to sleeve 1412 to facilitate manipulation of container 1432 and medication cards 1460. In the non-locked configuration, one or more medication cards 1460 are accessible from container 1432.

Figure 68:
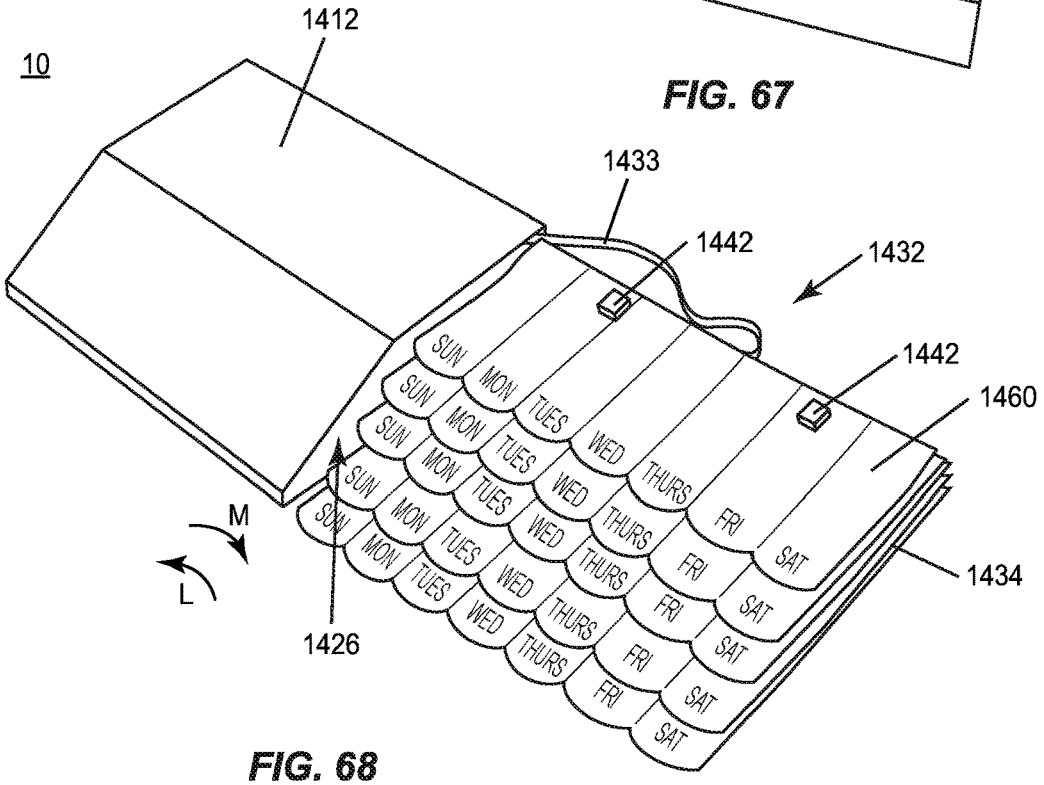
FIG. 68 is a perspective view of components of the system shown in FIG. 66.

Container 1432 includes tiered surfaces having fasteners 1442 configured to receive a medication card 1460. In some embodiments, each stepped surface includes two spaced apart fasteners 1442. In alternate embodiments, each step may include more or less fasteners 1442. For example, each step may include one or three fasteners 1442. A fastener 1442 projects from a stepped surface and is configured to hold a medication card 1460 in place. In some embodiments, fastener 1442 extends in a cantilever configuration from a stepped surface of container 1432. Each fastener 1442 includes a hook end configured for disposal with an opening 1468 for capture of a medication card 1460, as discussed herein. In some embodiments, container 1432 includes several rows of fasteners 1442 to hold multiple medication cards 1460 in place. In some embodiments, as shown in FIG. 68, container 1432 includes five tiered surfaces and five corresponding rows of fasteners 1442 to hold five medication cards 1460. In some embodiments, container 1432 may include one or a plurality of tiered surfaces and rows of fasteners 1442.

Medication cards 1460 are configured to enclose doses of medication(s) in a plurality of receptacles 1472. In some embodiments, medication cards 1460 include a central fold along ridge 1462 to define a front portion 1464 and a rear portion 1466. Ridge 1462 is deflectable to define an axis of rotation for medication card 1460. In some embodiments, medication cards 1460 can be rotated to view and access information held on a rear-facing surface of portion 1466 or a front-facing surface of portion 1464. In some embodiments, medication card 1460 comprises one or more information labels 1480 to educate a patient about a medication being administered in the dosage regimen. In some embodiments, each medication card 1460 encloses a different medication such that each medication that is part of a patient's dosage regimen is organized on separate medication cards 1460. In some embodiments, medication card 1460 comprises receptacles 1472 indicating a patient's daily dosage of medication held within medication card 1460, as described herein.

Figure 69:
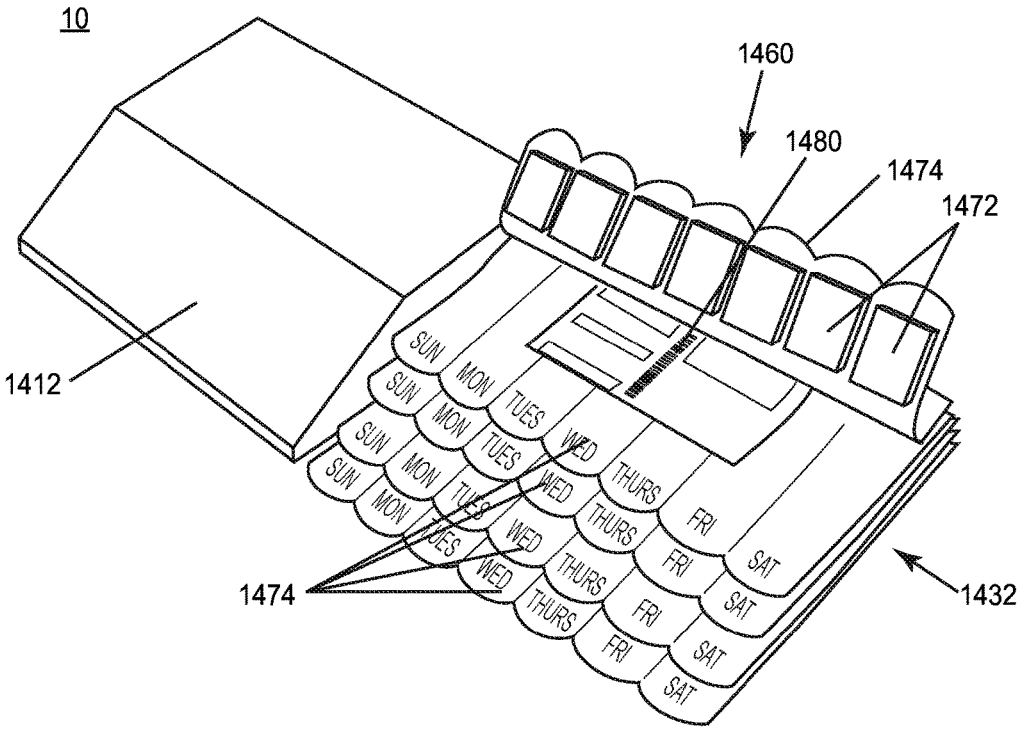
FIG. 69 is a perspective view of components of the system shown in FIG. 66.
Figure 70:
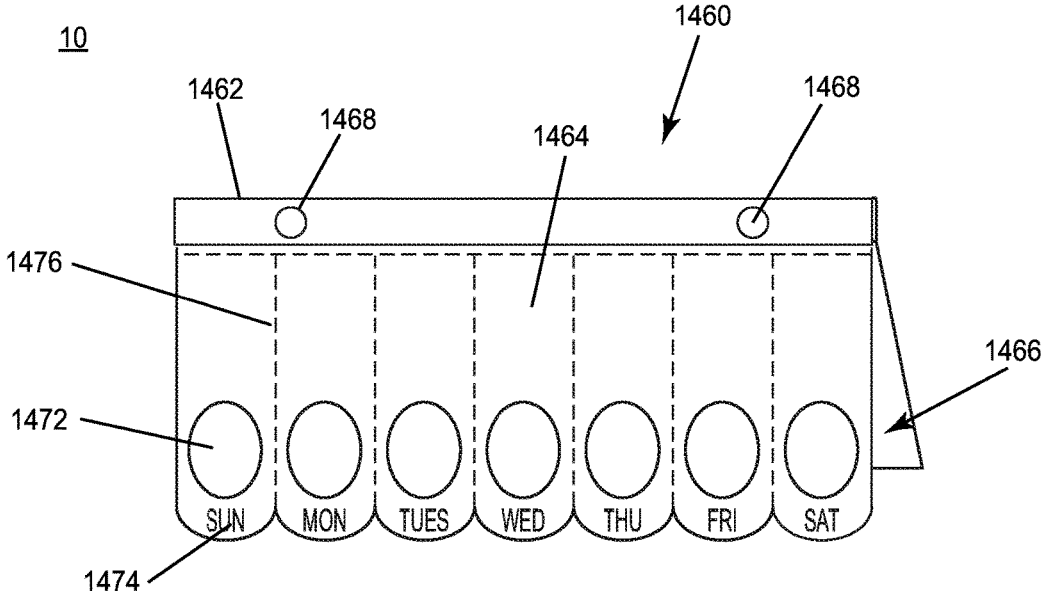
FIG. 70 is a perspective view of components of the system shown in FIG. 66

Medication cards 1460 include openings 1468 that are sized to receive fasteners 1442 to fix medication cards 1460. In some embodiments, medication card 1460 includes a folding line 1470, which allows medication card 1460 to be folded to access the medicaments held within receptacles 1472 of medication card 1460 and/or additional medication cards 1460 attached to container 1432 and positioned adjacent to medication card 1460, as shown in FIG. 69. A first medication card 1460 is held by a bottom row of fasteners 1442 on a bottom tiered surface of container 1432, and a second medication card 1460 is held by a row of fasteners 1442 on a next tiered surface such that second medication card 1460 is folded up to access to the first medication card 1460. In some embodiments, third, fourth, and fifth medication cards 1460 are applied to third, fourth, and fifth rows of fasteners 1442.

Figure 71:
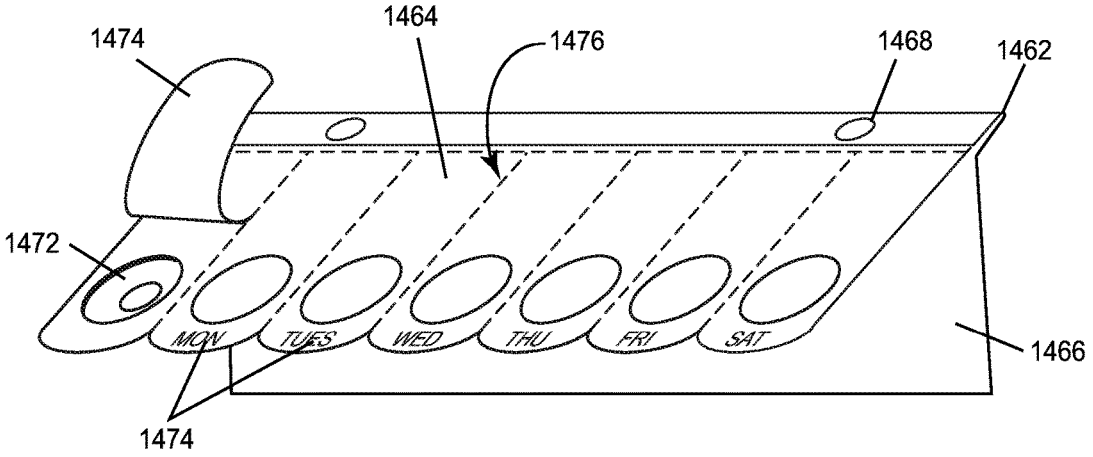
FIG. 71 is a perspective view of components of the system shown in FIG. 66.

In some embodiments, medication card 1460 comprises indicia tabs 1474, disposed with and displayed from a predetermined portion adjacent one or more receptacles 1472, indicating information regarding the medication enclosed within receptacles 1472. In some embodiments, indicia tabs 1474 are presented as a color to convey information to a user. In some embodiments, tabs 1474 include a day of the week in which a user is to take the medication contained within a corresponding receptacle 1472. Tabs 1474 are removable from medication cards 1460. To facilitate gripping by a user, tabs 1474 extend beyond medication card 1460, as shown in FIG. 71. Tabs 1474 convey information to a user to increase compliance with a complex dosage regimen such that upon reading the indicia presented on tabs 1474, a user grips tab 1474, and pulls to tear the tab away from a medication card 1460 along perforated lines 1476. Upon removal of tab 1474, a medicament is available to be taken from receptacle 1472.

Figure 72:
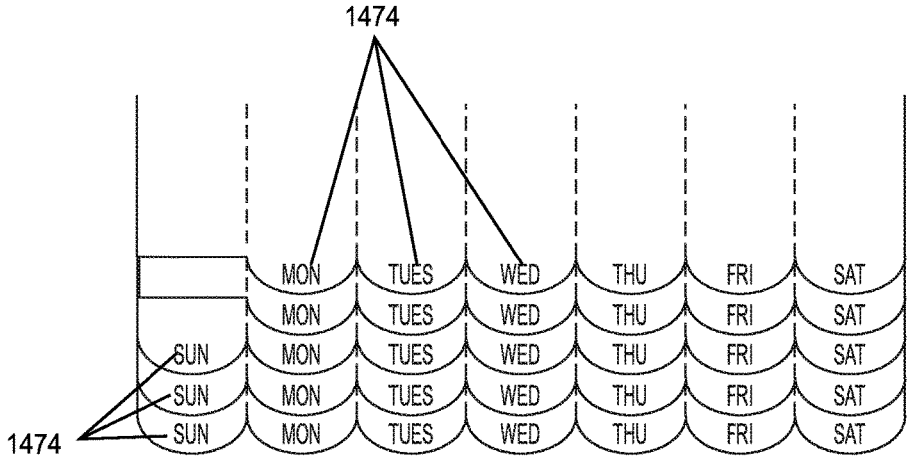
FIG. 72 is a perspective view of components of the system shown in FIG. 66.

In some embodiments, container 1432 includes several medication cards 1460 arranged such that all tabs 1474 are arranged to be easily viewed by a user. In some embodiments, each medication card 1460 includes one row of seven tabs 1474. Each tab 1474 is positioned adjacent to a receptacle 1472 to provide information relating to the medicaments held within the receptacles. Medication cards 1460 are aligned in a tiered configuration on container 1432 such that each row of tabs 1474 aligns into columns, as shown in FIG. 72. In some embodiments, a first tab 1474 of each medication card 1460 is aligned into a first column, the second tab 1474 of each medication card 1460 is aligned in to a second column, the third tab 1474 of each medication card 1460 is aligned into a third column. The arrangement of tabs aids a user in maintaining compliance with a complex dosage regimen. Thus, compliance with a complex dosage regimen, such as a regimen requiring multiple medications each day, is made easier by having visibility of each of the medications required to be taken at once in a column view. Similarly, a patient can easily tell which medicaments have been taken already, and which medicaments have yet to be taken by looking to the columns of tabs 1474 which have been removed. In some embodiments, as shown in FIG. 72, a user can determine at a glance that two doses intended to be taken on Monday have been taken since two tabs 1474 in the first column have been removed, and three tabs 1474 remain.

In one embodiment, as shown in FIGS. 73-76, medicament dispensing system 10, similar to the systems and methods as described herein, includes a medicament dispensing container 1512. Medicament dispensing container 1512 includes a wall, such as, for example, a cover 1514 and a wall, such as, for example, a cover 1524. Cover 1514 includes a bottom section 1516, a front sidewall 1518, and opposing sidewalls 1520. In one embodiment, bottom section 1516 comprises a rectangular shape. Sidewalls 1520 are disposed on opposing sides of bottom section 1516 such that sidewall 1518 extends between sidewalls 1520.

Cover 1524 includes a top section 1526, a front sidewall 1528, and opposing sidewalls 1530. Sidewalls 1530 are disposed on opposing sides of top section 1526 such that sidewall 1528 extends between sidewalls 1530. In one embodiment, top section 1526 comprises a rectangular shape. In some embodiments, sidewall 1528 is configured to mate with sidewall 1518 to close medicament dispensing container 1512. In some embodiments, sidewall 1528 mates with sidewall 1518 via clips, clasps, magnet, key/keyway, interference fit, friction fit, hinged part, male/female part and/or adhesive.

Cover 1524 is attached with cover 1514 by a tether 1540. Tether 1540 is configured such that cover 1524 is extendable from cover 1514 but not detachable from cover 1522. Tether 1540 is configured to provide a range of motion for movement of cover 1524 relative to cover 1514. In some embodiments, cover 1524 is pivotable about tether 1540 in an angular range of 0 to 360 degrees. In some embodiments, tether 1540 is configured to provide movement of cover 1524 within a predetermined distance from cover 1514 to cover 1524 to extend and display medication cards 1560.

Figure 73:
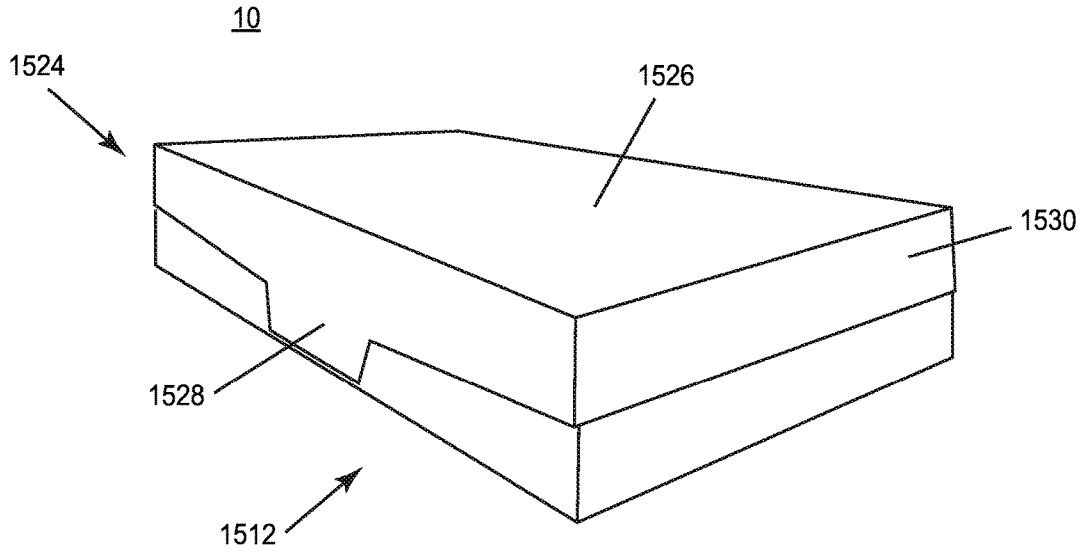
FIG. 73 is a perspective view of components of one embodiment of a system in accordance with the principles of the present disclosure.
Figure 74:
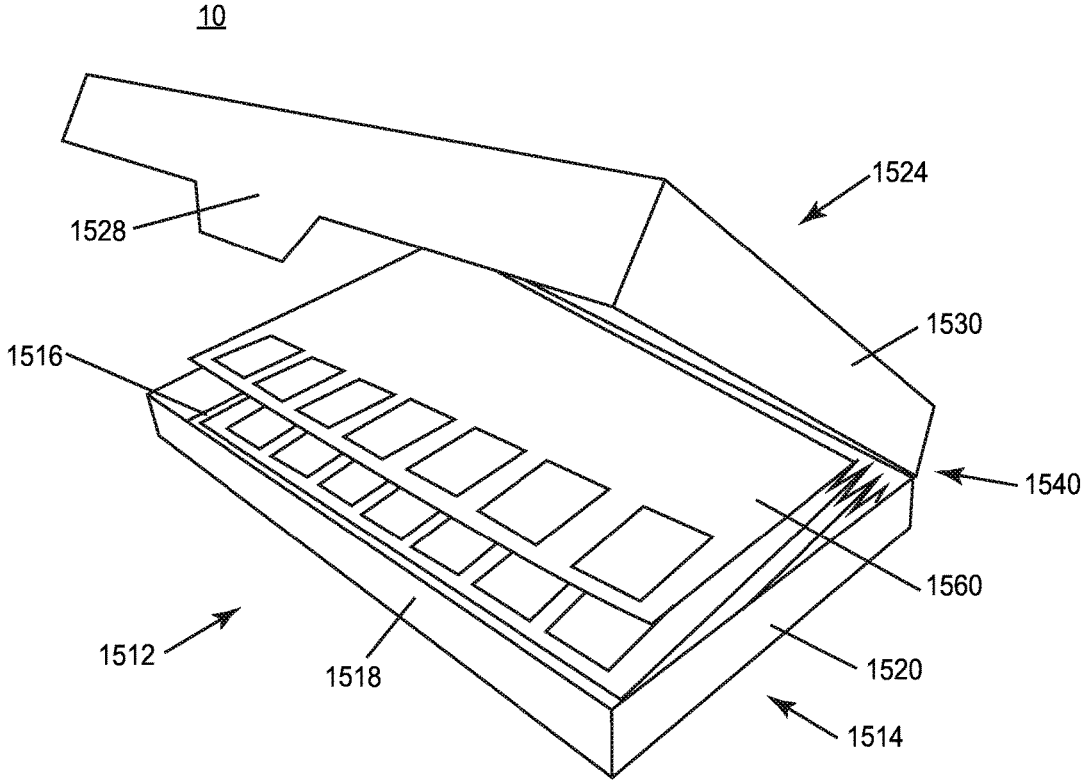
FIG. 74 is a perspective view of components of the system shown in FIG. 73.
Figure 75:
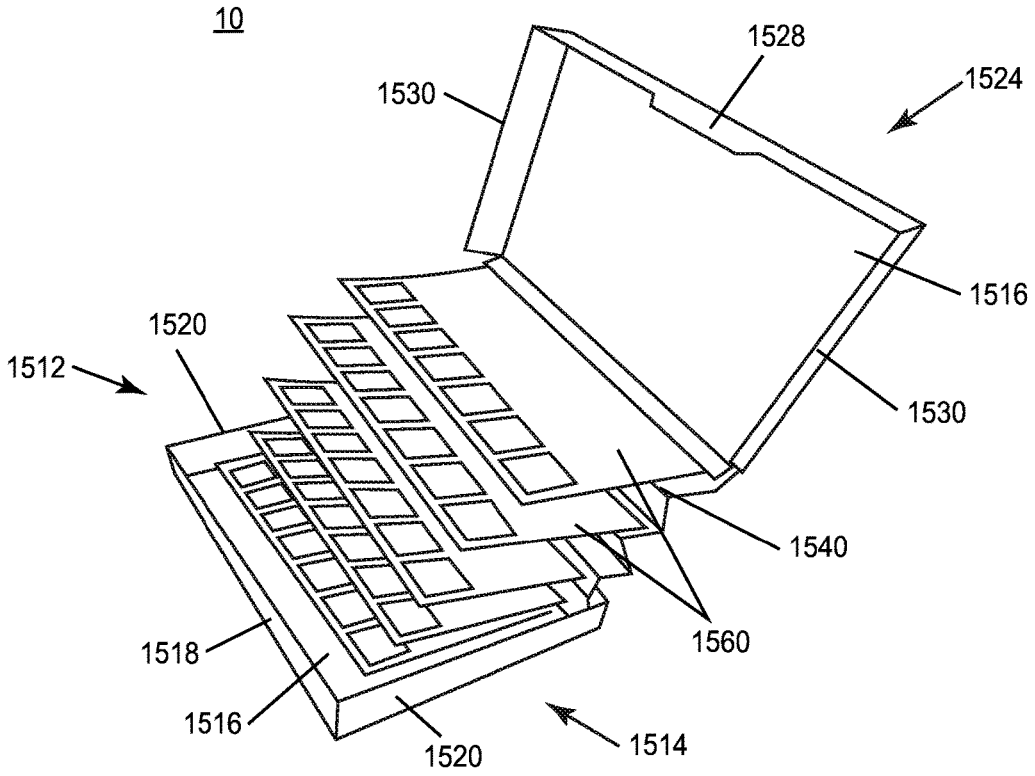
FIG. 75 is a perspective view of components of the system shown in FIG. 73.
Figure 76:
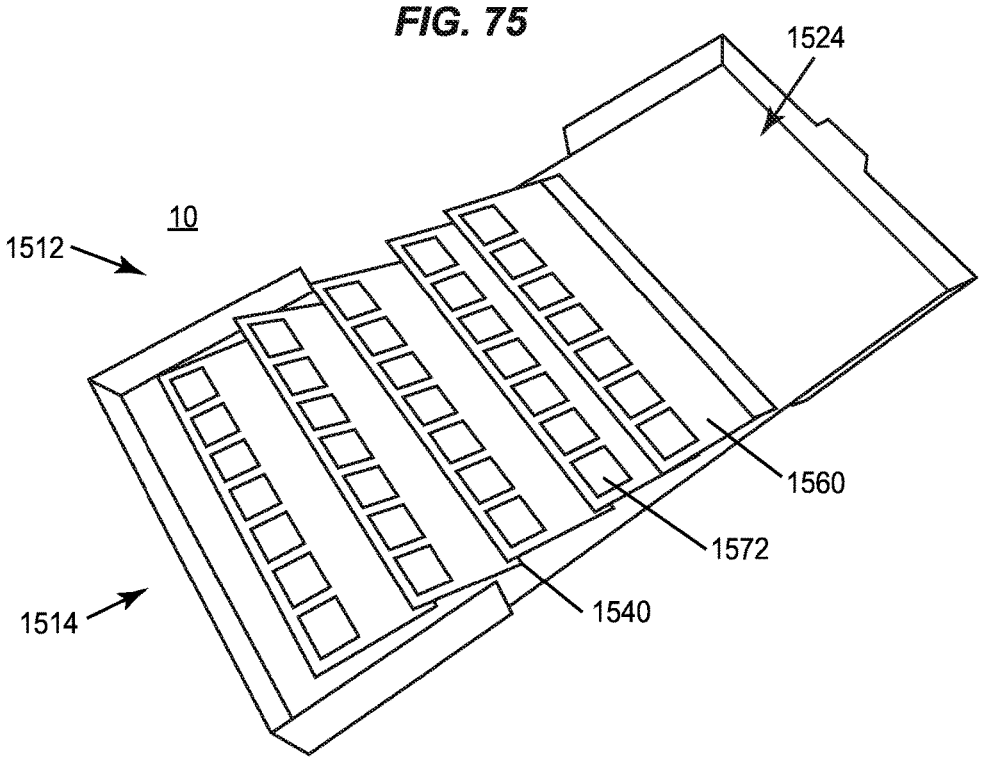
FIG. 76 is a perspective view of components of the system shown in FIG. 73.
Figure 77:
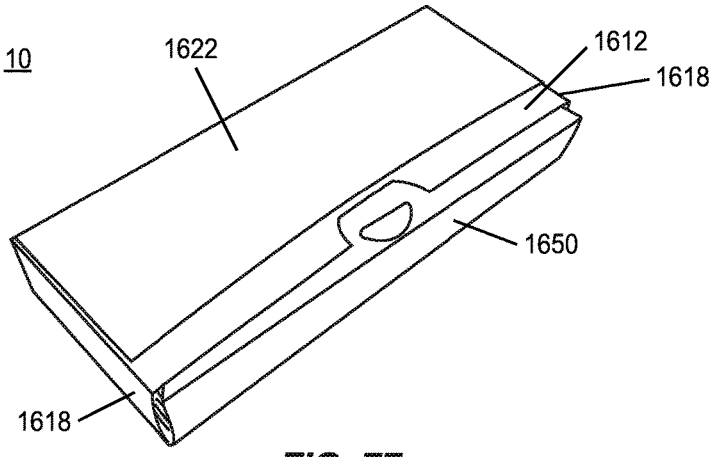
FIG. 77 is a perspective view of components of one embodiment of a system in accordance with the principles of the present disclosure.
Figure 78:
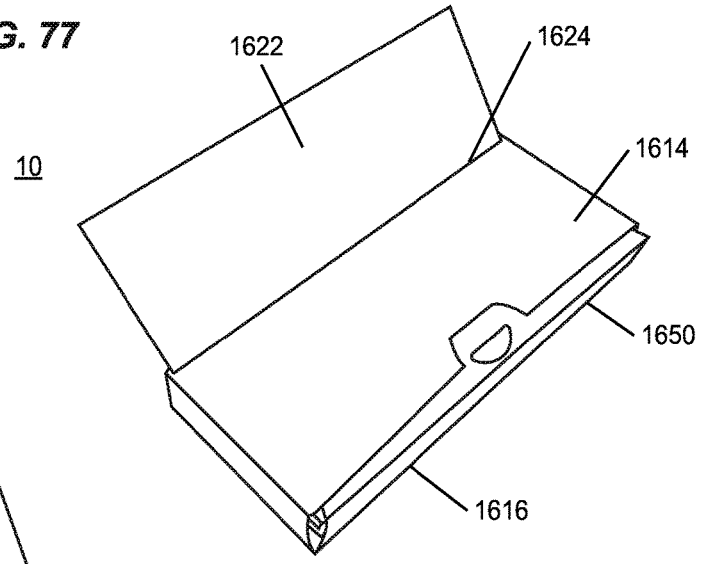
FIG. 78 is a perspective view of the components shown in FIG. 77.
Figure 79:
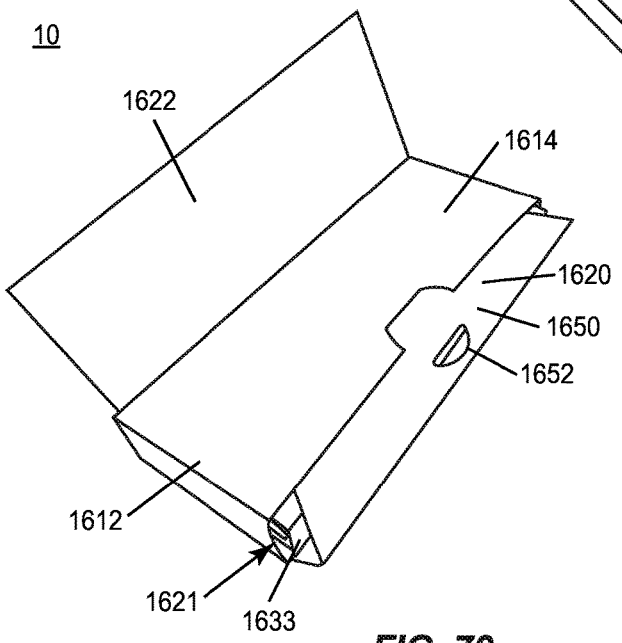
FIG. 79 is a perspective view of the components shown in FIG. 77.
Figure 80:
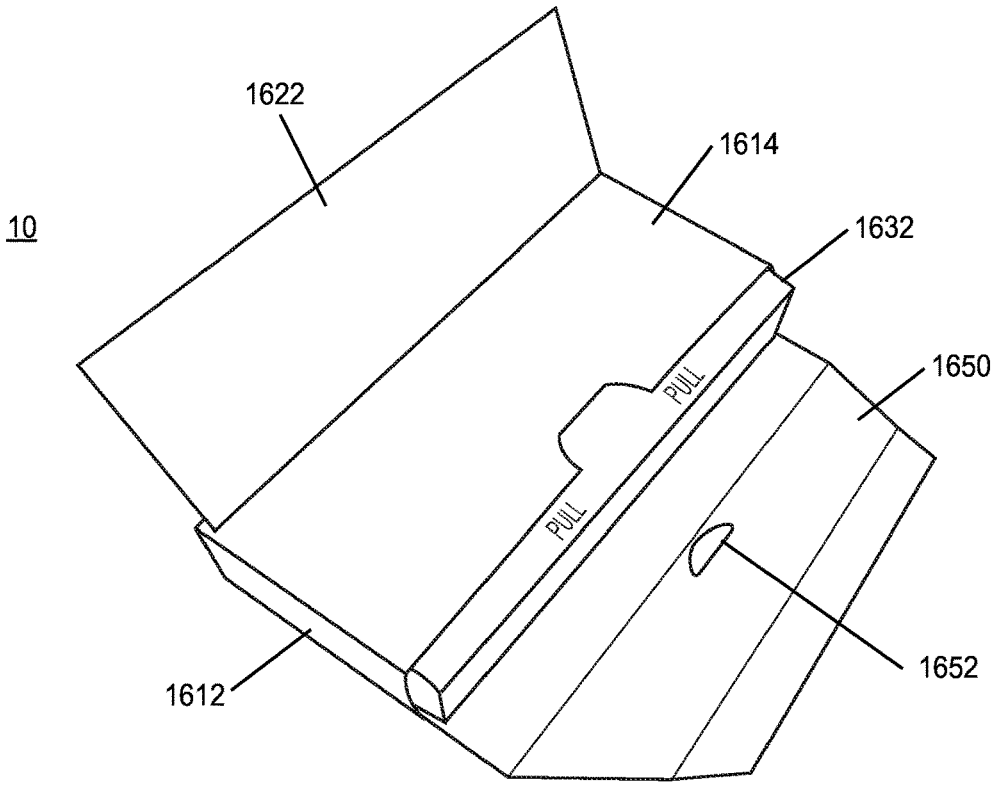
FIG. 80 is a perspective view of the components shown in FIG. 77.

In a closed configuration, similar to that described herein, as shown in FIG. 73, sidewalls 1518, 1520, 1528, 1530, and sections 1516, 1526 define a substantially enclosed cavity configured for disposal of medication cards 1560 and/or information labels, as discussed herein, such that cover 1524 and cover 1514 prevent access to contents of medicament dispensing container 1512.

In some embodiments, in a closed configuration, cover 1524 and cover 1514 provide a child and/or tamper resistant medicament dispensing container. In an open configuration, similar to that described herein, cover 1514 is rotated relative to cover 1524 such that medicament dispensing container 1512 rests flatly on a surface to facilitate ease of access to the contents of the cavity of medicament dispensing container 1512. In one embodiment, medicament dispensing container 1512 is sized to facilitate carrying and storage of printer paper, such as, for example, 9 inches by 12 inches. In some embodiments, medicament dispensing container 1512 is sized to facilitate carrying and storage of one or more unit dose packs, such as, for example, 9.5 inches by 9.5 inches by 0.9 inches.

Medicament dispensing container 1512 comprises one or more unit dose pages, such as, for example, medication cards 1560 that store and/or contain one or more medications, such as, for example, a dose of at least one medication. The dose of medication(s) is enclosed and sealed in a plurality of receptacles 1572. In some embodiments, medicament dispensing container 1512 includes a plurality of medication cards 1560. In one embodiment, each medication card 1560 is attached to a tether 1540 such that when the medication cards 1560 are in the extended state, receptacles 1572 of each medication card 1560 are visible to a user. In some embodiments, each medication card 1560 encloses a different medication such that each medication that is part of a patient's dosage regimen is organized on separate medication cards 1560. In some embodiments, medication card 1560 comprises receptacles 1572 indicating a patient's daily dosage of medication held within medication card 1560. In some embodiments, medication card 1560 comprises indicia, similar to indicia 1374, disposed with and displayed from a predetermined portion adjacent one or more receptacles 1572, indicating information regarding the medication enclosed within receptacles 1572.

In one embodiment, as shown in FIGS. 77-85, medicament dispensing system 10, similar to the systems and methods as described herein, includes a pocket and/or sleeve 1612, similar to sleeve 1312 as described herein, having a generally rectangular cross-sectional shape. Sleeve 1612 includes a top face 1614, a bottom face 1616 and sidewalls 1618. Sleeve 1612 includes a surface that defines an inner cavity 1620, similar to cavity 1320 described herein. Inner cavity 1620 includes a passageway configured to receive a medication container, such as, for example, a scroll container 1632, similar to scroll container 1332 as described herein. Sleeve 1612 includes an opening 1621 disposed between top face 1614 and bottom face 1616 configured to provide access to inner cavity 1620.

In some embodiments, sleeve 1612 includes a panel 1622 disposed on at least one of top face 1614 and/or bottom face 1616. Panel 1622 is connected to sleeve 1612 along a side 1624 of panel 1622. Panel 1622 is configured to be opened and closed. In some embodiments, panel 1622 may include information, such as, for example, additional product literature, a place for the patient to take notes about their experiences with the medicines, and/or helpful tips. In some embodiments, panel 1622 is accessible without accessing scroll container 632.

Scroll container 1632 is configured for disposal within inner cavity 1620, similar to that as described herein. Scroll container 1632 is attached with sleeve 1612 by a tether 1633, similar to tether 1333, as described herein. Tether 1633 is configured such that scroll container 1632 is drawn from sleeve 1612 but not detachable from sleeve 1612. Tether 1633 is configured to provide a range of motion for movement of scroll container 1632 relative to sleeve 1612, similar to that as described herein.

In some embodiments, medicament dispensing system 10 is movable between a locked configuration and a non-locked configuration, similar to that described herein. In some embodiments, sleeve 1612 includes a closure panel, such as, for example, a flap 1650. Flap 1650 is configured for opening and closing sleeve 1612. In some embodiments, flap 1650 is configured for releasable engagement with sleeve 1612, such as, for example, by being folded about opening 1621 and tucked into sleeve 1612. In some embodiments, flap 1650 includes an opening, such as, for example, an arcuate slot 1652 configured to facilitate opening and closing of flap 1650 by allowing the user to grasp the surface of slot 1652 and draw and/or drag flap 1650 from sleeve 1612. Flap 1650 is configured to fold around scroll container 1632 and be inserted into sleeve 1612.

Figure 81:
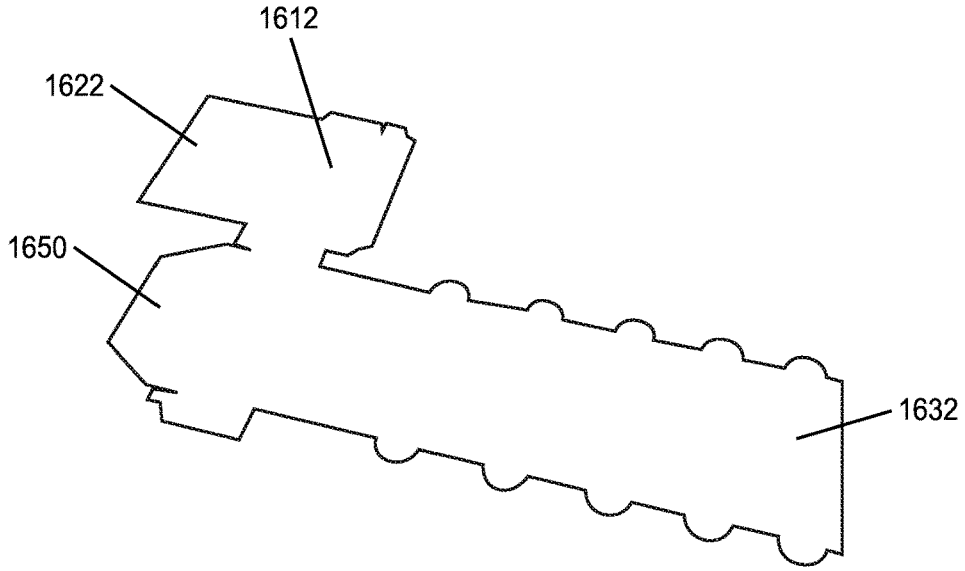
FIG. 81 is a perspective view of components of one embodiment of a system in accordance with the principles of the present disclosure.
Figure 82:
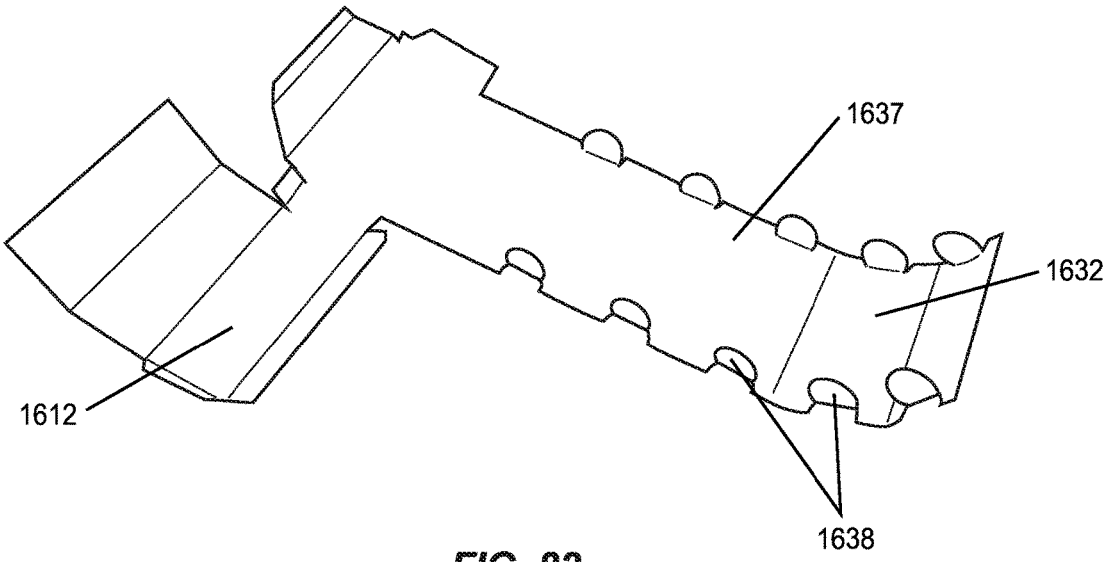
FIG. 82 is a perspective view of components of one embodiment of a system in accordance with the principles of the present disclosure.
Figure 83:
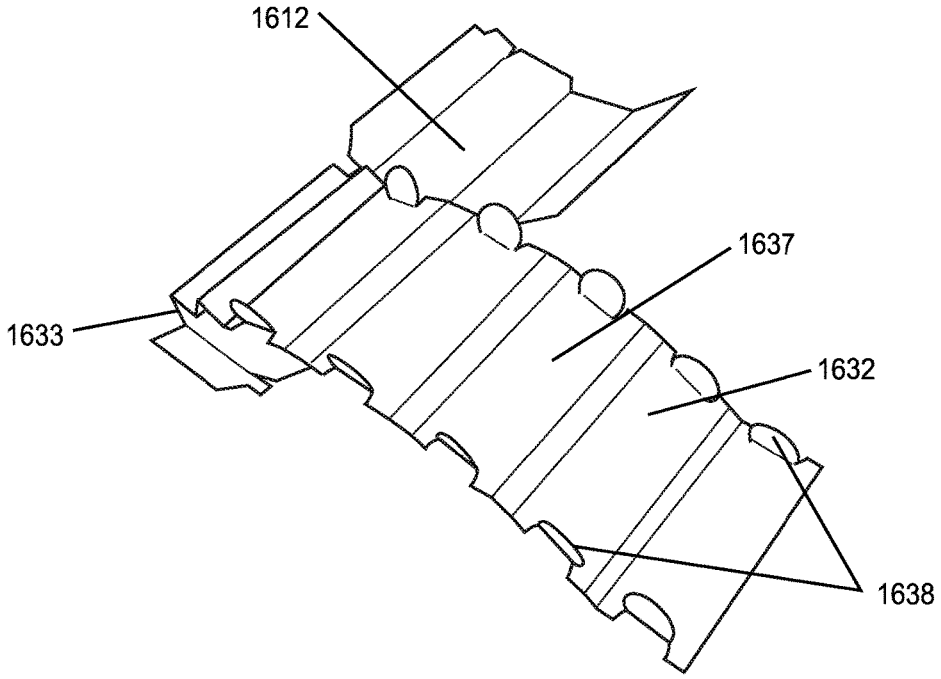
FIG. 83 is a perspective view of components of one embodiment of a system in accordance with the principles of the present disclosure.
Figure 84:
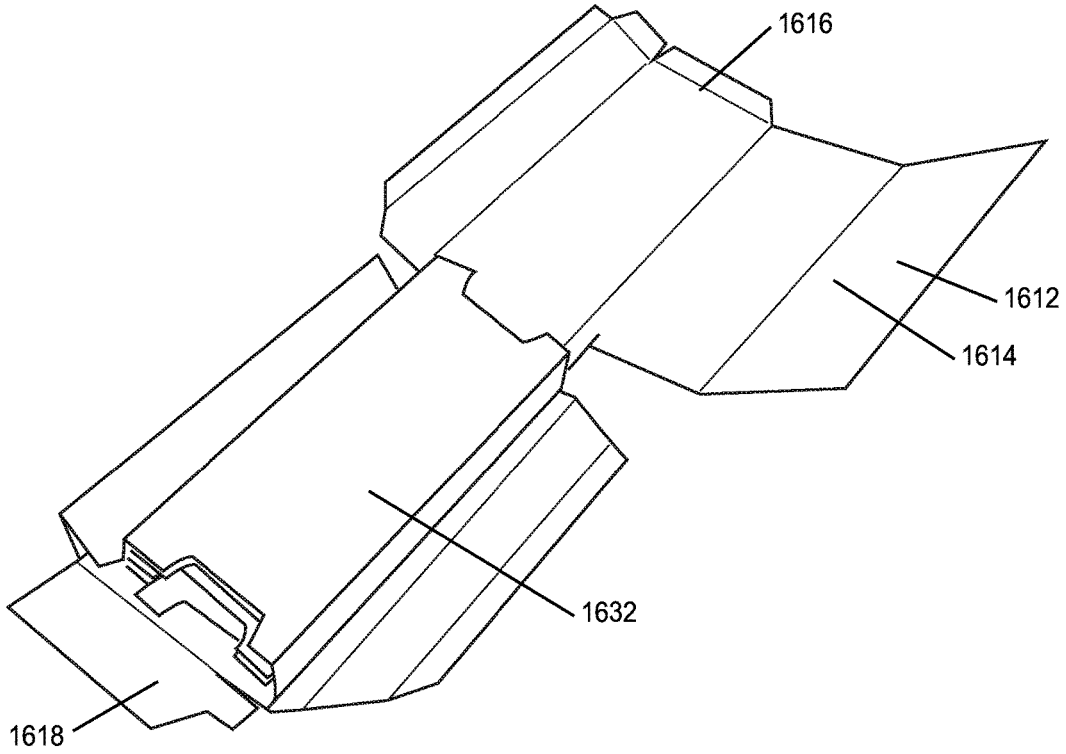
FIG. 84 is a perspective view of components of one embodiment of a system in accordance with the principles of the present disclosure.
Figure 85:
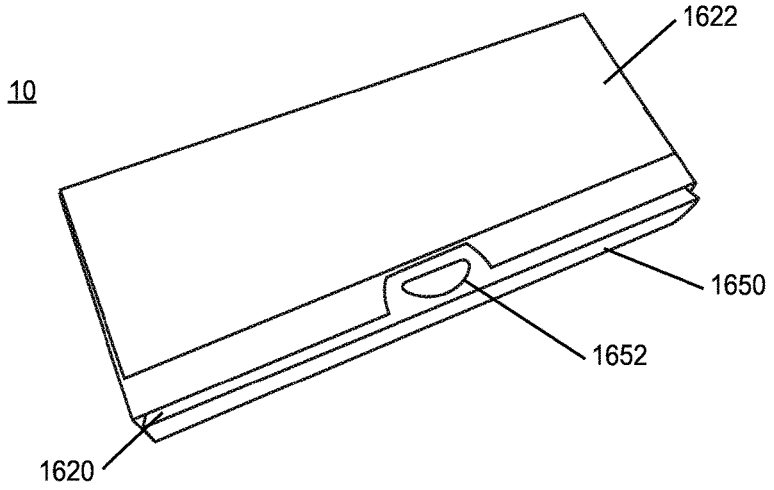
FIG. 85 is a perspective view of components of one embodiment of a system in accordance with the principles of the present disclosure.

In some embodiments, sleeve 1612 is manufactured from a single piece of card stock, as shown in FIGS. 81-85. In some embodiments, sleeve 1612 is assembled from and includes a flat configuration, as shown in FIG. 81, which is manipulated and/or manufactured to an assembled configuration, as shown in FIG. 85, for use as a medicament container for storage, transportation and discharge of medications for the treatment of a medical condition. In the flat configuration, the components, such as, for example, scroll container 1632 and flap 1650 are drawn out and disposed on a flat surface. Scroll container 1632 is assembled by folding rectangular sections 1637 and flaps 1638, as shown in FIG. 82. Sections 1637 and flaps 1638 are folded relative to tether 1633 to form scroll container 1632, as shown in FIG. 83. Sleeve 1612 is assembled by folding top face 1614, bottom face 1616 and sidewalls 1618, as shown in FIG. 84. Scroll container 1632 is disposed within and/or adjacent to the surfaces that will define inner cavity 1620. Sections 1637 and flaps 1638 are assembled into sleeve 1612 and flap 1650 is folded into cavity 1620 to dispose sleeve 1612 in a locked and/or medication non-accessible configuration, as shown in FIG. 85.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A medication dispensing container comprising:

a housing; and a scroll container fixedly connected with the housing by a tether, the scroll container comprising at least one panel, wherein each of the at least one panel comprises at least one fastener adhering a medication card thereto;

wherein the scroll container is movable about the tether relative to the housing between an accessible configuration where the medication card is accessible and a non-accessible configuration where the medication card is non-accessible.

2. The medication dispensing container of claim 1, wherein the at least one fastener comprises a flap, the flap being foldable over at least a portion of the medication card to secure the medication card to the at least one panel.

3. The medication dispensing container of claim 2, wherein the flap comprises an adhesive side and a non-adhesive side.

4. The medication dispensing container of claim 3, wherein the flap is formed from a cutout in the at least one panel.

5. The medication dispensing container of claim 1, wherein the scroll container comprises a plurality of panels, each of the panels being rotatably connected to an adjacent panel of the plurality of panels.

6. The medication dispensing container of claim 1, wherein the medication card comprises:

a front portion rotatably connected to a rear portion, wherein the front portion comprises at least one receptacle for storing a medicament, and the rear portion is configured to be received by the at least one fastener.

7. The medication dispensing container of claim 6, wherein the rear portion is received by the at least one fastener such that a back face of the rear portion contacts the at least one panel and the front portion rotates forward such that a rear face of the front portion comes into proximity with a front face of the rear portion.

8. The medication dispensing container of claim 7, wherein at least one of the front face of the rear portion and the rear face of the front portion comprises medication indicia corresponding to the medicament stored in the at least one receptacle of the front portion.

9. The medication dispensing container of claim 7, wherein the at least one fastener comprises a flap, the flap being foldable over the rear portion to contact a front face of the rear portion.

10. The medication dispensing container of claim 8, wherein the flap is formed from a cutout in the at least one panel, the rear portion being shaped to accommodate the cutout such that the flap may be folded over the rear portion when the rear portion is aligned with the at least one panel.

11. The medication dispensing container of claim 10, wherein the front face of the rear portion comprises medication indicia corresponding to the medicament stored in the at least one receptacle of the front portion, the medication indicia being positioned such that the flap does not obscure the medication indicia when the flap is folded over the rear portion.

12. The medication dispensing container of claim 9, wherein the flap comprises an adhesive side and a non-adhesive side, the adhesive side being front facing when the flap is in a non-folded position and rear facing when the flap is in a folded position.

* * * * *